US010145105B2

(12) United States Patent
Aldino et al.

(10) Patent No.: US 10,145,105 B2
(45) Date of Patent: Dec. 4, 2018

(54) MODULAR BUILDING

(75) Inventors: Albertelli Aldino, London (GB); Michael Frieh, London (GB); Marco Albini, Milan (IT); Roberto Zedda, Milan (IT)

(73) Assignee: ACELL INDUSTRIES LIMITED (GB)

( * ) Notice: Subject to any disclaimer, the term of this patent is extended or adjusted under 35 U.S.C. 154(b) by 0 days.

(21) Appl. No.: 14/123,692

(22) PCT Filed: Jun. 1, 2012

(86) PCT No.: PCT/GB2012/051258
§ 371 (c)(1),
(2), (4) Date: May 27, 2014

(87) PCT Pub. No.: WO2012/164311
PCT Pub. Date: Dec. 6, 2012

(65) Prior Publication Data

US 2014/0318037 A1 Oct. 30, 2014

(30) Foreign Application Priority Data

Jun. 3, 2011 (GB) ..... 1109361.4

(51) Int. Cl.

| | |
|---|---|
| ***E04B 7/02*** | (2006.01) |
| ***E04B 7/16*** | (2006.01) |
| ***E04B 7/24*** | (2006.01) |
| ***E04H 1/00*** | (2006.01) |
| *E04B 1/00* | (2006.01) |

(52) U.S. Cl.
CPC ..... *E04B 7/026* (2013.01); *E04B 7/163* (2013.01); *E04B 7/24* (2013.01); *E04H 1/005* (2013.01); *E04B 2001/0069* (2013.01)

(58) Field of Classification Search
CPC ..... E04B 7/026; E04B 7/163; E04B 7/24; E04B 2001/0069; E04H 1/005
USPC ..... 52/90.1, 92.1
See application file for complete search history.

(56) References Cited

U.S. PATENT DOCUMENTS

| | | | | |
|---|---|---|---|---|
| 3,257,266 A * | 6/1966 | Sapper | B29C 33/68 156/333 |
| 3,385,013 A | 5/1968 | Severson | |
| 3,645,052 A * | 2/1972 | Hanna | 52/64 |
| 3,771,277 A * | 11/1973 | Rausch et al. | 52/468 |

(Continued)

FOREIGN PATENT DOCUMENTS

| | | |
|---|---|---|
| DE | 20010385 | 11/2000 |
| FR | 1453984 | 9/1966 |

(Continued)

OTHER PUBLICATIONS

International Search Report dated Oct. 16, 2012.
GB Search Report Under Section 17, dated Sep. 28, 2011.

*Primary Examiner* — Patrick J Maestri
(74) *Attorney, Agent, or Firm* — Ryan T. Grace; Advent, LLP

(57) ABSTRACT

The invention relates to a modular building (2), to be assembled in various sizes and in various environments, having a generally triangular transverse sectional profile, wherein the modular building comprises a double sloping roof (6) over the generally triangular transverse sectional profile, and wherein the one or more double sloping roof panels comprise composite panel material.

32 Claims, 21 Drawing Sheets

(56) References Cited

U.S. PATENT DOCUMENTS

| | | | | | |
|---|---|---|---|---|---|
| 3,807,104 | A | | 4/1974 | Webster | |
| 3,942,290 | A | | 3/1976 | O'Sheeran | |
| 3,943,671 | A | * | 3/1976 | Curci | 52/69 |
| 4,024,682 | A | | 5/1977 | Jamison | |
| 4,616,452 | A | * | 10/1986 | Lemerre | 52/71 |
| 5,802,783 | A | * | 9/1998 | Bayha | 52/204.5 |
| 2007/0193213 | A1 | * | 8/2007 | Nanayakkara | E04H 9/10 52/750 |

FOREIGN PATENT DOCUMENTS

| | | | |
|---|---|---|---|
| FR | 1531426 | | 7/1968 |
| FR | 2569745 | | 3/1986 |
| FR | 2825735 | | 12/2002 |
| GB | 522619 | | 2/1939 |
| GB | 848945 | | 2/1958 |
| GB | 1145162 | | 6/1966 |
| GB | 2087452 | | 11/1980 |
| GB | 2168092 | | 6/1986 |
| GB | 2464541 | A * | 4/2010 |
| JP | H06108608 | | 4/1994 |
| KR | 200438290 | | 1/2008 |

* cited by examiner

MODULAR BUILDING

The present invention relates to a modular building to be assembled in variable sizes and in various environments, to processes of constructing such buildings and to composites for use in the construction thereof.

The modern world and recent catastrophic events, like, for example, earthquakes, typhoons, local wars, have created an urgent need for emergency housing and quickly assembled permanent housing. A seemingly ever increasing number of people in the world will only increase this need.

Currently, the only product available on the market that provides any sort solution to this need is in the form of containers which can be used to provide standard sized units and are easily shipped to different locations through existing infrastructure. This is an outdated solution. It does not provide a decent level of comfort or any security, and is certainly not an energy efficient solution.

Today's market requirement follows the LEED™ (Leadership in Energy and Environmental Design) standards for rating and certification of the performance of buildings with regard to energy and water conservation, impact on the environment, indoor environmental quality, and conservation of resources. These standards require, amongst other things, that emergency housing be:

a) earthquake (area 5) and typhoon resistant (170 miles per hour);
b) one or two floor accommodation;
c) different configuration and spaces possible with the same standard module;
d) self-sufficient in terms of energy consumption (green solution);
e) thermally insulated walls with no thermal bridges (class B);
f) flat packed transported by container;
e) fully factory prefabricated and assembled on site in one single operation;
f) corrosion proof (no metal) and waterproof;
g) different configurations possible (i.e. 1 to 3 bedroom apartments, individual villas, communal area, school);
h) wide range of traditional or contemporary facade finishes (bricks, stone, marble simulation etc.;
i) antiblast and ballistic resistant for military use with camouflage finishes; and
j) electrical and mechanical items fully integrated within the prefab system.

The present invention is a much improved alternative to the 'traditional container' in the role of emergency, or quickly assembled, housing. The present invention is suitable for civil application, like, for example, social housing. The present invention is also suitable for military applications, like, for example, army camps.

Accordingly, the present invention provides a modular building having a generally triangular transverse sectional profile, wherein the modular building comprises a double sloping roof over the generally triangular transverse sectional profile, wherein the double sloping roof is formed by one or more double sloping roof panels, and wherein the one or more double sloping roof panels comprise composite material.

Embodiments of the modular building of the present invention will now be described with reference to the drawings of which are summarized below.

Figure 1:
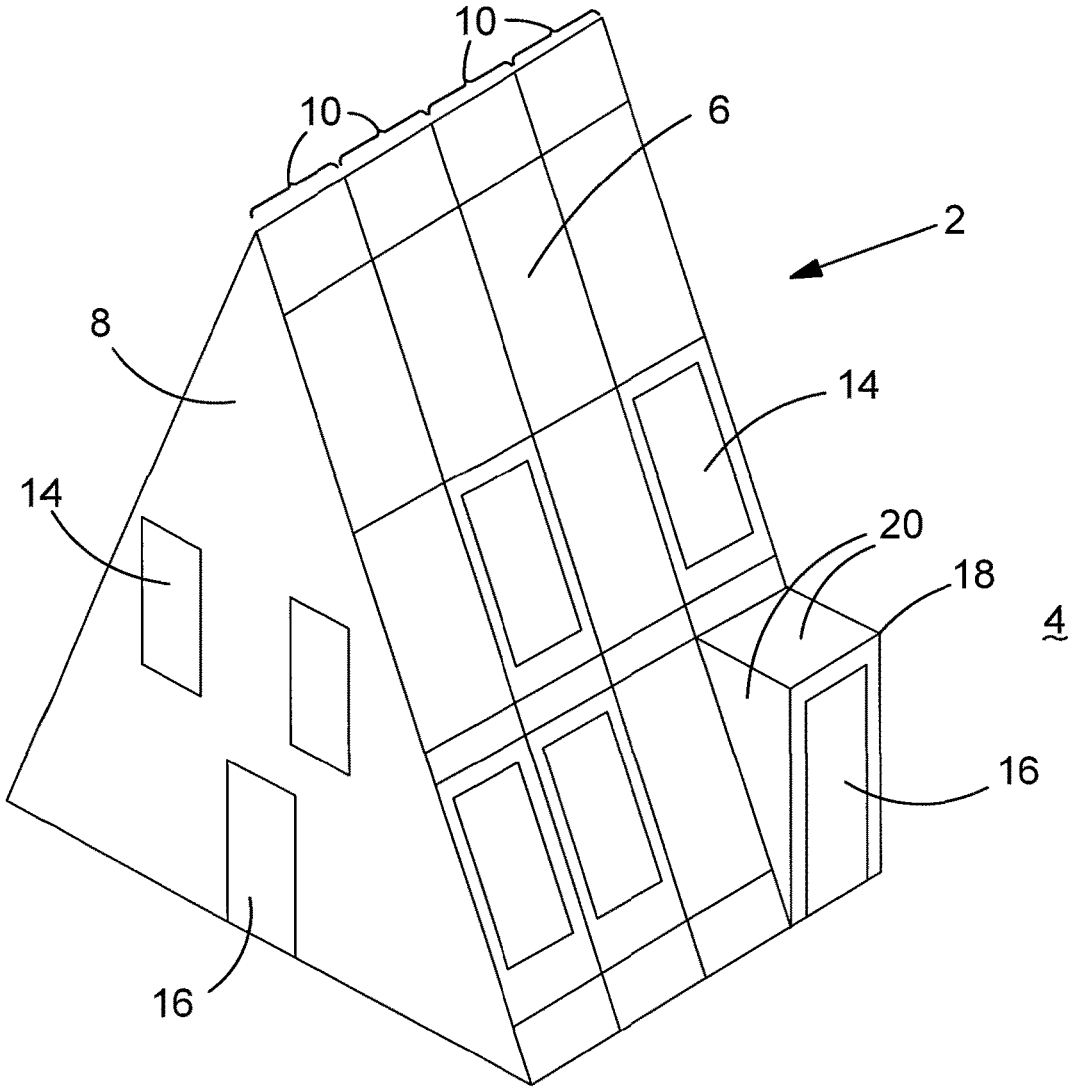
FIG. 1 is a diagrammatic perspective view of a modular building according to the present invention.

The modular building of the present invention has a generally triangular transverse sectional profile. By generally triangular cross sectional profile, it is meant that a transverse section of the modular building is generally (i.e. apart from minor variations like the contours of dormer windows) triangular from the ground to the apex of the double sloping roof. The triangular cross sectional profile of the modular building of the present invention allows a certain elasticity and deformation of the double sloping roof. This property is essential in the event of tornados, strong winds or even explosions. The pressure is shared between the absorption by the composite panel material and the partial deformation of the modular building. This flexibility cannot be achieved by any traditional type of rigid system.

Preferably, the one or more double sloping roof panels is an array of double sloping roof panels with adjoining double sloping roof edges. The modular nature of the building means that double sloping roof panels can be added or subtracted to increase, or decrease, the size of the building at will, and relatively easily and quickly. This makes for a flexible design to deal with many different situations.

The ends of the doubling sloping roof may be clad in tarpaulin or some other lightweight barrier to external elements. This saves weight and space during transportation and may be suitable in warm climates. Preferably, the modular building comprises a pair of mutually spaced triangular end walls, wherein each triangular end wall is saddled on two upper edges by the double sloping roof. The triangular walls provide additional protection to the external element and increase the structural rigidity of the modular building.

Preferably, the triangular end walls are upright. This ensures that the maximum available space inside the modular building is available for accommodation, storage etc.

Preferably, each triangular end wall is formed by end wall panels, wherein the end wall panels comprise composite panel material. The end wall panels have all the benefits of composite panel material. The end wall panels can be transported in flat packed pieces and erected quickly and easily on site.

Preferably, the end wall panels have at least one aperture equipped with a window or a door.

Preferably, the double sloping roof panels have at least one aperture equipped with a window or a door.

Preferably, the at least one aperture is equipped with a dormer formed by at least one dormer panel surrounding the window or door, wherein the at least one dormer panel comprises composite panel material. The dormer is a useful feature to sloped walls of any building because it provides the door or window with shelter from falling rain.

Preferably, the modular building comprises at least one cross member spanning the double sloping roof. The cross member provides the double sloping roof with transverse lateral rigidity.

Preferably, the at least one cross member is coupled to the double sloping roof by articulated joints. The advantage of a building with triangular transverse cross-sectional profile and articulated joints at the three corner edges is that the triangular shape building is earthquake proof and its component parts can be folded for flat pack transportation and assembly on site without manual intervention.

Preferably, the at least one cross member spans lower edges of the double sloping roof. A cross member spanning the lower edges provides the double sloping roof with increased transverse lateral rigidity and provides a base support on which the modular building can be founded.

Preferably, the at least one cross member connects adjacent double sloping roof panels. This provides the structural support to the double sloping roof by helping to unite its double sloping roof panels in a fixed.

Preferably, adjacent double sloping roof edges are sealed by a bead. This improves weather proof and water proof properties of the modular buildings.

Preferably, the at least one cross member comprises a floor panel, wherein the floor panel comprises composite panel material. This has the advantage that in addition to being a structural element of the modular building, the cross member provides a floor surface with all the benefits that composite panel material brings.

Preferably, the floor panel has an aperture for a stairway.

Preferably, the at least one cross member comprises an elongate cross bar and wherein the elongate cross bar provides support for the floor panel. The elongate bar increases the transverse lateral rigidity of the double sloping roof and suspends the floor panel.

Preferably, each double sloping roof panel comprises a frame clad with the composite panel material. The frame provides structural support to the double sloping roof panels. The frame is embedded in the double sloping roof panel. This creates a double sloping roof panel which is structurally stable.

Preferably, the composite panel material is in the form of a plurality of roof panel pieces. The roof panel pieces can be packed more densely during transportation. The roof panel pieces can be fitted, or swapped, on site thereby providing additional flexibility in the design of the modular building.

Preferably, the roof panel pieces are in complementary mating arrangement with each other and/or the frame. The roof panel pieces interlock with each other and the frame thereby adding structural rigidity to the double sloping roof panel.

Preferably, shock absorbent material interposes the frame and the composite panel material clad thereupon. This is to absorb any external forces applied to the modular building preferably without causing damage to the composite panel material. The shock absorbent material may be sacrificed and replaced, for example, where a frangible material is used. Suitable materials for constructing the shock absorbers are well within the knowledge of the person of skill in the art, and may include materials such as polymers and rubbers.

Preferably, each double sloping roof panel is formed by a pair of mutually inclined roof sections, wherein the inclined roof sections meet along edges defining a ridge, and wherein the frame of the double sloping roof panel is articulated at the ridge. This allows the double sloping roof panels to be folded and flat packed for transportation. The double sloping roof panels can be unfolded and erected on site.

Preferably, the frame of the double sloping roof panel is articulated by at least one hinge. This allows the double sloping roof panel to be easily folded and unfolded several times and thus used and re-used several times.

Preferably, the frame of each inclined roof section comprises a pair of elongate parallel side bars. The parallel side bars are embedded in the inclined roof section. This creates a monolithic roof section which is a structurally stable.

Preferably, the inclined roof sections are approximately two metres wide so that they may fit inside a container for transportation. The total thickness of a modular building which is flat packed for transportation is from 15 to 100 cm, more preferably 15 to 50 cm and most preferably 20 cm. For example, about eleven modular building can fit into one container of standard size.

Preferably, the ridge is capped by composite panel material. This is preferably done on site after the double sloping roof panel has been unfolded. The capped ridge provides improved weather proofing.

The frames and bars may be made of wood, composite material, metal or fibre glass. Preferably, the bars are made of metal because of the additional strength it provides and because of its good availability. Suitable metals include steel, aluminum and alloys of mixed metals such as stainless steel.

According to another aspect of the present invention, there is provided a double sloping roof panel for use in assembling the modular building. Individual double sloping roof panels may be needed for repair to the modular building. Alternatively, the modular nature of the building is intended to permit modification, like, for example, additional double sloping roof panels to increase the building's size. As such, there will be a need for individual double sloping roof panels according to the present invention.

According to another aspect of the present invention, there is provided a kit of panels for use in assembling the modular building. Individual panels, or a kit of panels, may be needed for repair or modification to the modular building which, as mentioned above, is specifically designed for simple maintenance or modification. As has already been mentioned, the modular building can be constructed from one sole double sloping roof panel.

According to another aspect of the present invention, there is provided a kit of bars and frames for use in assembling the modular building. The kit of bars and frames may be needed for repair or modification to the modular building which, as mentioned, above is specifically designed for simple maintenance or modification.

Suitable composite panel material for use in accordance with the present invention the may include natural materials, synthetic materials or combinations thereof. The materials are usually of different physical or chemical properties and may remain separate and distinct within the finished composite material.

In a preferred embodiment, the composites are laminates.

Examples of suitable natural materials include wood which can be used to produce engineered wood products such a wood fibre board, plywood, orientated strand board, wood-plastic composites, pykrete, plastic-impregnated/laminated paper or textiles, Arborite™, Formica™, Micarta™ and Mallite™.

Examples of suitable synthetic materials include resinous polymers such as polyester, epoxy, phenolic, polyimide, vinyl ester, polyamide, polyethylene and polypropylene.

It will also be appreciated that materials such as glass may be used either as single panes or more preferably in the form of laminates/composites.

Further materials to impart strength and rigidity may be added to the composite panels and may include glass fibres, carbon fibres, Kevlar™, metals (such as in the form of fibres and/or powders), ceramics and foams.

In a preferred embodiment, the composite panels comprise solid polymeric foams. Polymeric foams may be open-celled or closed-celled. Examples of solid, open-cell polymeric foams which may be used in accordance with this aspect of the present invention include phenolic resin foams, polystyrene foams, polyurethane foams, polyethylene foams, polyvinylchloride foams, polyvinylacetate foams, polyester foams polyether foams, and foam rubber. Preferably, the polymeric foam is selected from phenolic resin foams.

The solid polymeric foams which may be used to form panels for use according to the invention may include a finely-divided particulate reinforcing material. Suitable particulate reinforcing materials are preferably inert and insoluble. The reinforcing material may be present in an amount of up to 10 weight percent based on the total weight of the foam, for example from 2 to 10 weight percent, or 5 to 10 weight percent based on the total weight of the foam. Suitable reinforcing materials include organic or inorganic (including metallic) particulate materials, which may be crystalline or amorphous. Even fibrous solids have been found to be effective, although are not preferred. Non-limiting examples of suitable particulate materials include clays, clay minerals, talc, vermiculite, metal oxides, refractories, solid or hollow glass microspheres, fly ash, coal dust, wood flour, grain flour, nut shell flour, silica, mineral fibres such as finely chopped glass fibre and finely divided asbestos, chopped fibres, finely chopped natural or synthetic fibres, ground plastics and resins whether in the form of powder or fibres, e.g. reclaimed waste plastics and resins, pigments such as powdered paint and carbon black, and starches.

Preferred solid open-cell foams have a density in the range of 100 to 500 $kg \cdot m^{-3}$, more preferably 120 to 400 $kg \cdot m^{-3}$, and most preferably 120 to 250 $kg \cdot m^{-3}$.

The physical properties of such foams, especially the compressive strength and deflection under load are believed to be related to (amongst other factors) cell wall thickness and average cell diameter. Preferably, the average cell diameter of the solid open-cell foam is in the range of about 0.5 mm to 5 mm, more preferably 0.5 or 1 mm to 2 or 3 mm.

The cells or pores of the solid open-cell foam panel are preferably open to a surface of the core on which sheet form polymeric material is applied, and preferably they open out below the surface to a greater width than the opening, thereby providing an undercut which enhance bonding of other materials to the solid open-cell foam.

In a preferred embodiment, at least one surface of a solid open-cell foam panel may be bonded to a sheet-form polymeric material. The sheet-form polymeric material may be formed from a sheet-form curable polymeric material, for example a thermosetting polymeric material.

The sheet-form polymeric material preferably comprises a matrix comprising or consisting of a thermosetting polymer resin, for example, a thermosetting polymer resin matrix selected from polyester resins, vinyl ester resins, epoxy resins, phenolic resins, bismaleimide resins or polyimide resins. Most preferably, the sheet-form polymeric material comprises a thermosetting polymer resin matrix selected from polyester resins. The sheet-form polymeric material may also include melamine, which is useful as a fire retardant. The sheet-form polymeric material may further include additives selected from hardeners, accelerators, fillers, pigments, and/or any other components as required.

In some examples, the sheet-form polymeric material may be cured in contact with a solid open-cell foam panel of the core, such that a bond is formed without the need for an adhesive layer. For example, the bond may be produced by pressing sheet-form curable polymeric material and the solid, open-cell foam panel together and curing the sheet-form curable polymeric material with heat. In this way, at least a portion of material from the sheet-form curable polymeric material can flow into the cells and interstices of the open-cell foam to form a bond between the core and the sheet-form polymeric material as it cures.

In some examples, the cured polymeric material may penetrate the solid, open-cell foam to a depth which is at least equivalent to the average cell diameter of the foam, more preferably to a depth which is at least equivalent to two times the average cell diameter of the foam. Alternatively, the cured polymeric material may penetrate the solid, open-cell foam to a depth of at least 0.5 mm, more preferably at least 1.0 mm, and still more preferably at least 2.0 mm, for example 2.5 mm or 3.0 mm.

In this way, the sheet-form polymeric material forms a skin on the solid open-cell foam panel which is mechanically keyed into the surface of the solid open-cell foam panel. By "mechanically keyed" it is meant that at least a portion of the sheet-form polymeric material penetrates at least a portion of the solid open-cell foam panel and forms a mechanical interaction with the solid open-cell foam panel. Thus, at least a portion of the sheet-form polymeric material becomes effectively entrapped within the outer cells of the solid open-cell foam panel to form a strong mechanical bond. In this way, a stable monolithic layered composite structure is obtained without the need for an adhesive to be applied between the layers.

In some cases, it has been found that the bond achieved at the interface of the skin and a solid open-cell foam panel is stronger than the material of the foam panel itself. As a result, the layered composite panels used according to the invention are extremely strong, highly-resistant to delamination of the sheet-form material from the core, and highly-resistant to fragmentation of the core under the impact of an explosive energy wave. Specifically, it has been found that the sheet-form polymeric material acts as a flexible retaining layer which maintains the integrity of the solid, open-cell foam panel even as it is deformed/crushed by an explosive energy wave. It has been found that these constructions provide exceptional protection from explosive blasts and ballistic materials.

In other embodiments of the invention, an adhesive layer may be provided between the first surface layer of a sheet-form polymeric material and the solid, open-cell foam panel. In principle, any type of adhesive or other bonding agent suitable to form a strong bond between the two layers may be used.

The sheet-form polymeric material preferably comprises reinforcement, for example reinforcing fibres. The fibres may include one or more materials. For example the fibres may include one or more of carbon fibres, glass fibres, aramid fibres and/or polyethylene fibres, such as ultra-high molecular weight polyethylene (UHMWPE). In one preferred embodiment, the reinforcement comprises or consists of glass fibres, for example E-glass fibres or S-glass fibres.

The reinforcing fibres may be short fibres, for example having lengths of 5.0 cm or less, or may be longer fibres. The fibres may be loose, for example, the fibres may be arranged in a uni- or multi-directional manner. The fibres may be part of a network, for example woven or knitted together in any appropriate manner. The arrangement of the fibres may be random or regular, and may comprise a fabric, mat, felt or woven or other arrangement. Fibres may provide a continuous filament winding. Optionally, more than one layer of fibres may be provided.

Preferably the sheet-form polymeric material comprises SMC (sheet moulding compound). The SMC preferably includes a thermosetting polymer matrix as defined above and reinforcing fibres also as defined above. For example, the SMC may include a thermosetting resin, for example a polyester resin, together with reinforcing fibres, for example glass fibres. The thermosetting polymer may further comprise additives, for example minerals, inert fillers, pigments, stabilizers, inhibitors, release agents, catalysts, thickeners, hydrating additives and/or other suitable materials.

There are benefits in using SMC as the first surface layer. For example, SMC has low density but favourable mechanical properties compared with other sheet-form polymeric materials. In particular, it has been found that the very high compressive, tensile, flexural and impact strength of SMC make it particularly suitable for use in blast-resistant and/or anti-ballistic panels, for example in resisting delamination of the surface layer and maintaining the integrity of the layered composite panel against an energy wave from an explosive blast. SMC also exhibits good thermal properties and chemical resistance. Of particular importance in the context of the present invention, resistance to fire is good.

Thus, the panels of the present invention may also provide some degree of protection against the risk of fire associated with explosive blasts and certain types of ballistic materials.

The sheet form polymeric material preferably has a thickness in the range of from 0.5 to 25 mm, more preferably from 0.5 to 15 mm, still more preferably from 0.5 to 10 mm, and most preferably from 0.5 to 5 mm. For example, the sheet form polymeric material may have a thickness of 1 mm, 2 mm, 3 mm or 4 mm.

Preferably, the first surface layer of sheet-form polymeric material extends across an entire surface of the first solid open-cell foam panel.

In some aspects of the invention, the panel may comprise more than one foam panel. In particular, in some of the foregoing embodiments of the invention, the panel comprises a second foam panel bonded to the first solid open-cell foam panel by way of an adhesive or bonding agent.

Where present, the second solid foam panel may be the same as or different to the first solid open-cell foam panel. Thus, the second solid foam panel may comprise or consist of an open-cell foam or a closed-cell foam. Preferably, the second solid foam panel comprises an open-cell foam, and most preferably an open-cell polymeric foam, for example an open-cell polymeric foam as described above.

In particularly preferred embodiments, the panel may comprise a core comprising one or more polymeric foam layers wherein the core is sandwiched between two layers of a sheet-form polymeric material as disclosed above.

Energy Absorbing Composites

Where the modular building is to be used, for example, in areas of civil unrest or as army camps, it is preferable to use composite panels which provide protection against energy waves, such as explosive blast energy waves, and airborne projectiles.

In a first aspect, the present invention provides the use of a layered composite panel in a modular building as herein described as a blast-resistant and/or anti-ballistic shield, wherein the layered composite panel comprises: (i) a first surface layer of a sheet form polymeric material; and (ii) a core comprising or consisting of a first solid, open-cell foam panel, wherein the sheet form polymeric material comprises a cured polymeric material which penetrates a surface of the open-cell foam panel forming a bond between the first surface layer and the core.

In accordance with this aspect of the invention, the first solid, open-cell foam panel preferably comprises or consists of a polymeric foam. Examples of solid, open-cell polymeric foams which may be used in accordance with this aspect of the present invention include phenolic resin foams, polystyrene foams, polyurethane foams, polyethylene foams, polyvinylchloride foams, polyvinylacetate foams, polyester foams polyether foams, and foam rubber. Preferably, the polymeric foam is selected from phenolic resin foams.

It has been found that the mechanical properties of phenolic resin foams make them particularly suitable for use in blast-resistant and/or anti-ballistic shields. Further, the use of sheet-form polymeric material in conjunction with the phenolic resin foams provides panels of extremely high strength, and high resistance to delamination and fragmentation under the impact of an explosive energy wave. Thus, the layered composite panels provide exceptional protection from explosive blasts and ballistic materials.

In another aspect, the present invention provides the use of a layered composite panel in a modular building as herein described as a blast-resistant and/or anti-ballistic shield, wherein the layered composite panel comprises: (i) a first surface layer of a sheet form polymeric material; and (ii) a core comprising or consisting of a first solid, open-cell phenolic resin foam panel, wherein the sheet form polymeric material is bonded to a surface of the core.

In accordance with this aspect of the invention, the first surface layer of a sheet-form polymeric material preferably comprises a cured polymeric material. More preferably, the cured polymeric material penetrates a surface of the first solid open-cell foam panel so as to form the bond between the first surface layer and the core.

In another aspect, the present invention provides the use of a layered composite panel in a modular building as herein described as a blast-resistant and/or anti-ballistic shield, wherein the layered composite panel comprises: (i) a core comprising or consisting of a first solid, open-cell foam panel and a second solid foam panel wherein the foam panels are bonded together by an adhesive or other bonding agent so as to form a monolithic layered structure; and optionally (ii) a first surface layer of a sheet form polymeric material, wherein the sheet form polymeric material is bonded to a surface of the core.

In accordance with this aspect of the invention, the first solid, open-cell foam panel preferably comprises or consists of a polymeric foam as described above.

In accordance with this aspect of the invention, the first surface layer of a sheet-form polymeric material, where present, preferably comprises a cured polymeric material. More preferably, the cured polymeric material penetrates a surface of the first solid open-cell foam panel so as to form the bond between the first surface layer and the core.

In a further aspect, the present invention provides a layered composite panel for use in a modular building as herein described comprising: (i) a core comprising or consisting of a first solid, open-cell foam panel and a second solid foam panel wherein the foam panels are bonded together by an adhesive or other bonding agent so as to form a monolithic layered structure; and optionally (ii) a first surface layer of a sheet form polymeric material, wherein the sheet form polymeric material is bonded to a surface of the core, with the proviso that the adhesive or other bonding agent does not form an air-tight sealing coating around a foam panel of the core.

The layered composite panel of this aspect of the invention may advantageously be used as a blast-resistant shield.

In accordance with this aspect of the invention, the first solid, open-cell foam panel preferably comprises or consists of a polymeric foam as described above.

In accordance with this aspect of the invention, the first surface layer of a sheet-form polymeric material, where present, preferably comprises a cured polymeric material. More preferably, the cured polymeric material penetrates a surface of the first solid open-cell foam panel so as to form the bond between the first surface layer and the core.

In accordance with the foregoing aspects of the invention, the first solid, open-cell foam panel is preferably non-elastically deformable when pressure is applied beyond a certain limit. In some examples, the first solid, open-cell foam panel may deform plastically, retaining cohesion as a single object. In other examples, the first solid, open-cell foam panel may be frangible, i.e. it may break into fragments when pressure is applied.

As used herein, the term non-elastically deformable refers to an open-cell foam which undergoes irreversible change to the foam structure when pressure is applied beyond a certain limit, i.e. by crushing, collapsing or fragmenting. Thus, the foam is intended to absorb energy from an energy wave by non-elastic deformation.

In preferred examples, the first solid, open-cell foam panel is progressively deformable, such that the cells of the foam closest to an applied force collapse, fragment or are crushed first, with the cells further away from the applied force initially remaining intact.

The first solid, open-cell foam panel may include a finely-divided particulate reinforcing material. Suitable particulate reinforcing materials are preferably inert and insoluble. The reinforcing material may be present in an amount of up to 10 weight percent based on the total weight of the foam, for example from 2 to 10 weight percent, or 5 to 10 weight percent based on the total weight of the foam. Suitable reinforcing materials include organic or inorganic (including metallic) particulate materials, which may be crystalline or amorphous. Even fibrous solids have been found to be effective, although not preferred. Non-limiting examples of suitable particulate materials include clays, clay minerals, talc, vermiculite, metal oxides, refractories, solid or hollow glass microspheres, fly ash, coal dust, wood flour, grain flour, nut shell flour, silica, mineral fibres such as finely chopped glass fibre and finely divided asbestos, chopped fibres, finely chopped natural or synthetic fibres, ground plastics and resins whether in the form of powder or fibres, e.g. reclaimed waste plastics and resins, pigments such as powdered paint and carbon black, and starches.

In some examples, the first solid, open-cell foam panel may further include chips of stone, ceramic, glass or other aggregate materials embedded in the open-cell foam matrix. Preferably, the chips have a size of from 2 to 50 mm in each dimension, more preferably from 2 to 20 mm in each dimension. These materials have been found to improve the anti-ballistic properties of the composite panels of the invention, for example by preventing bullets from penetrating the panels.

Preferably the first solid open-cell foam panel has a density in the range of 100 to 500 $kg \cdot m^{-3}$, more preferably 120 to 400 $kg \cdot m^{-3}$, and most preferably 120 to 250 $kg \cdot m^{-3}$, exclusive of any aggregate chips that may be embedded in the foam.

The physical properties of such foams, especially the compressive strength and deflection under load are believed to be related to (amongst other factors) cell wall thickness and average cell diameter. Preferably, the average cell diameter of the solid open-cell foam is in the range of about 0.5 mm to 5 mm, more preferably 0.5 or 1 mm to 2 or 3 mm.

The cells or pores of the first solid open-cell foam panel are preferably open to a surface of the core on which sheet form polymeric material is applied, and preferably they open out below the surface to a greater width than the opening, thereby providing an undercut which enhance bonding of the sheet form polymeric material to the open cell foam.

In some aspects of the present invention, the first surface layer of a sheet-form polymeric material is formed from a sheet-form curable polymeric material, for example a thermosetting polymeric material.

The sheet-form polymeric material preferably comprises a matrix comprising or consisting of a thermosetting polymer resin, for example, a thermosetting polymer resin matrix selected from polyester resins, vinyl ester resins, epoxy resins, phenolic resins, bismaleimide resins or polyimide resins. Most preferably, the sheet-form polymeric material comprises a thermosetting polymer resin matrix selected from polyester resins. The sheet-form polymeric material may also include melamine, which is useful as a fire retardant. The sheet-form polymeric material may further include additives selected from hardeners, accelerators, fillers, pigments, and/or any other components as required.

In some examples, the sheet-form polymeric material may be cured in contact with a solid open-cell foam panel of the core, such that a bond is formed without the need for an adhesive layer. For example, the bond may be produced by pressing sheet-form curable polymeric material and the solid, open-cell foam panel together and curing the sheet-form curable polymeric material with heat. In this way, at least a portion of material from the sheet-form curable polymeric material can flow into the cells and interstices of the open-cell foam to form a bond between the core and the sheet-form polymeric material as it cures.

In some examples, the cured polymeric material may penetrate the solid, open-cell foam to a depth which is at least equivalent to the average cell diameter of the foam, more preferably to a depth which is at least equivalent to two times the average cell diameter of the foam. Alternatively, the cured polymeric material may penetrate the solid, open-cell foam to a depth of at least 0.5 mm, more preferably at least 1.0 mm, and still more preferably at least 2.0 mm, for example 2.5 mm or 3.0 mm.

In this way, the sheet-form polymeric material forms a skin on the solid open-cell foam panel which is mechanically keyed into the surface of the solid open-cell foam panel. By "mechanically keyed" it is meant that at least a portion of the sheet-form polymeric material penetrates at least a portion of the solid open-cell foam panel and forms a mechanical interaction with the solid open-cell foam panel. Thus, at least a portion of the sheet-form polymeric material becomes effectively entrapped within the outer cells of the solid open-cell foam panel to form a strong mechanical bond. In this way, a stable monolithic layered composite structure is obtained without the need for an adhesive to be applied between the layers.

In some cases, it has been found that the bond achieved at the interface of the skin and a solid open-cell foam panel is stronger than the material of the foam panel itself. As a result, the layered composite panels used according to the invention are extremely strong, highly-resistant to delamination of the sheet-form material from the core, and highly-resistant to fragmentation of the core under the impact of an explosive energy wave. Specifically, it has been found that the sheet-form polymeric material acts as a flexible retaining layer which maintains the integrity of the solid, open-cell foam panel even as it is deformed/crushed by an explosive energy wave. It has been found that these constructions provide exceptional protection from explosive blasts and ballistic materials.

In other embodiments of the invention, an adhesive layer may be provided between the first surface layer of a sheet-form polymeric material and the solid, open-cell foam panel. In principle, any type of adhesive or other bonding agent suitable to form a strong bond between the two layers may be used.

The sheet-form polymeric material preferably comprises reinforcement, for example reinforcing fibres. The fibres may include one or more materials. For example the fibres may include one or more of carbon fibres, glass fibres, aramid fibres and/or polyethylene fibres, such as ultra-high molecular weight polyethylene (UHMWPE). In one preferred embodiment, the reinforcement comprises or consists of glass fibres, for example E-glass fibres or S-glass fibres.

The reinforcing fibres may be short fibres, for example having lengths of 5.0 cm or less, or may be longer fibres. The fibres may be loose, for example, the fibres may be arranged in a uni- or multi-directional manner. The fibres may be part of a network, for example woven or knitted together in any appropriate manner. The arrangement of the fibres may be random or regular, and may comprise a fabric, mat, felt or woven or other arrangement. Fibres may provide a continuous filament winding. Optionally, more than one layer of fibres may be provided.

Preferably the sheet-form polymeric material comprises SMC (sheet moulding compound). The SMC preferably includes a thermosetting polymer matrix as defined above and reinforcing fibres also as defined above. For example, the SMC may include a thermosetting resin, for example a polyester resin, together with reinforcing fibres, for example glass fibres. The thermosetting polymer may further comprise additives, for example minerals, inert fillers, pigments, stabilizers, inhibitors, release agents, catalysts, thickeners, hydrating additives and/or other suitable materials.

There are benefits in using SMC as the first surface layer. For example, SMC has low density but favourable mechanical properties compared with other sheet-form polymeric materials. In particular, it has been found that the very high compressive, tensile, flexural and impact strength of SMC make it particularly suitable for use in blast-resistant and/or anti-ballistic panels, for example in resisting delamination of the surface layer and maintaining the integrity of the layered composite panel against an energy wave from an explosive blast. SMC also exhibits good thermal properties and chemical resistance. Of particular importance in the context of the present invention, resistance to fire is good. Thus, the panels of the present invention may also provide some degree of protection against the risk of fire associated with explosive blasts and certain types of ballistic materials.

The sheet form polymeric material preferably has a thickness in the range of from 0.5 to 25 mm, more preferably from 0.5 to 15 mm, still more preferably from 0.5 to 10 mm, and most preferably from 0.5 to 5 mm. For example, the sheet form polymeric material may have a thickness of 1 mm, 2 mm, 3 mm or 4 mm.

Preferably, the first surface layer of sheet-form polymeric material extends across an entire surface of the first solid open-cell foam panel.

In accordance with aspects of the invention, the first surface layer of sheet form polymeric material is desirably orientated in use towards the origin of a potential explosive blast or ballistic material.

In some aspects of the invention, the core may consist of the first solid, open-cell foam panel. In other aspects of the invention, the core may comprise more than one foam panel. In particular, in some of the foregoing embodiments of the invention, the core comprises a second foam panel bonded to the first solid open-cell foam panel by way of an adhesive or bonding agent.

Where present, the second solid foam panel may be the same as or different to the first solid open-cell foam panel. Thus, the second solid foam panel may comprise or consist of an open-cell foam or a closed-cell foam. Preferably, the second solid foam panel comprises an open-cell foam, and most preferably an open-cell polymeric foam, for example an open-cell polymeric foam as described above.

The adhesive or bonding agent used to bond the first and second foam layers preferably comprises or consists of one or more elastomers. Preferably, the adhesive or bonding agent comprises or consists of at least one elastomer selected from: natural rubber, synthetic polyisoprene, butyl rubber, halogenated butyl rubber, polybutadiene, styrene-butadiene rubber, nitrile rubber, hydrogenated nitrile rubber, chloroprene rubber, silicone rubber, and halogenated silicone rubber.

Where the adhesive or bonding agent comprises one or more elastomers, the elastomer preferably penetrates at least a portion of the first solid open-cell foam panel. For example, the elastomer may penetrate the first solid, open-cell foam panel to a depth which is at least equivalent to the average cell diameter of the foam, more preferably to a depth which is at least equivalent to two times the average cell diameter of the foam. Alternatively, the elastomer may penetrate the first solid, open-cell foam panel to a depth of at least 0.5 mm, more preferably at least 1.0 mm, and still more preferably at least 2.0 mm, for example 2.5 mm or 3.0 mm.

More preferably, where the second solid foam panel comprises an open-cell foam, the elastomer preferably penetrates at least a portion of each of the solid open-cell foam panels. For example, the elastomer may penetrate the first and/or the second solid, open-cell foam panel to a depth which is at least equivalent to the average cell diameter of the foam, more preferably to a depth which is at least equivalent to two times the average cell diameter of the foam. Alternatively, the elastomer may penetrate the first and/or the second solid, open-cell foam panel to a depth of at least 0.5 mm, more preferably at least 1.0 mm, and still more preferably at least 2.0 mm, for example 2.5 mm or 3.0 mm.

If required, the properties of each of the solid foam panels may be selected so as to optimise the blast-resistance and anti-ballistic properties of the layered composite panels. For example, the first solid, open-cell foam panel may have a resistance to deformation (e.g. crushing, collapse, or fragmentation) that is lower than the second solid foam panel. In this way, the layered composite panel may have a progressive resistance to deformation that increase from one solid foam panel to the next. The difference in resistance to deformation between the solid foam panels may be due to a difference in density. Other arrangements are of course possible, as will be appreciated by persons of skill in the art.

It has been found that these constructions provide blast-resistant and anti-ballistic panels which are extremely strong, highly resistant to delamination and fragmentation of the core layers under the impact of an explosive energy wave, and which provide exceptional protection from explosive blasts and ballistic materials.

In further aspects of the invention, the core may comprise one or more further core layers. In this way, the core may be formed from a plurality of layers or plies, wherein the plurality of layers or plies are preferably bonded together so as to form a monolithic core structure.

Preferably the plurality of layers or plies are coextensive with one another. However, it is not excluded that in certain embodiments of the invention, the various layers or plies of the core may differ in extent. For example, one or more further core layers may be used only in areas of particular vulnerability to explosive impact, or to provide structural reinforcement in areas of the panel subjected to increased mechanical stress (e.g. at or around joints).

In some embodiments, the core comprises one or more further solid foam panels, which may be the same or different to the first solid, open-cell foam panel and/or the second solid foam panel (where present). Thus, the one or more additional solid foam panels may comprise or consist of an open-cell or closed-cell foam. Preferably, the one or more additional solid foam panels comprise an open-cell foam, and most preferably an open-cell polymeric foam, for example an open-cell polymeric foam as described above.

In accordance with this aspect of the invention, the properties of each of the solid foam panels may be selected so as to optimise the blast-resistance and anti-ballistic properties of the layered composite panels. For example, the first solid, open-cell foam panel may have a resistance to deformation (e.g. crushing, collapse, or fragmentation) that is lower than a second solid foam panel. In this way, the layered composite panel may have a progressive resistance to deformation that increase from one solid foam panel to the next. Other arrangements are of course possible, as will be appreciated by persons of skill in the art.

In an embodiment, the composite panel comprises three solid foam panels. Preferably, the two outer panels sandwich an inner panel. Preferably, the inner panel has a lower resistance to deformation than the outer panels, for example by having a lower density. Preferably, the inner solid foam panel may have a density of 100 to 140 $kg \cdot m^{-3}$, and the outer solid foam panels may have a density of 130 to 170 $kg \cdot m^{-3}$. More preferably, the inner solid foam panel has a density of 115 to 125 $kg \cdot m^{-3}$, and the outer solid foam panels may have a density of 145 to 155 $kg \cdot m^{-3}$. It is believed that, under large or repeated impact, the inner panel absorbs at least a portion of the impact energy and thus deforms, for example by being frangible, whilst the outer panels remain substantially intact.

In another embodiment, the composite material may comprise more than three solid foam panels in a sandwich like structure. Preferably, one or more of the inner solid foam panels has a lower resistance to deformation than its respective outer panels. Preferably, one or more of the inner solid foam panels may have a density of 100 to 140 $kg \cdot m^{-3}$, and the outer solid foam panels may have a density of 130 to 170 $kg \cdot m^{-3}$. More preferably, one or more of the inner solid foam panels has a density of 115 to 125 $kg \cdot m^{-3}$, and the outer solid foam panels may have a density of 145 to 155 $kg \cdot m^{-3}$. In all of the embodiments where the composite material comprises a plurality of layers or plies, the outer panels may be the same or different from one another.

The one or more further solid foam panels may be bonded directly to one another so as to form a monolithic core structure, or may be bonded together through one or more intermediate layers.

Where the core comprises one or more further solid foam panels, such as one or more additional solid, open-cell foam panels, any two of the panels may be bonded together by way of an adhesive or other bonding agent. The adhesive or bonding agent preferably comprises or consists of one or more elastomers as described above. The elastomer may penetrate one or more of the foam panels as described above.

Thus, in one particularly preferred embodiment, the core comprises the first solid open-cell foam panel and a second solid-open-cell foam panel, which may be the same as or different from the first, wherein the panels are joined together by an adhesive or bonding agent which comprises one or more elastomers, and wherein the elastomer penetrates the solid open-cell foam panels as described above.

In another particularly preferred embodiment, the core comprises the first, second and third solid open-cell foam panels, which may each be the same or different, wherein the panels are joined together by an adhesive or bonding agent which comprises one or more elastomers, and wherein the elastomer penetrates the solid open-cell foam panels as described above.

In some embodiments, the core may further comprise one or more reinforcing layers.

One type of reinforcing layer suitable for the layered composite panels described above comprises reinforcing fibres. The fibres may include one or more materials. For example, the fibres may include one or more of carbon fibres, glass fibres, aramid fibres and/or polyethylene fibres, such as ultra-high molecular weight polyethylene (UHMWPE) fibres. In one preferred embodiment, the reinforcement comprises or consists of glass fibres, for example E-glass fibres and/or S-glass fibres.

Preferably, the reinforcing fibres used in the one or more reinforcing layers are in the form of a woven or orientated fabric, felt, mat or web, which may be formed in any suitable manner as known in the art.

The reinforcing layer comprising reinforcing fibres in the form of a woven or orientated fabric, felt, mat or web is preferably penetrable by a curable material or by an adhesive. In this way, the reinforcing layer may be used as an intermediate layer between the first surface layer of a sheet form cured polymeric material and the first solid, open-cell foam panel, such that cured polymeric material preferably penetrates the reinforcing layer and a surface of the open-cell foam panel, thus forming a bond between the first surface layer and the core, with the reinforcing layer embedded in cured polymeric material.

In another example, the reinforcing layer may be used as an intermediate layer between two adjacent foam panels in the core, wherein the reinforcing layers is embedded in the adhesive or bonding agent (e.g. containing an elastomer) that is used to bond the foam panels together as described above.

The core may further comprise one or more layers of sheet form polymeric material as described above. In a preferred embodiment, the sheet form polymeric material may comprise a cured polymeric material which penetrates the surface of at least one adjacent solid open-cell foam panel. More preferably, the sheet form polymeric material may comprise a cured polymeric material which penetrates the surface of two adjacent solid open-cell foam panels, so as to bond the panels together.

The core may further comprise one or more other types of blast-resistant and/or anti-ballistic materials. A range of suitable materials are known in the art which can readily be incorporated into the layered composite materials described above. For example, suitable additional layers could be selected from glass reinforced plastic (GRP) panels, ceramic panels, ceramic-reinforced plastic panels, steel panels, or similar.

The core may further comprise one or more fire-retardant layers. Examples of materials which may be incorporated into the one or more fire-retardant layers include rock wool, gypsum, perlite, vermiculite, alumina, aluminium hydroxide, magnesium hydroxide, and calcium silicate.

In accordance with aspects of the present invention, the core preferably has a thickness in the range of from 20 to 500 mm, more preferably 20 to 250 mm, still more preferably from 20 to 200 mm, still more preferably from 20 to 150 mm, still more preferably from 20 to 100 mm, and most preferably from 50 to 100 mm. For example, the core may have a thickness of at least 25 mm, at least 40 mm, or at least 50 mm.

In preferred aspects of the invention, the layered composite panel further comprises (iii) a second surface layer of a sheet form polymeric material, wherein the core is disposed between the first and second surface layers of sheet-form polymeric material, such that the resulting layered composite panel has a sandwich construction—the core being sandwiched between first and second surface layers of sheet-form polymeric material.

The first and second surface layers of sheet-form polymeric material may be the same or different. Preferably, the second surface layer of sheet-form polymeric material comprises a thermosetting polymer matrix as defined above, and/or preferably comprises reinforcement as described above. In a preferred embodiment the first and second surface layers of sheet-form polymeric material consist of SMC as defined above. Where the second layer of sheet form polymeric material comprises a cured polymeric material, a portion of the curable material preferably penetrates the surface of an open-cell foam panel forming a bond between the second surface layer and the core.

Where the core consists of a first solid, open-cell foam panel, the second surface layer of sheet-form polymeric material is bonded to a surface of the solid, open-cell foam panel opposite the first surface layer of sheet-form polymeric material.

Where the core comprises two or more layers and/or panels, the second surface layer of sheet-form polymeric material is bonded to a surface of the core opposite the first surface layer of sheet-form polymeric material. Preferably, the core comprises a solid foam layer adjacent to the second surface layer of sheet-form polymeric material. More preferably, the core comprises a solid, open-cell foam layer adjacent to the second surface layer of sheet-form polymeric material.

Alternatively, the second surface layer of sheet-form polymeric material may be bonded to the core by way of an adhesive or other bonding agent.

A reinforcing layer comprising reinforcing fibres, for example in the form of a woven or orientated fabric, felt, mat or web, may optionally be disposed between the second surface layer of sheet-form material and the core.

In accordance with aspects of the present invention, the layered composite panel preferably has a thickness in the range of from 21 to 550 mm, more preferably 21 to 275 mm, still more preferably from 21 to 220 mm, still more preferably from 21 to 165 mm, still more preferably from 21 to 110 mm, and most preferably from 51 to 110 mm. For example, the layered composite panel may have a thickness of at least 26 mm, at least 41 mm, or at least 51 mm.

In accordance with aspects of the present invention, the layered composite panel is preferably capable of withstanding an energy wave having an impulse of at least 20 $psi \cdot ms^{-1}$. In some embodiments of the invention, the layered composite panel is capable of withstanding an energy wave having an impulse of at least 50 $psi \cdot ms^{-1}$, more preferably at least 100 $psi \cdot ms^{-1}$, more preferably at least 150 $psi \cdot ms^{-1}$, still more preferably at least 200 $psi \cdot ms^{-1}$, and most preferably 250 $psi \cdot ms^{-1}$. By "withstanding", it is meant that the layered composite material remains intact, without fragmentation and/or delamination of the surface layer of sheet-form polymeric material, and that the impulse transmitted through the layered composite material is reduced to no more than 20% of the impulse of the energy wave before the panel, preferably no more than 10%, still more preferably no more than 5%, and most preferably no more than 2% of the impulse of the energy wave before the panel.

It will be appreciated that other arrangements of layers are possible within the scope of the present invention. For instance, the layered composite material may include one or more further layers of sheet-form polymeric material, one or more further reinforcing layers, one or more further foam layers, and/or one or more further fire-retardant layers.

The component layers or panels of the layered composite panel may be assembled in a variety of ways. Thus, the layers may be bonded together simultaneously or consecutively. Where the layers are bonded together consecutively, the order in which the layers are bonded together is not limited.

In a preferred example, the layered composite panel may be formed by a method that comprises the steps of layering a sheet-form curable material (e.g. SMC) and at least the first solid, open-cell foam panel in a press and applying heat and/or pressure to the layers to cure the sheet-form material, thus forming a bond to the solid open-cell foam. Preferably, at least a portion of the material of the sheet-form curable material flows into the cells or interstices of the first solid, open-cell foam panel during the curing step.

The resulting composite may optionally be bonded to one or more additional core layers and/or a second surface layer of sheet-form polymeric material in one or more subsequent manufacturing steps. Alternatively, or in addition, the solid open-cell foam panel may be bonded to one or more additional core component layers or panels prior to the curing step.

In a further example, the method may comprise the steps of layering a sheet-form curable polymeric material, a core (e.g. consisting of the first solid open-cell foam panel, or a plurality of core panels/layers), and a second layer of sheet-form curable polymeric material in a press and applying heat and/or pressure to the layers. In this way, the first and second surface layers of sheet-form polymeric material may be bonded to the core in a single step.

In a preferred embodiment, one or both faces of the layered composite panel may have a profiled surface. For example, one or both faces of the layered composite panel may have a profiled surface formed by a moulding technique. Where a profiled surface is used, it is preferably formed on a surface which is visible when the layered composite panel is in use. For example, the profile may be formed on the first surface layer. In this way, the aesthetic effect of the layered composite panels of the invention may be improved, and the function of the panels may be disguised for aesthetic and security reasons.

In a preferred embodiment, the profiled surface may be formed by a method as described above, wherein the press is provided with a mould surface having a negative impression of the desired profile.

In particular, the method preferably comprises the steps of: (i) providing a mould surface having a negative impression of the desired profile; (ii) layering a sheet-form curable polymeric material (e.g. SMC) over the surface of the mould; (iii) providing a core (e.g. consisting of the first solid open-cell foam panel, or a plurality of core panels/layers) over the sheet-form curable polymeric material; and (iv) optionally providing a second surface layer of a sheet-form polymeric material (e.g. SMC) over the core; and (v) pressing the layers into the mould, optionally with heating.

Upon pressing the layers into the mould, air is expelled from the first solid, open-cell foam panel, and some cells of the foam are preferably crushed, so as to allow the foam to assume the shape of the mould and thereby press the sheet-form polymeric material into the mould.

The first solid open-cell foam panel may optionally be bonded to one or more additional core layers/panels prior to the moulding step. Alternatively, bonding between the first solid, open-cell foam panel and one or more additional core layers/panels and/or a second surface layers of a sheet form polymeric material may take place during one or more subsequent steps. In a further possibility, one or more additional core layers and/or a second surface layer of a sheet-form polymeric material may also be bonded together in the pressing step (e.g. where the second surface layer of a sheet-form polymeric material comprises a curable material).

Optionally, a second mould surface may be provided over the second layer of sheet-form polymeric material, such that a layered composite panel is provided having a profiled surface on both faces.

Where the layered composite panel has a profiled surface formed by moulding, the first and/or second layers of sheet-from polymeric material are preferably formed from a sheet-form curable polymeric material, such as SMC. Preferably, the sheet-form polymeric material layer is adjacent to a solid open-cell foam panel, such as a solid open-cell phenolic resin foam panel.

In some examples, an outer surface of the sheet-form polymeric material may optionally be bonded to a surface effect material. The surface effect material may be selected so as to provide the layered composite panel with, for example, a simulated stone surface, a simulated brick surface, a simulated wood surface, a wood laminate surface, a material of high thermal conductivity (a "cool touch" surface), or a reflective surface. For example, a granular material, such as sand or metal granules, a veneer element, such as a wood veneer element, a brick veneer element, a stone veneer element, or a metallic foil/metallic particles can be bonded to, or partially embedded into the surface of the sheet form polymeric material. Different surface effects can be obtained by selection of the types of surface effect materials that are used.

To improve the rigidity of the layered composite panels used according to the invention, the layered composite panels may be mounted in a frame or by frame members such as stiles, rails, and/or mullions. The frame members may be of wood, metal (for example, aluminium), or plastics (such as UPVC), or a combination of these.

In one embodiment, the layered composite panels of the invention may occupy substantially the entire volume or volume within the frame, such that frame members abut the edges of the layered composite panels. In another embodiment, substantially the entire volume or volumes within the frame are occupied by the core, and the first and/or second surface layers of a sheet form polymeric material overlie substantially the entire surface of the frame and the layers contained therein. It will be appreciated that the use of frame members, particularly metal frame members, may compromise the blast resistance of the layered composite panels of the invention. Thus, the use of frame members is ideally kept to the minimum necessary to obtain the necessary structural rigidity of the layered composite panels of the invention.

The layered composite panels of the invention may be formed in a large surface area, or continuous configuration, and subsequently cut to the required size. Alternatively, the layered composite panels may be custom fabricated with the required dimensions for a particular application.

In one embodiment, the composite materials of the invention may be provided in the form of modular panels, wherein each panel is provided with interconnecting means to allow a series of panels to be interconnected. In a preferred embodiment, the interconnecting means is a tongue and groove arrangement.

Where the core comprises more than three layers or panels, the tongue and groove arrangement may be obtained by offsetting one or more central layers or panels relative to two or more outer layers. The offset may be linear or diagonal. Where the offset is linear, the layered composite panels may be connected in a two-dimensional array. Where the offset is diagonal, the layered composite panels may be connected in a three-dimensional array.

Alternatively, or where the core comprises fewer than three layers, the tongue and groove arrangement may be obtained by contouring the edges of the individual layers of the core. Where the tongue and groove arrangement is provided on two opposite edges of the layered composite panels, the panels may be connected in a two-dimensional array. Where the tongue and groove arrangement is provided on all edges of the layered composite panels, the panels may be connected in a three-dimensional array.

Where a tongue and groove arrangement is used, the tongue and/or groove portions may comprise means for maintaining the integrity of the tongue and groove joint. For example, the tongue and/or groove portions may be provided with a gripping surface, such as a rubberised coating. Alternatively, the tongue and/or groove portions may be provided with an adhesive prior to joining the panels.

In some aspects of the present invention, the layered composite panel may be used in conjunction with a reinforced webbing material, such as a poly-aramid webbing or a UHMWPE webbing material. Such webbing materials are well-known in the art and are used, for example, to prevent fragmentation and/or the release of high velocity fragments from the rear surface of walls when exposed to the energy wave from an explosive blast.

Such webbing materials may provide further attenuation of the effects of an explosive blast. Preferably the webbing materials are bonded to or positioned across a rear surface of the layered composite panel, i.e. a surface opposite the surface that faces the potential origin of an explosive blast or ballistic material.

In accordance with the present invention, the composite material panels may be used in the modular buildings described herein to form a blast-resistant and/or anti-ballistic envelope around persons or infrastructure that are at risk of damage or injury from an explosive blast or high-velocity fragments.

In one preferred embodiment, the composite material panels may be mounted using expansion clips of a type known in the art. These clips can expand in response to an explosive energy wave contacting the composite material panels, so as to further assist in absorbing the energy of the explosion.

As noted above, in aspects of the present invention, a particularly suitable solid open-cell foam is a solid open-cell phenolic resin foam. For example, a suitable foam may be produced by way of a curing reaction between:

(a) a liquid phenolic resole having a reactivity number (as defined below) of at least 1; and (b) a strong acid hardener for the resole; optionally in the presence of:

(c) a finely divided inert and insoluble particulate solid which is present, where used, in an amount of at least 5% by weight of the liquid resole and is substantially uniformly dispersed through the mixture containing resole and hardener;

the temperature of the mixture containing resole and hardener due to applied heat not exceeding 85° C. and the said temperature and the concentration of the acid hardener being such that compounds generated as by-products of the curing reaction are volatilised within the mixture before the mixture sets such that a foamed phenolic resin product is produced.

By a phenolic resole is meant a solution in a suitable solvent of an acid-curable prepolymer composition prepared by condensation of at least one phenolic compound with at least one aldehyde, usually in the presence of an alkaline catalyst such as sodium hydroxide.

Examples of phenols that may be employed are phenol itself and substituted, usually alkyl substituted, derivatives thereof, with the condition that that the three positions on the phenolic benzene ring ortho- and para- to the phenolic hydroxyl group are unsubstituted. Mixtures of such phenols may also be used. Mixtures of one or more than one of such phenols with substituted phenols in which one of the ortho- or para-positions has been substituted may also be employed where an improvement in the flow characteristics of the resole is required. However, in this case the degree of cross-linking of the cured phenolic resin foam will be reduced. Phenol itself is generally preferred as the phenol component for economic reasons.

The aldehyde will generally be formaldehyde although the use of higher molecular weight aldehydes is not excluded.

The phenol/aldehyde condensation product component of the resole is suitably formed by reaction of the phenol with at least 1 mole of formaldehyde per mole of the phenol, the formaldehyde being generally provided as a solution in water, e.g. as formalin. It is preferred to use a molar ratio of formaldehyde to phenol of at least 1.25 to 1 but ratios above 2.5 to 1 are preferably avoided. The most preferred range is 1.4 to 2.0 to 1.

The mixture may also contain a compound having two active hydrogen atoms (dihydric compound) that will react with the phenol/aldehyde reaction product of the resole during the curing step to reduce the density of cross-linking. Preferred dihydric compounds are diols, especially alkylene diols or diols in which the chain of atoms between the hydroxy groups contains not only methylene and/or alkyl-substituted methylene groups but also one or more heteroatoms, especially oxygen atoms. Suitable diols include ethylene glycol, propylene glycol, propane-1,3-diol, butane-1,4-diol and neopentyl glycol. Particularly preferred diols are poly-, especially di-,(alkylene ether) diols, for example diethylene glycol and, especially, dipropylene glycol.

Preferably the dihydric compound is present in an amount of from 0 to 35% by weight, more preferably 0 to 25% by weight, based on the weight of phenol/aldehyde condensation product. Most preferably, the dihydric compound, when used, is present in an amount of from 5 to 15% by weight based on the weight of phenol/aldehyde condensation product. When such resoles containing dihydric compounds are employed in the present process, products having a particularly good combination of physical properties, especially strength, can be obtained.

Suitably, the dihydric compound is added to the formed resole and preferably has 2 to 6 atoms between hydroxy groups.

The resole may comprise a solution of the phenol/aldehyde reaction product in water or in any other suitable solvent or in a solvent mixture, which may or may not include water.

Where water is used as the sole solvent, it is preferably present in an amount of from 15 20 to 35% by weight of the resole, preferably 20 to 30%. Of course the water content may be substantially less if it is used in conjunction with a cosolvent, e.g. an alcohol or one of the above-mentioned dihydric compounds where used.

As indicated above, the liquid resole (i.e. the solution of phenol/aldehyde product 25 optionally containing dihydric compound) must have a reactivity number of at least 1. The reactivity number is 10/x where x is the time in minutes required to harden the resole using 10% by weight of the resole of a 66 to 67% aqueous solution of p-toluene sulfonic acid at 60° C. The test involves mixing about 5 mL of the resole with the stated amount of the p-toluene sulfonic acid solution in a test tube, immersing the test tube in a water bath heated to 60° C. and measuring the time required for the mixture to become hard to the touch. The resole should have a reactivity number of at least 1 for useful foamed products to be produced and preferably the resole has a reactivity number of at least 5, most preferably at least 10.

The pH of the resole, which is generally alkaline, is preferably adjusted to about 7, if necessary, for use in the process, suitably by the addition of a weak organic acid such as lactic acid.

Examples of strong acid hardeners are inorganic acids such as hydrochloric acid, sulphuric acid and phosphoric acid, and strong organic acids such as aromatic sulphonic acids, e.g. toluene sulphonic acids, and trichloroacetic acid. Weak acids such as acetic acid and propionic acid are generally not suitable. The preferred hardeners for the process of the invention are the aromatic sulfonic acids, especially toluene sulfonic acids. The acid may be used as a solution in a suitable solvent such as water.

When the mixture of resole, hardener and solid is to be poured, e.g. into a mould and in slush moulding applications, the amount of inert solid that can be added to the resole and hardener is determined by the viscosity of the mixture of resole and hardener in the absence of the solid. For these applications, it is preferred that the hardener is provided in a form, e.g. solution, such that when mixed with the resole in the required amount yields a liquid having an apparent viscosity not exceeding about 50 poises at the temperature at which the mixture is to be used, and the preferred range is 5 to 20 poises. Below 5 poises, the amount of solvent present tends to present difficulties during the curing reaction.

The curing reaction is exothermic and will therefore of itself cause the temperature of the mixture containing resole and acid hardener to increase. The temperature of the mixture may also be raised by applied heat, but the temperature to which said mixture may then be raised (that is, excluding the effect of any exotherm) preferably does not exceed 85° C. If the temperature of the mixture exceeds 85° C. before addition of the hardener, it is usually difficult or impossible thereafter to properly disperse the hardener through the mixture because of incipient curing. On the other hand, it is difficult, if not impossible, to uniformly heat the mixture above 85° C. after addition of the hardener.

Increasing the temperature towards 85° C. tends to lead to coarseness and non-uniformity of the texture of the foam but this can be offset at least to some extent at moderate temperatures by reducing the concentration of hardener. However at temperatures much above 75° C. even the minimum amount of hardener required to cause the composition to set is generally too much to avoid these disadvantages. Thus, temperatures above 75° C. are preferably avoided and preferred temperatures for most applications are from ambient temperature to about 75° C. The preferred temperature range usually depends to some extent on the nature of the particulate solid, where used. For most solids the preferred temperature range is from 25 to 65° C., but for some solids, in particular wood flour and grain flour, the preferred temperature range is 25 to 75° C. The most preferred temperature range is 30 to 50° C. Temperatures below ambient, e.g. down to 10° C. can be used if desired, but no advantage is usually gained thereby. In general, at temperatures up to 75° C., increase in temperature leads to decrease in the density of the foam and vice versa.

The amount of hardener present also affects the nature of the product as well as the rate of hardening. Thus, increasing the amount of hardener not only has the effect of reducing the time required to harden the composition, but above a certain level dependant on the temperature and nature of the resole it also tends to produce a less uniform cell structure. It also tends to increase the density of the foam because of the increase in the rate of hardening. In fact, if too high a concentration of hardener is used, the rate of hardening may be so rapid that no foaming occurs at all and under some conditions the reaction can become explosive because of the build up of gas inside a hardened shell of resin. The appropriate amount of hardener will depend primarily on the temperature of the mixture of resole and hardener prior to the commencement of the exothermic curing reaction and the reactivity number of the resole and will vary inversely with the chosen temperature and the reactivity number. The preferred range of hardener concentration is the equivalent of 2 to 20 parts by weight of p-toluene sulfonic acid per 100 parts by weight of phenol/aldehyde reaction product in the resole, assuming that the resole has a substantially neutral reaction, i.e. a pH of about 7. By equivalent to p-toluene sulfonic acid, we mean the amount of hardener required to give substantially the same curing time as the stated amount of p-toluene sulfonic acid. The most suitable amount for any given temperature and combination of resole and finely divided solid is readily determinable by simple experiment. Where the preferred temperature range is 25 to 75° C. and the resole has a reactivity number of at least 10, the best results are generally obtained with the use of hardener in amounts equivalent to 3 to 10 parts of p-toluene sulfonic acid per 100 parts by weight of the phenol/aldehyde reaction product. For use with temperatures below 25° C. or resoles having a reactivity number below 10, it may be necessary to use more hardener.

By suitable control of the temperature and of the hardener concentration, the time lapse between adding the hardener to the resole and the composition becoming hard (referred to herein as the curing time) can be varied at will from a few seconds to up to an hour or even more, without substantially affecting the density and cell structure of the product.

Another factor that controls the amount of hardener required can be the nature of the inert solid, where present. Very few are exactly neutral and if the solid has an alkaline reaction, even if only very slight, more hardener may be required because of the tendency of the filler to neutralize it. It is therefore to be understood that the preferred values for hardener concentration given above do not take into account any such effect of the solid. Any adjustment required because of the nature of the solid will depend on the amount of solid used and can be determined by simple experiment.

The exothermic curing reaction of the resole and acid hardener leads to the formation of by-products, particularly aldehyde and water, which are at least partially volatilised.

The curing reaction is effected in the presence of a finely divided inert and insoluble particulate solid which is substantially uniformly dispersed throughout the mixture of resole and hardener. By an inert solid we mean that in the quantity it is used it does not prevent the curing reaction.

It is believed that the finely divided particulate solid provides nuclei for the gas bubbles formed by the volatilisation of the small molecules, primarily formaldehyde and/or water, present in the resole and/or generated by the curing action, and provides sites at which bubble formation is promoted, thereby assisting uniformity of pore size. The presence of the finely divided solid may also promote stabilisation of the individual bubbles and reduce the tendency of bubbles to agglomerate and eventually cause likelihood of bubble collapse prior to cure. To achieve the desired effect, the solid should be present in an amount of not less than 5% by weight based on the weight of the resole.

Any finely divided particulate solid that is insoluble in the reaction mixture is suitable, provided it is inert. Examples of suitable particulate solids are provided above.

Solids having more than a slightly alkaline reaction, e.g. silicates and carbonates of alkali metals, are preferably avoided because of their tendency to react with the acid hardener. Solids such as talc, however, which have a very mild alkaline reaction, in some cases because of contamination with more strongly alkaline materials such as magnesite, are acceptable.

Some materials, especially fibrous materials such as wood flour, can be absorbent and it may therefore be necessary to use generally larger amounts of these materials than non-fibrous materials, to achieve valuable foamed products.

The solids preferably have a particle size in the range 0.5 to 800 microns. If the particle size is too great, the cell structure of the foam tends to become undesirably coarse. On the other hand, at very small particle sizes, the foams obtained tend to be rather dense. The preferred range is 1 to 100 microns, most preferably 2 to 40 microns. Uniformity of cell structure appears to be encouraged by uniformity of particle size. Mixtures of solids may be used if desired.

If desired, solids such as finely divided metal powders may be included which contribute to the volume of gas or vapour generated during the process. If used alone, however, it will be understood that the residues they leave after the gas by decomposition or chemical reaction satisfy the requirements of the inert and insoluble finely divided particulate solid required by the process of the invention.

Preferably, the finely divided solid has a density that is not greatly different from that of the resole, so as to reduce the possibility of the finely divided solid tending to accumulate towards the bottom of the mixture after mixing.

One preferred class of solids is the hydraulic cements, e.g. gypsum and plaster, but not Portland cement because of its alkalinity. These solids will tend to react with water present in the reaction mixture to produce a hardened skeletal structure within the cured resin product. Moreover, the reaction with the water is also exothermic and assists in the foaming and curing reaction. Foamed products obtained using these materials have particularly valuable physical properties. Moreover, when exposed to flame even for long periods of time they tend to char to a brick-like consistency that is still strong and capable of supporting loads. The products also have excellent thermal insulation and energy absorption properties. The preferred amount of inert particulate solid is from 20 to 200 parts by weight per 100 parts by weight of resole.

Another class of solids that is preferred because its use yields products having properties similar to those obtained using hydraulic cements comprises talc and fly ash. The preferred amounts of these solids are also 20 to 200 parts by weight per 100 parts by weight of resole.

For the above classes of solid, the most preferred range is 50 to 150 parts per 100 parts of resole.

In general, the maximum amount of solid that can be employed is controlled only by the physical problem of incorporating it into the mixture and handling the mixture. In general it is desired that the mixture is pourable but even at quite high solids concentrations, when the mixture is like a dough or paste and cannot be poured, foamed products with valuable properties can be obtained.

Other additives may be included in the foam-forming mixture. These may include: (i) surfactants, such as anionic materials, e.g. sodium salts of long chain alkyl benzene sulfonic acids, non-ionic materials such as those based on poly(ethyleneoxide) or copolymers thereof, and cationic materials such as long chain quaternary ammonium compounds or those based on polyacrylamides; (ii) viscosity modifiers such as alkyl cellulose, especially methyl cellulose; and (iii) colorants, such as dyes or pigments. Plasticisers for phenolic resins may also be included provided the curing and foaming reactions are not suppressed thereby, and polyfunctional compounds other than the dihydric compounds referred to above may be included which take part in the cross-linking reaction which occurs in curing; e.g. di- or poly-amines, di- or poly-isocyanates, di- or poly-carboxylic acids and aminoalcohols. Polymerisable unsaturated compounds may also be included, possibly together with free-radical polymerisation initiators that are activated during the curing reaction, e.g. acrylic monomers, so-called urethane acrylates, styrene, maleic acid and derivatives thereof, and mixtures thereof. The foam-forming compositions may also contain dehydrators, if desired.

Other resins may be included e.g. as prepolymers which are cured during the foaming and curing reaction or as powders, emulsions or dispersions. Examples are polyacetals such as polyvinyl acetals, vinyl polymers, olefin polymers, polyesters, acrylic polymers and styrene polymers, polyurethanes and prepolymers thereof and polyester prepolymers, as well as melamine resins, phenolic novolaks, etc. Conventional blowing agents may also be included to enhance the foaming reaction, e.g. low boiling organic compounds or compounds which decompose or react to produce gases.

The SMC may be prepared by applying a layer of a resin paste, for example a polyester resin paste, containing additives where appropriate, onto a bottom film carrier. Glass fibres as the reinforcement are then applied to the upper surface of the resin paste on the film carrier. A further layer of the resin paste is applied to sandwich the fibres between the layers of matrix. A top film is applied to the upper layer of the matrix. The resulting layered composition is subsequently compressed using a series of rollers to form a sheet of the SMC between the film carriers. The material is rolled onto rollers and kept for at least 3 days at a regulated temperature of for example 23 to 27° C. The resulting SMC can be compression moulded with heat. The shelf life of the SMC before use is usually a few weeks.

Thermal Composites

In a further aspect, the present invention provides the use of a composite material panel in a modular building as herein described, wherein the composite material panel comprises a first insulating layer comprising a solid open-cell foam panel having at least one internal void provided therein, wherein the peripheral surfaces of the internal void are provided with an air-tight sealing coating.

As used herein, the term "internal void" is used to refer to a fully enclosed cavity or chamber within the solid open-cell foam panel. The term should not be considered to refer to the cells of the solid open-cell foam panel, but to a distinct void space within the internal structure of the foam panel which provides a thermal break, i.e. a discontinuity in the thermal conductivity of the panel. The air-tight sealing coating is provided over the peripheral surfaces of the or each internal void so as to hermetically seal the interior of the internal void.

In preferred embodiments, the solid open-cell foam panel has a plurality of internal voids provided therein. Preferably, the solid open-cell foam panel comprises a plurality of voids distributed in a two-dimensional array in the direction perpendicular to the panel thickness.

In principle, it is possible to use all previously described solid open-cell foam materials to form the composite material panels used according to this aspect of the invention. However, in preferred embodiments the solid open-cell foam is a substantially rigid, self-supporting polymeric foam which is resistant to deflection under load and does not collapse under moderate pressure. For example, the polymeric foam may be selected from phenolic resin foams, polystyrene foams, polyurethane foams, polyethylene foams, polyvinylchloride foams, polyvinylacetate foams, polyester foams polyether foams, and foam rubber. Preferably, the polymeric foam is selected from phenolic resin foams.

The solid open-cell foam may include a finely-divided particulate reinforcing material. Suitable particulate reinforcing materials are preferably inert and insoluble. The reinforcing material may be present in an amount of up to 10 weight percent based on the total weight of the foam, for example from 2 to 10 weight percent, or 5 to 10 weight percent based on the total weight of the foam. Suitable reinforcing materials include organic or inorganic (including metallic) particulate materials, which may be crystalline or amorphous. Even fibrous solids have been found to be effective, although not preferred. Non-limiting examples of suitable particulate materials include clays, clay minerals, talc, vermiculite, metal oxides, refractories, solid or hollow glass microspheres, fly ash, coal dust, wood flour, grain flour, nut shell flour, silica, mineral fibres such as finely chopped glass fibre and finely divided asbestos, chopped fibres, finely chopped natural or synthetic fibres, ground plastics and resins whether in the form of powder or fibres, e.g. reclaimed waste plastics and resins, pigments such as powdered paint and carbon black, and starches.

Preferably the solid open-cell foam has a density in the range of 100 to 500 $kg \cdot m^{-3}$, more preferably 120 to 400 $kg \cdot m^{-3}$, and most preferably 120 to 250 $kg \cdot m^{-3}$.

The physical properties of such foams, especially the compressive strength and deflection under load are believed to be related to (amongst other factors) cell wall thickness and average cell diameter. Preferably, the average cell diameter of the solid open-cell foam is in the range of about 0.5 mm to 5 mm, more preferably 0.5 or 1 mm to 2 or 3 mm.

The cells or pores of the solid open-cell foam are open to the surface of the internal void onto which the air-tight sealing coating is applied, and preferably they open out below the surface to a greater width than the opening, thereby providing an undercut which can enhance the keying of the air-tight sealing material to the open-cell foam.

The interior of each internal void is preferably evacuated so as to form a partial vacuum within the internal void. For instance, the internal void may desirably have an internal pressure of from 10,000 to 95,000 kPa, for example 20,000 to 80,000 kPa.

Each internal void may contain air or an inert gas, either at or around atmospheric pressure, or under a partial vacuum as described above. Examples of inert gases which may be introduced into the internal voids include nitrogen, helium, neon, argon, krypton and xenon. Preferably, the inert gas is nitrogen.

It is also envisioned that other materials, preferably gaseous materials, could be introduced into the internal voids, for instance fire retardants such as haloalkane gases (known as halons).

The air-tight sealing coating is provided over the peripheral surfaces of each internal void so as to hermetically seal the interior of the internal void.

The air-tight sealing coating preferably comprises or consists of one or more elastomers. Preferably, the air-tight sealing coating comprises or consists of at least one elastomer selected from: natural rubber, synthetic polyisoprene, butyl rubber, halogenated butyl rubber, polybutadiene, styrene-butadiene rubber, nitrile rubber, hydrogenated nitrile rubber, chloroprene rubber, silicone rubber, and halogenated silicone rubber.

The air-tight sealing coating preferably penetrates at least a portion of the solid open-cell foam around the periphery of the internal void. For example, the air-tight sealing coating may penetrate the solid open-cell foam to a depth which is at least equivalent to the average cell diameter of the foam, more preferably to a depth which is at least two times the average cell diameter of the foam. Alternatively, the air-tight sealing coating may penetrate the solid open-cell foam to a depth of at least 0.5 mm, more preferably at least 1.0 mm, and still more preferably at least 2.0 mm, for example at least 2.5 mm or at least 3.0 mm.

In accordance with this aspect of the invention, the solid open-cell foam panel preferably has a thickness of from 1 to 50 cm, more preferably from 2 to 40 cm. In further preferred embodiments, the solid open-cell foam panel of the invention may have a thickness of from 2 to 5 cm, from 5 to 10 cm, from 10 to 20 cm, from 20 to 30 cm, or from 30 to 40 cm.

The length and width of the solid open-cell foam panel are not particularly limited and may each take a range of values, for instance in the range of from 20 to 10,000 cm, for example from 50 to 5,000 cm. Multiplying the length by the width provides the surface area of the solid open-cell foam panel, which as used herein refers to the surface area of a single face of the solid open-cell foam panel.

It will be appreciated that the size of the composite material panel will depend on the end use of the panel. In general panels having greater length and width will also have greater thickness so as to maintain a functional level of rigidity of the panel.

In accordance with this aspect of the invention, each internal void preferably has an average depth in the panel thickness direction of from 10% to 90% of the solid open-cell foam panel thickness, more preferably from 20% to 80% of the solid open-cell foam panel thickness, and still more preferably from 30% to 70% of the solid open-cell foam panel thickness. In further preferred embodiments, each internal void may have an average depth in the panel thickness direction of from 30% to 40% of the solid open-cell foam panel thickness, from 40% to 50% of the solid open-cell foam panel thickness, from 50% to 60% of the solid open-cell foam panel thickness, or from 60% to 70% of the solid open-cell foam panel thickness.

The cross-sectional area of each internal void in the direction perpendicular to the panel thickness is not particularly limited and may be varied by the skilled person to take account of the degree of thermal insulation required and the structural performance required of the panel. Merely for example, the cross-sectional area of each void may be from as little as 1.0 $cm^2$ to as much as 10,000 $cm^2$. In preferred embodiments, the cross-sectional area of each void may be from 5.0 $cm^2$ to 5,000 $cm^2$, for example from 10 $cm^2$ to 2,500 $cm^2$, from 20 $cm^2$ to 1,000 $cm^2$ or from 50 $cm^2$ to 500 $cm^2$. It will be appreciated that voids having a larger cross-sectional area in the direction perpendicular to the panel thickness are more appropriate as the thickness of the panel is increased.

The total cross-sectional area of all internal voids in the solid open-cell foam panel in the direction perpendicular to the panel thickness is not particularly limited. It will be appreciated by the skilled person that as the total area of the internal voids is decreased relative to the total surface area of the panel, the thermal insulating properties of the panel are also decreased. However, increasing the total area of the internal voids relative to the total surface area of the panel may reduce the compression strength and rigidity of the panel. This effect can be mitigated in some cases by dividing the total area of the internal voids over a large number of voids each having a small area rather than a smaller number of internal voids each having a large area.

In further preferred embodiments, the total area of the internal voids may be from 5% to 90% of the surface area of the solid open-cell foam panel, more preferably from 10 to 80% of the total surface area of the solid open-cell foam panel. In particularly preferred embodiments, the total area of the internal voids is from 40% to 80% of the surface area of the solid open-cell foam panel, for example from 40% to 50%, from 50% to 60%, from 60% to 70% or from 70% to 80% of the surface area of the solid open-cell foam panel.

If required, the internal voids may contain reinforcing structures to maintain the strength and rigidity of the panels and/or to maintain the shape of the internal voids (e.g. where the internal voids are under partial vacuum). Suitable reinforcing structures may include reinforcing bars or posts which may, for instance, be formed from metal or from a solid-open-cell foam material. It will be appreciated that a reinforcing bar extending across an entire internal void may subdivide the void into separate portions. Such a subdivided void is within the scope of the present invention. Where a reinforcing bar or post is formed from a solid open-cell foam, it is not necessary that the reinforcing bar or post itself be provided with an air-tight sealing coating, provided that the peripheral surfaces of the internal void surrounding the reinforcing bar or post are provided with an air-tight sealing coating.

In accordance with this aspect of the invention, the composite material panel may comprise one or more additional layers associated with the solid open-cell foam panel.

In preferred embodiments, the composite material panels of the invention may comprise one or more additional foam layers. The additional foam layer(s) may comprise an open cell foam layer, for instance using the open cell foams described above, or a layer of a closed cell foam such as are well-known in the art. In a preferred embodiment, the composite material panel may comprise an additional solid open-cell foam panel having at least one internal void provided therein, as described above.

In further preferred embodiments, the composite material panels of the invention may comprise a layer of a sheet-form polymeric material. As used herein, the term "sheet-form polymeric material" is preferably used to refer to a sheet-form curable material. More preferably, the sheet-form polymeric material penetrates a surface of the solid open-cell foam panel when cured so as to form a bond.

Preferably, the sheet-form polymeric material comprises a thermosetting polymer resin matrix, for example, a thermosetting polymer resin matrix selected from polyester resins, vinyl ester resins, epoxy resins, phenolic resins, bismaleimide resins or polyimide resins. Most preferably, the sheet-form polymeric material comprises a thermosetting polymer resin selected from polyester resins. The sheet-form polymeric material may also include melamine, which is useful as a fire retardant. The sheet-form polymeric material may further include additives selected from hardeners, accelerators, fillers, pigments, and/or any other components as required. The matrix may include a thermoplastic material.

The sheet-form polymeric material may comprise reinforcement, for example reinforcing fibres. The fibres may include one or more materials. For example the fibres may include one or more of carbon fibres, glass fibres, aramid fibres and/or polyethylene fibres. Preferably, the reinforcement comprises or consists of glass fibres.

The reinforcing fibres may be short fibres, for example having lengths of 5.0 cm or less, or may be longer fibres. The fibres may be loose, for example, the fibres may be arranged in a uni- or multi-directional manner. The fibres may be part of a network, for example woven or knitted together in any appropriate manner. The arrangement of the fibres may be random or regular, and may comprise a fabric, mat, felt or woven or other arrangement. Fibres may provide a continuous filament winding. Optionally, more than one layer of fibres may be provided.

Preferably the layer of sheet-form polymeric material comprises SMC (sheet moulding compound). The SMC preferably includes a thermosetting polymer matrix as defined above and reinforcing fibres also as defined above. For example, the SMC may include a thermosetting resin, for example a polyester resin, together with reinforcing fibres, for example glass fibres. The thermosetting polymer may further comprise additives, for example minerals, inert fillers, pigments, stabilizers, inhibitors, release agents, catalysts, thickeners, hydrating additives and/or other suitable materials.

There are benefits in using SMC. For example, SMC has low density but favourable mechanical properties compared with other sheet-form polymeric materials, and also exhibits good thermal properties. Of particular importance for some applications, for example building applications, resistance to fire is good. SMC also shows good chemical resistance.

In preferred embodiments, the composite material panels of the invention may comprise a thermally insulating core comprising a solid open-cell foam panel as defined above and optionally one or more additional foam layers, wherein the core is sandwiched between first and second layers of sheet-form polymeric material. The first and second layers of sheet-form polymeric material may be the same or different. Preferably, the first and second layers of sheet-form polymeric material comprise a thermosetting polymer matrix as defined above, and optionally reinforcement as defined above. For example, the first and second layers of sheet-form polymeric material may comprise SMC as defined above. Thus, in one embodiment, the invention relates to a layered composite material panel wherein an insulating core comprising a solid open-cell foam panel as defined above is sandwiched between outer layers of sheet-form polymeric material, for example SMC.

The composite material panels of the invention may further comprise one or more reinforcing layers to provide additional strength, rigidity and/or weight-bearing capacity to the panels. Thus, alternatively or in addition to reinforcement being provided as an integral part of sheet-form polymeric material, reinforcement may be provided as a separate layer, for example arranged between a sheet-form polymeric material layer and the substrate.

Where a separate layer of reinforcement is provided, it may be coextensive with the solid open-cell foam panel, or it may be provided only in certain areas of the layered composite material where reinforcement is required. If there is a particular area of the composite material panel which is more susceptible to damage in use, then additional reinforcement can be provided in that area, for example at the edges and/or at the corners of the composite material panel.

In accordance with this aspect of the invention, the composite material panels may further comprise one or more fire retardant layers. Examples of materials which may be incorporated into the one or more fire retardant layers include rock wool, gypsum, perlite, vermiculite, alumina, aluminium hydroxide, magnesium hydroxide, and calcium silicate.

The solid open-cell foam panels for use according to this aspect of the invention may be prepared by a method comprising the steps of:

(i) providing a first solid open-cell foam panel having at least one recess provided in a surface thereof;
(ii) coating the periphery of the recess with an air-tight sealing coating material, such as an elastomer as described above; and
(iii) sealing the first solid open-cell foam panel to a second solid open-cell foam panel which is also provided with an air-tight sealing coating so as to form a hermetically sealed internal void at the or each recess.

In accordance with this method, the second solid open-cell foam panel may have at least one recess provided in a surface thereof which is complementary to a recess provided on a surface of the first solid open-cell foam panel.

The solid open-cell foam panels for use according to this aspect of the invention may also be prepared by a method comprising the steps of:

(i) providing a first solid open-cell foam panel having at least one opening extending through the entire thickness of the panel;
(ii) coating the periphery of the opening with an air-tight sealing coating material, such as an elastomer as described above; and
(iii) sandwiching the first solid open-cell foam panel between second and third solid open-cell foam panels, each of which is also provided with an air-tight sealing coating so as to form a hermetically sealed internal void at the or each opening.

In accordance with this method, the second and/or the third solid open-cell foam panel may optionally have at least one recess provided in a surface thereof which is complementary to the opening in the first solid open-cell foam panel.

The solid open-cell foam panels for use according to this aspect of the invention may also be prepared by a method comprising the steps of:

(i) providing a first solid open-cell foam panel;
(ii) bonding rails and stiles of solid open-cell foam on the surface of the first solid open-cell foam panel so as to define at least one recess enclosed by the rails and stiles;
(iii) coating the periphery of the recess with an air-tight sealing coating material, such as an elastomer as described above; and
(iv) sealing a second open-cell foam panel which is also provided with an air-tight sealing coating to the assembly from step (iii) so as to form a hermetically sealed internal void at the or each recess.

In preferred embodiments of the above methods, the material used to form the airtight sealing coating on the periphery of the internal void may also be used to bond the panels and/or the rails and stiles to one another. When used in this way, the air-tight sealing coating preferably penetrates at least a portion of the solid open-cell foam on either side of the bond. For example, the air-tight sealing coating may penetrate the solid open-cell foam to a depth which is at least equivalent to the average cell diameter of the foam, more preferably to a depth which is at least two times the average cell diameter of the foam. Alternatively, the air-tight sealing coating may penetrate the solid open-cell foam to a depth of at least 0.5 mm, more preferably at least 1.0 mm, and still more preferably at least 2.0 mm, for example at least 2.5 mm or at least 3.0 mm.

In a further aspect the present invention provides the use of a composite material panel in a modular building as herein described, wherein the composite material panel comprises a first insulating layer comprising a solid open-cell foam panel and at least one layer of a sheet-form polymeric material, wherein an internal void is provided between the solid open-cell foam panel and the at least one layer of sheet-form polymeric material, wherein the surfaces of the open cell foam panel peripheral to the internal void are provided with an air-tight sealing coating, and wherein the sheet-form polymeric material is bonded to the solid open-cell foam panel so as to hermetically seal the internal void.

In accordance with this aspect of the invention, the solid open-cell foam, the sheet-form polymeric material, and the air-tight sealing coating are preferably as described above.

Preferably, an air-tight sealing coating is also provided on the surfaces of the sheet-form polymeric material peripheral to the internal void, such that the air-tight sealing coating forms a hermetic seal over all peripheral surfaces of the internal void.

As above, the term "internal void" is used to refer to a fully enclosed cavity or chamber formed between the solid open-cell foam panel and the at least one layer of a sheet-form polymeric material. The term should not be considered to refer to the cells of the solid open-cell foam panel, but to a distinct void space within the internal structure of the panel which provides a thermal break, i.e. a discontinuity in the thermal conductivity of the panel. A hermetic seal is formed by the airtight sealing coating provided on the surfaces of the open cell foam panel peripheral to the internal void and the sheet-form polymeric material.

In preferred embodiments, plurality of internal voids are provided between the solid open-cell foam panel and the at least one layer of sheet-form polymeric material. Preferably the thermal insulating layer comprises a plurality of voids distributed in a two-dimensional array in the direction perpendicular to the panel thickness.

In accordance with this aspect of the invention, the or each internal void may comprise a recess or depression in a surface of the open-cell foam panel which is hermetically sealed by a layer of sheet-form polymeric material which overlies the recess and is bonded to the surface of the open-cell foam panel at least at the periphery of the recess or depression. The layer of sheet-form polymeric material preferably comprises a thermosetting polymer matrix as defined above, and optionally reinforcement as defined above. For example, the layer of sheet-form polymeric material may comprise SMC as defined above.

In an alternative embodiment, the or each internal void may be formed by providing a first solid open-cell foam panel having at least one opening extending through the entire thickness of the panel, and hermetically sealing the opening by bonding a first layer of sheet-form polymeric material to the surface of the open-cell foam panel on one side of the opening and bonding a second layer of sheet-form polymeric material to the surface of the open-cell foam panel on the opposite side of the opening. The first and second layers of sheet-form polymeric material are each bonded at least to the adjacent periphery of the opening so as to form the internal void. The first and second layers of sheet-form polymeric material may be the same or different. Preferably, the first and second layers of sheet-form polymeric material comprise a thermosetting polymer matrix as defined above, and optionally reinforcement as defined above. For example, the first and second layers of sheet-form polymeric material may comprise SMC as defined above. Preferably, the sheet-form polymeric material penetrates a surface of the solid open-cell foam panel when cured so as to form a bond.

The interior of each internal void is preferably evacuated so as to form a partial vacuum within the internal void. For instance, the internal void may desirably have an internal pressure of from 10,000 to 95,000 kPa, for example 20,000 to 80,000 kPa.

Each internal void may contain air or an inert gas, either at or around atmospheric pressure, or under a partial vacuum as described above. Examples of inert gases which may be introduced into the internal voids include nitrogen, helium, neon, argon, krypton and xenon. Preferably, the inert gas is nitrogen.

It is also envisioned that other materials, preferably gaseous materials, could be introduced into the internal voids, for instance fire retardants such as haloalkane gases (known as halons).

The air-tight sealing coating preferably penetrates at least a portion of the solid open-cell foam around the periphery of the internal void. For example, the air-tight sealing coating may penetrate the solid open-cell foam to a depth which is at least equivalent to the average cell diameter of the foam, more preferably to a depth which is at least two times the average cell diameter of the foam. Alternatively, the air-tight sealing coating may penetrate the solid open-cell foam to a depth of at least 0.5 mm, more preferably at least 1.0 mm, and still more preferably at least 2.0 mm, for example at least 2.5 mm or at least 3.0 mm.

In accordance with this aspect of the invention, the solid open-cell foam panel has a thickness of from 1 to 50 cm, more preferably from 2 to 40 cm. In further preferred embodiments, the solid open-cell foam panel of the invention may have a thickness of from 2 to 5 cm, from 5 to 10 cm, from 10 to 20 cm, from 20 to 30 cm, or from 30 to 40 cm.

The length and width of the solid open-cell foam panel are not particularly limited and may each take a range of values, for instance in the range of from 20 to 10,000 cm, for example from 50 to 5,000 cm. Multiplying the length by the width provides the surface area of the panel, which as used herein refers to the surface area of a single face of the panel.

In accordance with this aspect of the present invention, each internal void preferably has an average depth in the panel thickness direction of from 10% to 90% of the solid open-cell foam panel thickness, more preferably from 20% to 80% of the solid open-cell foam panel thickness, and still more preferably from 30% to 70% of the solid open-cell foam panel thickness. In further preferred embodiments, each internal void may have an average depth in the panel thickness direction of from 30% to 40% of the solid open-cell foam panel thickness, from 40% to 50% of the solid open-cell foam panel thickness, from 50% to 60% of the solid open-cell foam panel thickness, or from 60% to 70% of the solid open-cell foam panel thickness.

As above, the cross-sectional area of each internal void in the direction perpendicular to the panel thickness is not particularly limited and may be varied by the skilled person to take account of the degree of thermal insulation required and the structural performance required of the panel. Merely for example, the cross-sectional area of each void may be from as little as 1.0 $cm^2$ to as much as 10,000 $cm^2$. In preferred embodiments, the cross-sectional area of each void may be from 5.0 $cm^2$ to 5,000 $cm^2$, for example from 10 $cm^2$ to 2,500 $cm^2$, from 20 $cm^2$ to 1,000 $cm^2$ or from 50 $cm^2$ to 500 $cm^2$. It will be appreciated that voids having a larger cross-sectional area in the direction perpendicular to the panel thickness are more appropriate as the thickness of the panel is increased.

The total cross-sectional area of all internal voids in the panel in the direction perpendicular to the panel thickness is also not particularly limited. It will be appreciated by the skilled person that as the total area of the internal voids is decreased relative to the total surface area of the panel, the thermal insulating properties of the panel are also decreased. However, increasing the total area of the internal voids relative to the total surface area of the panel may reduce the compression strength and rigidity of the panel. This effect can be mitigated in some cases by dividing the total area of the internal voids over a large number of voids each having a small area rather than a smaller number of internal voids each having a large area.

In preferred embodiments of the invention, the total area of the internal voids may be from 5% to 90% of the surface area of the solid open-cell foam panel, more preferably from 10 to 80% of the total surface area of the solid open-cell foam panel. In particularly preferred embodiments, the total area of the internal voids is from 40% to 80% of the surface area of the solid open-cell foam panel, for example from 40% to 50%, from 50% to 60%, from 60% to 70% or from 70% to 80% of the surface area of the solid open-cell foam panel.

As discussed above, the internal voids may contain reinforcing structures as required to maintain the strength and rigidity of the panels and/or to maintain the shape of the internal voids (e.g. where the internal voids are under partial vacuum). Suitable reinforcing structures may include reinforcing bars or posts which may, for instance, be formed from metal or from a solid-open-cell foam material.

As discussed above, the composite material panel of this aspect of the invention may comprise one or more additional layers associated with the solid open-cell foam panel and the layer of sheet-form polymeric material. The additional layers may be selected from:

(i) one or more additional foam layers, for instance one or more solid open-cell foam layers having an internal void in accordance with the first aspect of the invention, or other types of foam layers as discussed above;

(ii) one or more additional layers of sheet-form polymeric material, as discussed above;

(iii) one or more reinforcing layers, as discussed above; and (iv) one or more fire retardant layers, as discussed above.

In a further aspect, the present invention provides the use of a composite material panel in a modular building as herein described, wherein the composite material panel comprises: (i) a first layer of a sheet-form polymeric material; and (ii) a first insulating layer comprising a first solid open-cell foam panel, wherein the solid open-cell foam panel is provided with an air-tight sealing coating forming a hermetic seal surrounding the open-cell foam panel.

In accordance with this aspect of the invention, the solid open-cell and/or the sheet-form polymeric material foam may be as described above.

The interior of the solid open-cell foam panel is preferably evacuated so as to form a partial vacuum within the air-tight sealing coating. For instance, the interior of the solid open-cell foam panel may desirably have an internal pressure of from 10,000 to 95,000 kPa, for example 20,000 to 80,000 kPa.

The solid open-cell foam panel may contain air or an inert gas within the air-tight sealing coating, either at or around atmospheric pressure, or under a partial vacuum as described above. Examples of inert gases which may be introduced into the solid open-cell foam panel include nitrogen, helium, neon, argon, krypton and xenon. Preferably, the inert gas is nitrogen.

It is also envisioned that other materials, preferably gaseous materials, could be introduced into the solid open-cell foam within the air-tight sealing coating, for instance fire retardants such as haloalkane gases (known as halons).

The air-tight sealing coating preferably comprises or consists of one or more elastomers, more preferably one or more elastomers as described above.

In accordance with this aspect of the invention, the air-tight sealing coating preferably penetrates at least a portion of the solid open-cell foam. For example, the air-tight sealing coating may penetrate the solid open-cell foam to a depth which is at least equivalent to the average cell diameter of the foam, more preferably to a depth which is at least two times the average cell diameter of the foam. Alternatively, the air-tight sealing coating may penetrate the solid open-cell foam to a depth of at least 0.5 mm, more preferably at least 1.0 mm, and still more preferably at least 2.0 mm, for example 2.5 mm or 3.0 mm.

In accordance with this aspect of the present invention, the solid open-cell foam panel may optionally be partitioned into a plurality of chambers, wherein each chamber is individually provided with an air-tight sealing coating. Preferably, the plurality of insulating layer chambers extend substantially across the entire first insulating layer, such that there is an air-tight seal formed between edges of adjacent insulating chambers. For instance, the air-tight sealing coating may extend between abutting edges of the insulating layer chambers. In this way, if the air-tight sealing coating of one insulating layer chamber is compromised, for example by being penetrated by a nail or through cutting the layered composite material to the required size, the insulation effect is only lost in respect that insulating layer chamber.

Preferably, each chamber is manufactured separately and an array of chambers is bonded together in a two-dimensional array to form a panel structure.

In accordance with this aspect of the invention, the layered composite material panel may further comprise a second layer of a sheet-form polymeric material, such that the solid open-cell foam panel is sandwiched between first and second layers of sheet-form polymeric material. The first and second layers of sheet-form polymeric material may be the same or different. Preferably, the second layer of sheet-form polymeric material comprises a thermosetting polymer matrix as defined above, an optionally reinforcement as defined above. For example, the second layer of sheet from polymeric material may comprise SMC as defined above. Thus, in one embodiment, this aspect of the invention relates to a three layer composite wherein the solid open-cell foam panel is sandwiched between outer layers of sheet-form polymeric material, for example SMC.

As discussed above, other arrangements of layers are also possible. For instance, the composite material panel may include one or more further layers of sheet-form polymeric material, one or more further insulating layers, one or more reinforcing layers, and/or one or more fire-retardant layers, as discussed above.

Thus, alternatively or in addition to reinforcement being provided as an integral part of the sheet-form polymeric material, reinforcement may be provided as a separate layer, for example arranged between the sheet-form polymeric material and the solid open-cell foam panel. As above, a separate layer of reinforcement may be coextensive with the first insulating layer, or it may be provided only in certain areas of the layered composite material where reinforcement is required.

The layered composite material panels for use according to this aspect of the invention may further comprise one or more additional insulating layers. For example, the one or more additional insulating layers may be selected from a solid open-cell or closed-cell foam. For example, the one or more additional insulating layers may comprise a solid open-cell foam as defined above, which may optionally be provided with an air-tight sealing coating as with the first solid open-cell foam panel. Alternatively, or in addition, the one or more additional insulating layers may comprise solid open-cell foam panel in accordance with the first aspect of the invention, and/or a thermal insulating layer as defined in relation to the second aspect of the invention.

In accordance with this aspect of the invention, there is provided, in particular, the use of a layered composite material panel wherein the first insulating layer is sandwiched between two layers of sheet-form polymeric material to form a three-layer composite material panel.

There is also provided the use of a layered composite material panel wherein the first insulating layer and an additional insulating foam layer are sandwiched between two layers of sheet-form polymeric material to form a four-layer composite material panel.

There is further provided the use of a layered composite material panel, wherein the first insulating layer is sandwiched between two additional insulating foam layers, and wherein the resulting assembly is sandwiched between two layers of sheet-form polymeric material to form a five-layer composite material panel.

Where the composite material panel of the invention contains a layer of sheet-form polymeric material adjacent to an open-cell foam layer which does not have an air-tight sealing coating adjacent to the sheet-form polymeric material, the sheet-form polymeric material preferably penetrates a surface of the solid open-cell foam panel when cured so as to form a bond.

The composite material panels for use according to this aspect of the invention may be prepared by a method comprising the steps of:

(i) coating a solid open-cell foam with an air-tight sealing coating so as to provide a first insulating layer;
(ii) providing a first layer of sheet-form polymeric material; and
(iii) bonding the first insulating layer directly or indirectly to the sheet-form polymeric material.

In accordance with this aspect of the invention, bonding the insulating layer indirectly to the sheet-form polymeric material means that one or more intermediate layers are present between the first insulating layer and the first layer of sheet-form polymeric material. For example, a further insulating layer may be present between the first insulating layer and the first layer of sheet-form polymeric material. Thus, one or more further layers, such as a further insulating layer, may be provided, so as to form a multi-layer composite.

In preferred embodiments, the composite material panels of the above aspects of the invention may have a profiled surface. For example, the outer surface of the layered composite material may have a profiled surface formed by moulding.

Where the layered composite material panel has a profiled surface formed by moulding, the outer surface of the panel on the profiled face is preferably a sheet-form polymeric layer, such as SMC. Preferably, the sheet-form layer is adjacent to a solid open-cell foam layer, such as a solid open-cell phenolic resin foam layer, which most preferably does not have an air-tight sealing coating provided thereon.

In accordance with the above aspects of the invention, an outer surface of the sheet-form polymeric material may optionally be bonded to a surface effect material. In accordance with this aspect of the invention, the surface effect material may be selected so as to provide the layered composite material panel with, for example, a simulated stone surface, a simulated wood surface, a wood laminate surface, a material of high thermal conductivity (a "cool touch" surface), or a reflective surface. For example, a granular material, such as sand or metal granules, a veneer element, such as a wood veneer element, or a metallic foil/metallic particles can be bonded to, or partially embedded into the surface of the sheet-form polymeric material. Different surface effects can be obtained by selection of the types of surface effect materials that are used. For thermal insulation purposes, the use of a reflective surface, such as a metallic foil, is advantageous as it reduces the radiant heat absorbed by the insulating composite material panel of the invention.

In a further aspect, the present invention provides the use of a composite material panel in a modular building as herein described, wherein the composite material panel comprises: (i) a first insulating layer comprising a solid open-cell foam panel, wherein the solid open-cell foam panel is provided with an air-tight sealing coating; and (ii) one or more additional insulating layers.

In accordance with this aspect of the invention, the first insulating layer is preferably as defined in connection with the third aspect of the invention.

The one or more additional insulating layers are also preferably as defined above. Thus, the one or more additional insulating layers may be independently selected from a solid open-cell insulating foam or a solid closed-cell insulating foam. For example, the one or more additional insulating layers may comprise a solid open-cell foam as defined above, which may optionally be provided with an air-tight sealing coating, for example comprising one or more elastomers. Alternatively, or in addition, the one or more additional insulating layers may comprise an insulating layer as defined in relation to the first aspect of the invention, and/or an insulating layer as defined in relation to the second aspect of the invention.

In accordance with this aspect of the invention, the layered composite material panel may further comprise one or more additional layers selected from one or more reinforcing layers, and/or one or more fire-retardant layers, as discussed above.

Thus, reinforcement may optionally be provided as a separate layer, for example arranged between the first insulating layer and the one or more additional insulating layers. As above, a separate layer of reinforcement may be coextensive with the first insulating layer, or it may be provided only in certain areas of the layered composite material where reinforcement is required.

The composite material panel for use according to this aspect of the invention may have a profiled surface as discussed above.

The composite material panel for use according to this aspect of the invention may be prepared by a method comprising the steps of:

(i) coating a solid open-cell foam with an air-tight sealing coating so as to provide a first insulating layer;
(ii) providing a further insulating layer; and
(iii) bonding the first insulating layer directly or indirectly to the further insulating layer.

In accordance with this aspect of the invention, bonding the insulating layer indirectly to the further insulating layer means that one or more intermediate layers are present between the first insulating layer and the further insulating layer. Thus in accordance with this method, one or more further layers may be provided, so as to form a multi-layer composite.

In a further aspect, the present invention provides the use of a composite material panel in a modular building as herein described, wherein the composite material panel comprises: an insulating composite material comprising a solid open-cell phenolic resin foam, wherein the foam is provided with an air-tight sealing coating comprising an elastomer.

In accordance with this aspect of the invention, the solid open-cell phenolic resin foam is preferably as defined above.

In accordance with this aspect of the invention, the solid open-cell phenolic resin foam is preferably evacuated so as to form a partial vacuum within the air-tight sealing coating. For instance, the internal pressure within the air-tight sealing coating may be from 10,000 to 95,000 kPa, for example 20,000 to 80,000 kPa.

The solid open-cell phenolic resin foam may contain air or an inert gas within the air-tight sealing coating, either at or around atmospheric pressure, or under a partial vacuum as described above. Examples of inert gases which may be introduced into the solid open-cell phenolic resin foam include nitrogen, helium, neon, argon, krypton and xenon. Preferably, the inert gas is nitrogen.

The air-tight sealing coating preferably comprises or consists of one or more elastomers. Preferably, the air-tight sealing coating comprises or consists of at least one elastomer as defined above.

In accordance with this aspect of the present invention, the air-tight sealing coating preferably penetrates at least a portion of the solid open-cell phenolic resin foam. For example, the air-tight sealing coating may penetrate the solid open-cell foam to a depth which is at least equivalent to the average cell diameter of the foam, more preferably to a depth which is at least two times the average cell diameter of the foam. Alternatively, the the air-tight sealing coating may penetrate the solid open-cell foam to a depth of at least 0.5 mm, more preferably at least 1.0 mm, and still more preferably at least 2.0 mm, for example 2.5 mm or 3.0 mm.

In accordance with this aspect of the present invention, the insulating composite material panel may optionally be partitioned into a plurality of chambers, wherein each chamber is individually provided with an air-tight sealing coating. Preferably, the plurality of chambers are aligned adjacent to each other such that an air-tight seal is formed between the edges of adjacent chambers. For instance, the air-tight sealing coating may extend between the edges of adjacent chambers. In this way, if the air-tight sealing coating of one insulating layer chamber is compromised, for example by being penetrated by a nail or through cutting the layered composite material to the required size, the insulation effect is only lost in respect that chamber. Preferably, each chamber is manufactured separately and an array of chambers is bonded together in a two-dimensional array to form a layer structure.

Where the composite materials for use according to the above aspects of the present invention comprise a number of layers, the layers may be joined together in a variety of ways. For instance, where air-tight sealing coating material comprising an elastomer is used, the same coating material may be used to bond the first insulating layer to one or more adjacent layers of the layered composite material panel. Alternatively, or in addition, where a sheet-form polymeric material comprising a curable material is used, the sheet-form polymeric material may be bonded to one or more adjacent layers during curing of the sheet-form polymeric material, for instance using heat and/or pressure. In addition, a variety of known adhesives may be used to bond the individual layers of the layered composite material panel together.

Preferably, pressure is applied to the layered composite material during the bonding step so as to ensure good adhesion of the layers. As noted above, where one or more layers comprises a curable polymeric material, for example an SMC layer, the application of pressure may also assist in the curing of the curable polymer.

In accordance with the above aspects of the invention, the individual layers of layered composite material panels are preferably coextensive with each other. However, it is not excluded that in certain embodiments the various layers of the layered composite material panels may differ in extent. For example, the first insulating layer may extend beyond the surface area of one or more other layers of the layered composite material and/or one or more other layers of the layers of the layered composite material may extend beyond the first insulating layer.

The composite material panels for use according to the invention may be formed in a large surface area, or continuous configuration, and subsequently cut to the required size. However, unless the first insulating layer contains a plurality of internal voids, or comprises a plurality of chambers each having an air-tight sealing coating, the effect of any inert gas or vacuum contained within the air-tight sealing coating is lost. Alternatively, the composite material panels may be custom fabricated with the required dimensions for a particular application.

In one embodiment, the composite material panels for use according to the invention may be provided in the form of modular panels, wherein each panel is provided with interconnecting means to allow a series of panels to be interconnected. In a preferred embodiment, the interconnecting means is a tongue and groove arrangement.

As noted above, in aspects of the present invention, a suitable solid open-cell foam is a solid open-cell phenolic resin foam. A particularly suitable foam may be produced by way of a curing reaction between:

(a) a liquid phenolic resole having a reactivity number (as defined below) of at least 1; and (b) a strong acid hardener for the resole; optionally in the presence of:

(c) a finely divided inert and insoluble particulate solid which is present, where used, in an amount of at least 5% by weight of the liquid resole and is substantially uniformly dispersed through the mixture containing resole and hardener;

the temperature of the mixture containing resole and hardener due to applied heat not exceeding 85° C. and the said temperature and the concentration of the acid hardener being such that compounds generated as by-products of the curing reaction are volatilised within the mixture before the mixture sets such that a foamed phenolic resin product is produced.

By a phenolic resole is meant a solution in a suitable solvent of an acid-curable prepolymer composition prepared by condensation of at least one phenolic compound with at least one aldehyde, usually in the presence of an alkaline catalyst such as sodium hydroxide.

Examples of phenols that may be employed are phenol itself and substituted, usually alkyl substituted, derivatives thereof, with the condition that that the three positions on the phenolic benzene ring ortho- and para- to the phenolic hydroxyl group are unsubstituted. Mixtures of such phenols may also be used. Mixtures of one or more than one of such phenols with substituted phenols in which one of the ortho or para positions has been substituted may also be employed where an improvement in the flow characteristics of the resole is required. However, in this case the degree of cross-linking of the cured phenolic resin foam will be reduced. Phenol itself is generally preferred as the phenol component for economic reasons.

The aldehyde will generally be formaldehyde although the use of higher molecular weight aldehydes is not excluded.

The phenol/aldehyde condensation product component of the resole is suitably formed by reaction of the phenol with at least 1 mole of formaldehyde per mole of the phenol, the formaldehyde being generally provided as a solution in water, e.g. as formalin. It is preferred to use a molar ratio of formaldehyde to phenol of at least 1.25 to 1 but ratios above 2.5 to 1 are preferably avoided. The most preferred range is 1.4 to 2.0 to 1.

The mixture may also contain a compound having two active hydrogen atoms (dihydric compound) that will react with the phenol/aldehyde reaction product of the resole during the curing step to reduce the density of cross-linking. Preferred dihydric compounds are diols, especially alkylene diols or diols in which the chain of atoms between the hydroxy groups contains not only methylene and/or alkyl-substituted methylene groups but also one or more heteroatoms, especially oxygen atoms. Suitable diols include ethylene glycol, propylene glycol, propane-1,3-diol, butane-1,4-diol and neopentyl glycol. Particularly preferred diols are poly-, especially di-, (alkylene ether)diols, for example diethylene glycol and, especially, dipropylene glycol.

Preferably the dihydric compound is present in an amount of from 0 to 35% by weight, more preferably 0 to 25% by weight, based on the weight of phenol/aldehyde condensation product. Most preferably, the dihydric compound, when used, is present in an amount of from 5 to 15% by weight based on the weight of phenol/aldehyde condensation product. When such resoles containing dihydric compounds are employed in the present process, products having a particularly good combination of physical properties, especially strength, can be obtained.

Suitably, the dihydric compound is added to the formed resole and preferably has 2 to 6 atoms between OH groups.

The resole may comprise a solution of the phenol/aldehyde reaction product in water or in any other suitable solvent or in a solvent mixture, which may or may not include water.

Where water is used as the sole solvent, it is preferably present in an amount of from 15 to 35% by weight of the resole, preferably 20 to 30%. Of course the water content may be substantially less if it is used in conjunction with a cosolvent, e.g. an alcohol or one of the above-mentioned dihydric compounds where used.

As indicated above, the liquid resole (i.e. the solution of phenol/aldehyde product optionally containing dihydric compound) must have a reactivity number of at least 1. The reactivity number is 10/x where x is the time in minutes required to harden the resole using 10% by weight of the resole of a 66 to 67% aqueous solution of p-toluene sulfonic acid at 60° C. The test involves mixing about 5 ml of the resole with the stated amount of the p-toluene sulfonic acid solution in a test tube, immersing the test tube in a water bath heated to 60° C. and measuring the time required for the mixture to become hard to the touch. The resole should have a reactivity number of at least 1 for useful foamed products to be produced and preferably the resole has a reactivity number of at least 5, most preferably at least 10.

The pH of the resole, which is generally alkaline, is preferably adjusted to about 7, if necessary, for use in the process, suitably by the addition of a weak organic acid such as lactic acid.

Examples of strong acid hardeners are inorganic acids such as hydrochloric acid, sulphuric acid and phosphoric acid, and strong organic acids such as aromatic sulphonic acids, e.g. toluene sulphonic acids, and trichloroacetic acid. Weak acids such as acetic acid and propionic acid are generally not suitable. The preferred hardeners for the process of the invention are the aromatic sulfonic acids, especially toluene sulfonic acids.

The acid may be used as a solution in a suitable solvent such as water.

When the mixture of resole, hardener and solid is to be poured, e.g. into a mould and in slush moulding applications, the amount of inert solid that can be added to the resole and hardener is determined by the viscosity of the mixture of resole and hardener in the absence of the solid. For these applications, it is preferred that the hardener is provided in a form, e.g. solution, such that when mixed with the resole in the required amount yields a liquid having an apparent viscosity not exceeding about 50 poises at the temperature at which the mixture is to be used, and the preferred range is 5 to 20 poises. Below 5 poises, the amount of solvent present tends to present difficulties during the curing reaction.

The curing reaction is exothermic and will therefore of itself cause the temperature of the mixture containing resole and acid hardener to increase. The temperature of the mixture may also be raised by applied heat, but the temperature to which said mixture may then be raised (that is, excluding the effect of any exotherm) preferably does not exceed 85° C. If the temperature of the mixture exceeds 85° C. before addition of the hardener, it is usually difficult or impossible thereafter to properly disperse the hardener through the mixture because of incipient curing. On the other hand, it is difficult, if not impossible, to uniformly heat the mixture above 85° C. after addition of the hardener.

Increasing the temperature towards 85° C. tends to lead to coarseness and non-uniformity of the texture of the foam but this can be offset at least to some extent at moderate temperatures by reducing the concentration of hardener. However at temperatures much above 75° C. even the minimum amount of hardener required to cause the composition to set is generally too much to avoid these disadvantages. Thus, temperatures above 75° C. are preferably avoided and preferred temperatures for most applications are from ambient temperature to about 75° C. The preferred temperature range usually depends to some extent on the nature of the particulate solid, where used. For most solids the preferred temperature range is from 25 to 65° C., but for some solids, in particular wood flour and grain flour, the preferred temperature range is 25 to 75° C. The most preferred temperature range is 30 to 50° C. Temperatures below ambient, e.g. down to 10° C. can be used if desired, but no advantage is usually gained thereby. In general, at temperatures up to 75° C., increase in temperature leads to decrease in the density of the foam and vice versa.

The amount of hardener present also affects the nature of the product as well as the rate of hardening. Thus, increasing the amount of hardener not only has the effect of reducing the time required to harden the composition, but above a certain level dependant on the temperature and nature of the resole it also tends to produce a less uniform cell structure. It also tends to increase the density of the foam because of the increase in the rate of hardening. In fact, if too high a concentration of hardener is used, the rate of hardening may be so rapid that no foaming occurs at all and under some conditions the reaction can become explosive because of the build up of gas inside a hardened shell of resin. The appropriate amount of hardener will depend primarily on the temperature of the mixture of resole and hardener prior to the commencement of the exothermic curing reaction and the reactivity number of the resole and will vary inversely with the chosen temperature and the reactivity number. The preferred range of hardener concentration is the equivalent of 2 to 20 parts by weight of p-toluene sulfonic acid per 100 parts by weight of phenol/aldehyde reaction product in the resole assuming that the resole has a substantially neutral reaction, i.e. a pH of about 7. By equivalent to p-toluene sulfonic acid, we mean the amount of hardener required to give substantially the same curing time as the stated amount of p-toluene sulfonic acid. The most suitable amount for any given temperature and combination of resole and finely divided solid is readily determinable by simple experiment. Where the preferred temperature range is 25 to 75° C. and the resole has a reactivity number of at least 10, the best results are generally obtained with the use of hardener in amounts equivalent to 3 to 10 parts of p-toluene sulfonic acid per 100 parts by weight of the phenol/aldehyde reaction product. For use with temperatures below 25° C. or resoles having a reactivity number below 10, it may be necessary to use more hardener.

By suitable control of the temperature and of the hardener concentration, the time lapse between adding the hardener to the resole and the composition becoming hard (referred to herein as the curing time) can be varied at will from a few seconds to up to an hour or even more, without substantially affecting the density and cell structure of the product.

Another factor that controls the amount of hardener required can be the nature of the inert solid, where present. Very few are exactly neutral and if the solid has an alkaline reaction, even if only very slight, more hardener may be required because of the tendency of the filler to neutralize it. It is therefore to be understood that the preferred values for hardener concentration given above do not take into account any such effect of the solid. Any adjustment required because of the nature of the solid will depend on the amount of solid used and can be determined by simple experiment.

The exothermic curing reaction of the resole and acid hardener leads to the formation of by-products, particularly aldehyde and water, which are at least partially volatilised.

The curing reaction is effected in the presence of a finely divided inert and insoluble particulate solid which is substantially uniformly dispersed throughout the mixture of resole and hardener. By an inert solid we mean that in the quantity it is used it does not prevent the curing reaction.

It is believed that the finely divided particulate solid provides nuclei for the gas bubbles formed by the volatilisation of the small molecules, primarily formaldehyde and/or water, present in the resole and/or generated by the curing action, and provides sites at which bubble formation is promoted, thereby assisting uniformity of pore size. The presence of the finely divided solid may also promote stabilization of the individual bubbles and reduce the tendency of bubbles to agglomerate and eventually cause likelihood of bubble collapse prior to cure. To achieve the desired effect, the solid should be present in an amount of not less than 5% by weight based on the weight of the resole.

Any finely divided particulate solid that is insoluble in the reaction mixture is suitable, provided it is inert. Examples of suitable particulate solids are provided above.

Solids having more than a slightly alkaline reaction, e.g. silicates and carbonates of alkali metals, are preferably avoided because of their tendency to react with the acid hardener. Solids such as talc, however, which have a very mild alkaline reaction, in some cases because of contamination with more strongly alkaline materials such as magnesite, are acceptable.

Some materials, especially fibrous materials such as wood flour, can be absorbent and it may therefore be necessary to use generally larger amounts of these materials than non-fibrous materials, to achieve valuable foamed products.

The solids preferably have a particle size in the range 0.5 to 800 microns. If the particle size is too great, the cell structure of the foam tends to become undesirably coarse. On the other hand, at very small particle sizes, the foams obtained tend to be rather dense. The preferred range is 1 to 100 microns, most preferably 2 to 40 microns. Uniformity of cell structure appears to be encouraged by uniformity of particle size. Mixtures of solids may be used if desired.

If desired, solids such as finely divided metal powders may be included which contribute to the volume of gas or vapour generated during the process. If used alone, however, it be understood that the residues they leave after the gas by decomposition or chemical reaction satisfy the requirements of the inert and insoluble finely divided particulate solid required by the process of the invention.

Preferably, the finely divided solid has a density that is not greatly different from that of the resole, so as to reduce the possibility of the finely divided solid tending to accumulate towards the bottom of the mixture after mixing.

One preferred class of solids is the hydraulic cements, e.g. gypsum and plaster, but not Portland cement because of its alkalinity. These solids will tend to react with water present in the reaction mixture to produce a hardened skeletal structure within the cured resin product. Moreover, the reaction with the water is also exothermic and assists in the foaming and curing reaction. Foamed products obtained using these materials have particularly valuable physical properties. Moreover, when exposed to flame even for long periods of time they tend to char to a brick-like consistency that is still strong and capable of supporting loads. The products also have excellent thermal insulation and energy absorption properties. The preferred amount of inert particulate solid is from 20 to 200 parts by weight per 100 parts by weight of resole.

Another class of solids that is preferred because its use yields products having properties similar to those obtained using hydraulic cements comprises talc and fly ash. The preferred amounts of these solids are also 20 to 200 parts by weight per 100 parts by weight of resole.

For the above classes of solid, the most preferred range is 50 to 150 parts per 100 parts of resole.

In general, the maximum amount of solid that can be employed is controlled only by the physical problem of incorporating it into the mixture and handling the mixture. In general it is desired that the mixture is pourable but even at quite high solids concentrations, when the mixture is like a dough or paste and cannot be poured, foamed products with valuable properties can be obtained.

Other additives may be included in the foam-forming mixture; e.g. surfactants, such as anionic materials e.g. sodium salts of long chain alkyl benzene sulfonic acids, non-ionic materials such as those based on poly(ethylene-oxide) or copolymers thereof, and cationic materials such as long chain quaternary ammonium compounds or those based on polyacrylamides; viscosity modifiers such as alkyl cellulose especially methyl cellulose, and colorants such as dyes or pigments. Plasticisers for phenolic resins may also be included provided the curing and foaming reactions are not suppressed thereby, and polyfunctional compounds other than the dihydric compounds referred to above may be included which take part in the cross-linking reaction which occurs in curing; e.g. di- or poly-amines, di- or poly-isocyanates, di- or poly-carboxylic acids and aminoalcohols. Polymerisable unsaturated compounds may also be included possibly together with free-radical polymerisation initiators that are activated during the curing action e.g. acrylic monomers, so-called urethane acrylates, styrene, maleic acid and derivatives thereof, and mixtures thereof. The foam-forming compositions may also contain dehydrators, if desired.

Other resins may be included e.g. as prepolymers which are cured during the foaming and curing reaction or as powders, emulsions or dispersions. Examples are polyacetals such as polyvinyl acetals, vinyl polymers, olefin polymers, polyesters, acrylic polymers and styrene polymers, polyurethanes and prepolymers thereof and polyester prepolymers, as well as melamine resins, phenolic novolaks, etc. Conventional blowing agents may also be included to enhance the foaming reaction, e.g. low boiling organic compounds or compounds which decompose or react to produce gases.

The SMC may be prepared by applying a layer of a resin paste, for example a polyester resin paste, containing additives where appropriate, onto a bottom film carrier. Glass fibres as the reinforcement are then applied to the upper surface of the resin paste on the film carrier. A further layer of the resin paste is applied to sandwich the fibres between the layers of matrix. A top film is applied to the upper layer of the matrix. The resulting layered composition is subsequently compressed using a series of rollers to form a sheet of the sheet moulding compound between the film carriers. The material is rolled onto rollers and kept for at least 3 days at a regulated temperature of for example 23 to 27° C. The resulting SMC can be compression moulded with heat. The shelf life of the SMC before use is usually a few weeks.

Where the first insulating layer has one or more internal voids, the layer may be fabricated in a low-pressure environment, such that a partial vacuum is formed within the void, and/or in the presence of an inert gas.

Similarly, where the solid open-cell foam has an air-tight sealing coating, the air-tight sealing coating may optionally be provided in a low-pressure environment, such that a partial vacuum is formed within the air-tight sealing coating, and/or in the presence of an inert gas.

Alternatively, the air-tight sealing coating surrounding the internal void or the solid open-cell foam may be penetrated by a connector port, which may be connected to a vacuum source and/or a source of inert gas or other gas (e.g. fire retardant gas). The connector port is preferably sealable once a vacuum is formed within the air-tight sealing coating, or once the inert gas or other gas fills the solid open-cell foam within the air-tight sealing coating.

Where a vacuum is formed within the air-tight sealing coating, the connector port is preferably a one-way gas valve, such that an air tight seal is automatically formed following application of a vacuum. Alternatively, a two-way gas valve may be used so as to enable the internal void or the solid open-cell foam within the air-tight sealing coating to be repeatedly flushed and evacuated, for instance to enable an inter gas to be introduced into the internal void or foam.

Thus, the vacuum, inert gas or other material may be provided separately to individual panels fitted with connector ports (such as one-way gas valves in the case of a vacuum) during manufacture of the layered composite material panel. Alternatively, the vacuum, inert gas or other material may be provided separately to individual panels during installation of the panels, for instance in a building. As a further alternative, the vacuum, inert gas or other material may be provided to a number of panels at once. For instance, the connector ports of a plurality of panels may be connected in series or in parallel, preferably in parallel, to a vacuum source or a source of inert gas or other gas. The series or parallel connection between the connector ports of the plurality of panels may be removed once the vacuum or gas has been provided, or may be left in situ to enable subsequent replenishment of the vacuum or gas, e.g. where the air-tight sealing coating may be susceptible to gradual permeation of gases into and/or out of the solid open-cell foam or internal void.

In a further preferred embodiment, the composite material panels for use according to the invention are provided with means for monitoring the internal pressure of a panel or of a plurality of panels connected in series or in parallel. In this way, any gradual loss of partial vacuum in the internal voids or in the solid open-cell foam within the air-tight sealing coating can be monitored and the vacuum can be reapplied as required, for instance via a connector port, so as to maintain the thermal insulating properties of the panels.

In a further preferred embodiment, a vacuum source, such as a vacuum pump, may be associated with a panel or plurality of panels for use according to the invention so as to reapply the vaccum as required. In a further preferred embodiment, the vacuum source may also be associated with means for monitoring the internal pressure of a panel or plurality of panels, such that reapplication of the vacuum as required may be automated. In this regard, it is noted that the potential energy savings due to the thermal insulating properties of the composite material panels according to the invention far outweigh the cost of monitoring any loss of vacuum and reapplying the vacuum where necessary.

To improve the rigidity of the composite material panels of the invention, the composite material panels may be mounted in a frame or by frame members such as stiles, rails, and/or mullions. The frame members may be of wood, metal (for example, aluminium), or plastics (such as UPVC), or a combination of these.

In one embodiment, the composite material panels for use according to the invention may occupy substantially the entire volume or volume within the frame, such that frame members abut the edges of the composite material panels. In another embodiment, substantially the entire volume or volumes within the frame are occupied by the first insulating layer, and optionally one or more additional layers, and at least one further layer overlies substantially the entire surface of the frame and the layers contained therein. It will be appreciated that the use of frame members, particularly metal frame members, compromises the insulating capability of the layered composite materials of the invention. Thus, the use of frame members is ideally kept to the minimum necessary to obtain the necessary structural rigidity of the composite material panels of the invention.

The composite material panels for use according to the invention may be formed in a large surface area, or continuous configuration, and subsequently cut to the required size. However, unless the first insulating layer is sub-divided into a plurality of chambers, each chamber having an air-tight sealing coating, the effect of any inert gas or vacuum contained within the air-tight sealing coating is lost. Alternatively, the composite material panels may be custom fabricated with the required dimensions for a particular application.

In one embodiment, the composite materials for use according to the invention may be provided in the form of modular panels, wherein each panel is provided with interconnecting means to allow a series of panels to be interconnected. In a preferred embodiment, the interconnecting means is a tongue and groove arrangement.

Where the composite material comprises more than three layers, the tongue and groove arrangement may be obtained by offsetting one or more central layers relative to two or more outer layers. The offset may be linear or diagonal. Where the offset is linear, the composite material modular panels may be connected in a two-dimensional array. Where the offset is diagonal, the composite material modular panels may be connected in a three-dimensional array.

Alternatively, or where the composite material comprises fewer than three layers, the tongue and groove arrangement may be obtained by contouring the edges of the individual layers of the composite material. Where the tongue and groove arrangement is provided on two opposite edges of the composite material modular panels, the panels may be connected in a two-dimensional array. Where the tongue and groove arrangement is provided on all edges of the composite material modular panels, the panels may be connected in a three-dimensional array.

Where a tongue and groove arrangement is used, the tongue and/or groove portions may comprise means for maintaining the integrity of the tongue and groove joint. For example, the tongue and/or groove portions may be provided with a gripping surface, such as a rubberised coating. Alternatively, the tongue and/or groove portions may be provided with a contact adhesive.

In a first aspect, the present invention provides the use of a composite material panel in a modular building as herein described, wherein the composite material panel comprises: (i) a metal surface having a powder coating; and (ii) an insulating layer comprising a solid open-cell phenolic resin foam.

As used herein, the term powder coating refers to a coating that is applied to the metal surface as a free-flowing dry powder then cured under heating and optionally pressure to form a flowable material which forms a skin on the metal surface. The powder may be a thermoplastic or thermosetting polymer and generally forms a hard finish which is tougher than conventional paint coatings. Such coatings and methods for their application are well-known to persons of skill in the art.

The metal used to make the metal surface is not particularly limited, and examples include aluminium and steel. In many applications a lightweight metal is desirable, in which case aluminium may be preferred.

The phenolic resin is preferably as described above, and is preferably formed in accordance with the methods described above. Preferably the phenolic resin is devoid of an air-tight sealing coating.

One advantage of using the composite structures of the invention is that the powder coating may be applied and cured with the insulating layer in situ without impairing the structure or the insulating properties of the solid open-cell phenolic resin foam insulating layer. In prior art composite structures, the insulating materials cannot withstand the temperatures and pressures required to cure the powder coating. Accordingly, such structures must be assembled in a stepwise manner in which the powder coating is first applied to the metal surface and cured in the absence of the insulating materials. The insulating materials are subsequently incorporated into the composite structures in a subsequent step, adding complexity to the construction process.

Thus, in accordance with this aspect of the invention, a panel is provided having at least one powder coated metal surface and an insulating layer of a solid open-cell phenolic resin foam provided in a cavity within the panel as an insulating layer. For example, the panel may be constructed from a frame and a metal skin covering the two major faces of the frame so as to form the panel surfaces, wherein the solid open-cell phenolic resin foam is located in one or more voids between the frame and the metal skin as an insulating layer.

The powder coating may be applied to the metal surface of the panel with the phenolic resin foam in situ without impairing the structure or insulating properties of the insulating layer.

Preferably, the powder coating is cured at a temperature in the range of from 100 to 250° C., more preferably 120 to 220° C.

According to another aspect of the invention, there is provided the method of assembling a modular building comprising the steps of: (a) erecting a double sloping roof panel; (b) erecting a subsequent double sloping roof panel adjacent the previous double sloping roof panel; (c) repeating steps (a) and (b) until all the double sloping roof panels have been erected in an array; and (d) connecting all adjacent double sloping edges to form a double sloping roof.

Preferably, the method comprises a step (e) of erecting the pair of mutually spaced triangular end walls.

Preferably, the method comprises a step (f) of equipping the end wall panels with a window or a door.

Preferably, the method comprises a step (g) of equipping the double sloping roof panels with a window or a door.

Preferably, the method comprises a step (h) of equipping the double sloping roof panels with a dormer formed by at least one dormer panel comprising composite panel material.

Preferably, the method comprises a step (i) of equipping the modular building with at least one cross member spanning the double sloping roof panels.

Preferably, the method comprises a first step (j) preceding all other steps of founding the modular building upon at least one cross member spanning lower edges of the double sloping roof. A cross member spanning the lower edges provides a base support and a foundation for the modular building which is laid before the double sloping roof panes are erected.

Preferably, the method comprises a step (k) of connecting adjacent sloping roof panels with at least one cross member.

Preferably, the method comprises a step (l) of sealing the edges of adjacent double sloping edges with a bead in between steps (a) and (b).

Preferably, the method comprises a step (m) of providing at least one floor panel made of composite panel material.

Preferably, the method comprises a step (n) of providing an aperture in the at least one floor panel for a stairway.

Preferably, the method comprises a step (o) of providing at least one elongate cross bar in support of the floor panel.

Preferably, the method comprises a step (p) of providing a double sloping roof panel with a frame clad with the composite panel material.

Preferably, the method comprises a step (q) of interposing shock absorbent material between the frame and the composite panel material.

Preferably, the method comprises a step (r) of unfolding the double sloping roof panels to the appropriate angle.

Preferably, the method comprises a step (s) of providing a frame of each inclined section with a pair of elongate parallel side bars.

Preferably, the method comprises a step (t) of capping the ridge with composite panel material.

According to another aspect of the present invention there is provided a modular building village, comprising a plurality of modular buildings, wherein neighbouring modular buildings are coupled by elevated walkway.

Preferably, the elevated walkway is supported by a column founded upon the ground.

Referring to FIG. 1, there is shown a modular building 2 founded upon solid ground 4. The modular building comprises double sloping roof 6 saddled on a pair of mutually spaced triangular end walls 8. Both sides of the double sloping roof are inclined at generally the same angle with respect to the ground such that the end walls are the shape of an isosceles triangle. It will be appreciated that other types of triangular shape could also be used, for example, equilateral. The triangular end walls are generally upright with respect to the ground.

The double sloping roof 6 is formed by an array of double sloping roof panels 10 adjoining at adjacent double sloping edges. The triangular end walls 8 are equipped with windows 14 or a door 16. Some of the double sloping roof panels are equipped with a window 14 or a door 16. The door 16 is housed in a dormer 18 protruding from the one side of a sloping roof panel 10. The dormer is construed from dormer panels 20. A window may be housed in a dormer, although that is not shown in FIG. 1. Otherwise, the double sloping roof panels are generally identical in shape and size. The building is described as modular because the double sloping roof panels are interchangeable so that the double sloping roof can have as many, or as few, double sloping roof panels as is necessary. The modular building shown in FIG. 1 has four double sloping roof panels 10.

Figure 2:
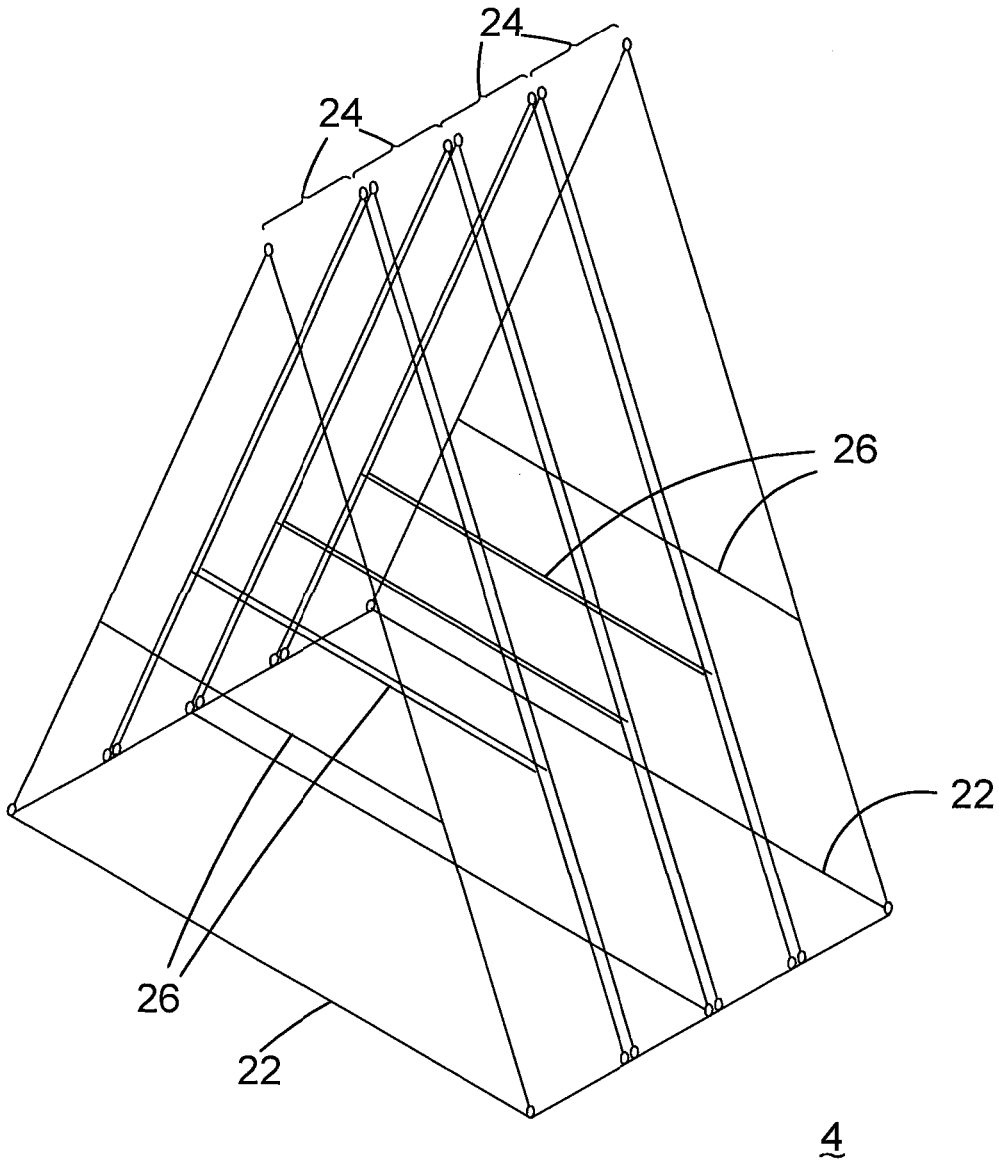
FIG. 2 is a diagrammatic perspective view of cross members and frames inside the modular building of FIG. 1.

Referring to FIG. 2, the modular building comprises two lower cross members 22, four double sloping roof frames 24 and four upper cross members 26. Each lower cross member comprises a rectangular metal cross frame 22 arranged to lie flat upon the ground. Preparation, like excavating, or flattening, the ground is unnecessary for all but the roughest surface. The cross frame is the width of two double sloping roof panels 10. The cross frames are bolted together. Two double sloping roof frames stand upon each cross frame. Each upper cross member comprises a pair of elongate cross bars 26 spanning a respective double sloping roof frame. This is described in more detail below.

Figure 3:
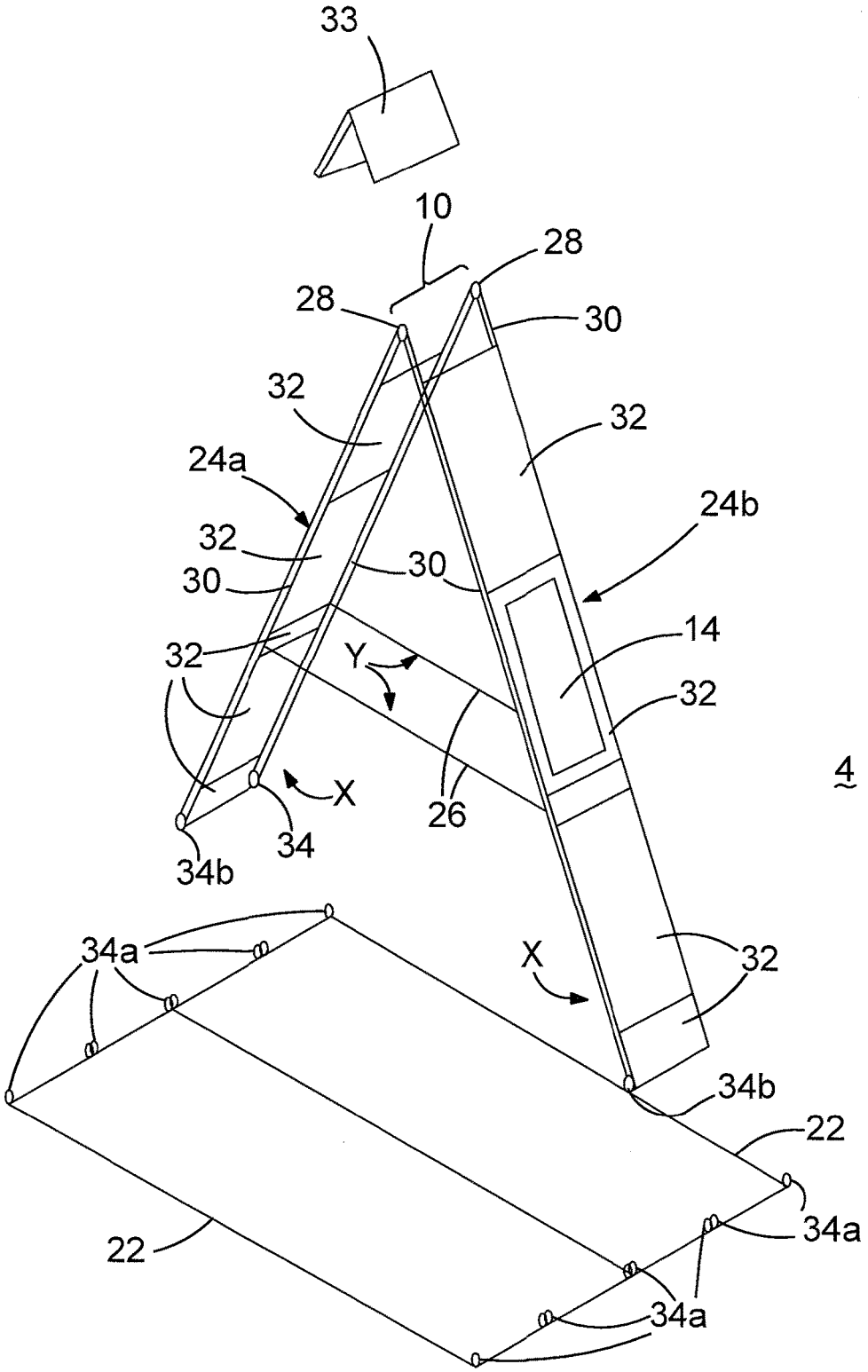
FIG. 3 is a diagrammatic exploded view of an early state of assembly of the modular building of FIG. 1.

Referring to FIG. 3, an early stage of assembling the modular building is shown diagrammatically. Two cross frame 22 are connected to each other. The cross frames lie upon ground in preparation for erection of the first double sloping roof panel 10.

The double sloping roof frame 24 is articulated in two sections 24*a*, 24*b* at a ridge joint 28 located at the apex of the double sloping roof panel 10. Each double sloping roof frame section has two parallel elongate side bars 30 running downwardly from the ridge joint.

A cross bar 26 is pivotally connected to each of a pair of side bars 30 part way along the length of the side bars. In the example shown, the pair of cross bars is pivotally connected to side bars belonging to section 24*b* of the double sloping roof frame, but they could easily be pivotally connected to the side bars of the other section 24*a*, or pivotally connected to one side bar of each section 24*a*, 24*b*.

The double sloping roof panel 10 is prefabricated in a factory. The side bars 30 of the double sloping roof frame 24 are clad in roof panel pieces 30. Preferably, modular building 2 and its component parts may be transported flat packed in a container or on the back of a truck. In that case, all but the portion of the side bars 30 nearest the ridge joint 28 is clad in roof panel pieces 32 in the factory so the sloping roof panel may be folded flat at the ridge joint 28. Roof panel pieces can be exchanged, or added, on site. One of the roof panel pieces 32 shown in FIG. 3 is equipped with a window 14.

The two sections 24*a*, 24*b* of the double sloping roof frame 24 are folded apart, in the direction of arrows X, and the cross bars 26 are folded downward, in the direction of arrows Y, until they are connected to, and span, both sections 24*a*, 24*b* of the double sloping roof frame 24. The elongate bars provide lateral rigidity to the double sloping roof frames and help prevent the two sections 24*a*, 24*b* from bowing inwardly. The double sloping roof frame is ready for connection to one of the cross frames 22.

Feet of the side bars 30 preferably have eyelets 34*b* for alignment with corresponding eyelets 34*a* on the cross frame. When the double sloping roof frame is to be connected to the cross frame 22, as shown in FIG. 2, the eyelets 34*b* of one section of the double sloping roof panel 24 are aligned with corresponding eyelets 34*a* on the cross frame 22 and connected by partially threaded pins, as is explained in more detail below. The double sloping roof frame is pivotable about the already-connected eyelets to align eyelets 34*b* of the other section of the double sloping roof panel 24 with corresponding eyelets 34*a* on the other side of the cross frame 22. The remaining eyelets are connected by pins to hold the double sloping roof frame firmly upon the cross frame. This is assembly process is repeated until all the double sloping roof frames are connected to the cross frames. The pivotal movement at the feet of the side bars simplifies assembly of the modular building and makes it easier.

A fully-unfolded double sloping roof panel 10 may be lowered upon, and connected to, the cross frames 22 by crane, if available. However, this is not an essential requirement. Instead, one of the double sloping roof frame sections may be pivotally connected to the cross frame. This steadies the already-connected section against lateral movement. Also, it guides subsequent movement of the unconnected other double sloping roof frame section. The other section may be unfolded and pivoted about the cross frame in stages and connected thereto.

Each double sloping roof frame is clad with a respective ridge panel 33 upon the ridge joint 28. This is done on site when the double sloping roof frames 24 have been erected upon the cross frames 22. Each triangular end wall 8 is clad with end wall panels 40, as is explained in more detail below.

Figure 4:
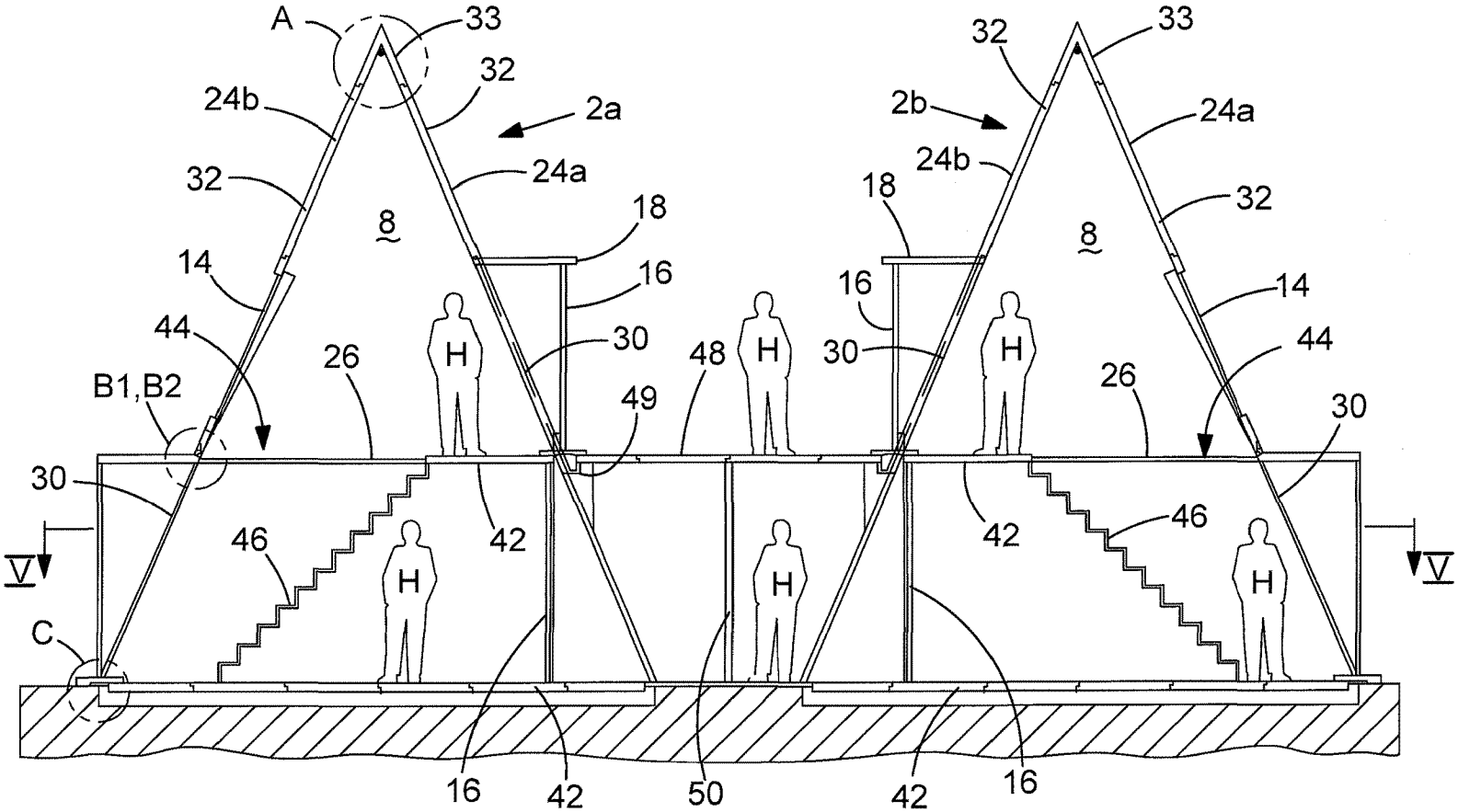
FIG. 4 is a cross-sectional view IV-IV of two alternative embodiment modular buildings connected by an elevated walkway.
Figure 5:
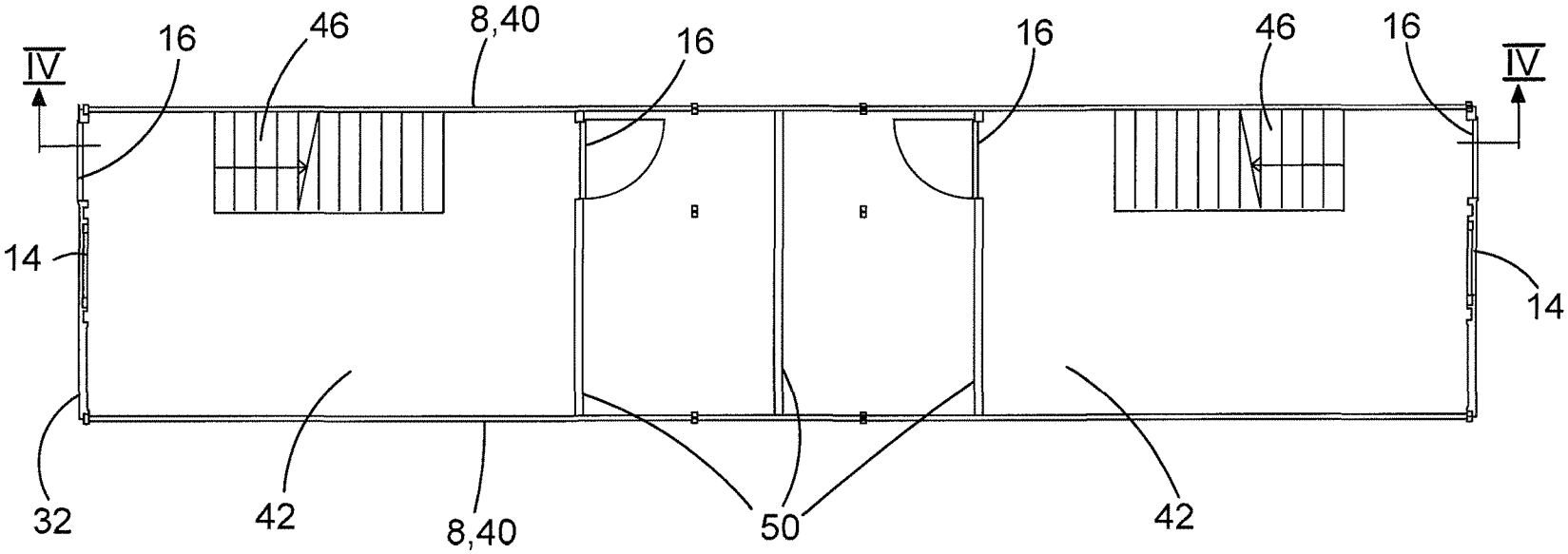
FIG. 5 is a cross sectional view V-V of the modular buildings of FIG. 4.

Referring to FIGS. 4 and 5, there are shown two modular buildings 2*a*, 2*b* each with a different layout of windows 14, doors 16 and dormers 18 in comparison with the modular building 2 shown in FIG. 1. The modular buildings 2*a*, 2*b* have an array of three double sloping roof panels 10. The triangular end walls 8 are generally parallel.

The cross frame 22 is clad with floor panels 42 to form a ground floor. Each pair of cross bars 26 is clad with floor panels 42 to form a first floor. The first floor panels are arranged about an aperture 44 for a stairway 46 leading from the ground floor to the first floor. There is ample space between ground and first floors, and above first floor, for accommodation, as is illustrated by human silhouettes H.

A double sloping roof panel section 24*a*, 24*b* of each modular building 2*a*, 2*b* is equipped with a door 16, preferably housed in a dormer 18, and which may be at first floor level. In the disclosed embodiment, the doors face each other. The two modular buildings are arranged with an elevated walkway 48 between the doors. The elevated walkway comprises a continuation of the pairs of elongate cross bars 26 clad with floor panels 42. The elevated walkway's pairs of cross bars 26 are connected to a pair of side bars 30 at the same location as the pairs of cross bars spanning the double sloping roof frame. This ensures that the elevated walkway is at first floor level. It will be appreciated that suitable drain means are envisaged so as to prevent flooding of the walkway, for example, by the use of channels 49 located at the edges of the walkway 48.

Roof panel pieces 32 may be removed from the double sloping roof frame sections 24*a*, 24*b* immediately below the elevated walkway 48 to create ground floor accommodation. The roof panel pieces 32 may be re-employed, or fresh panel pieces used, as partition panels 50 dividing the rooms. The partition panels are connected to the walkway's cross bars 26, the cross frames 22 or adjacent end wall panels 40 in an upright position. Two of the partition panels shown in FIGS. 4 and 5 are equipped with an internal door 16. The elevated walkway 48 can be supported by an upright bar (not shown) if additional load-bearing structural support is needed.

Figure 6:
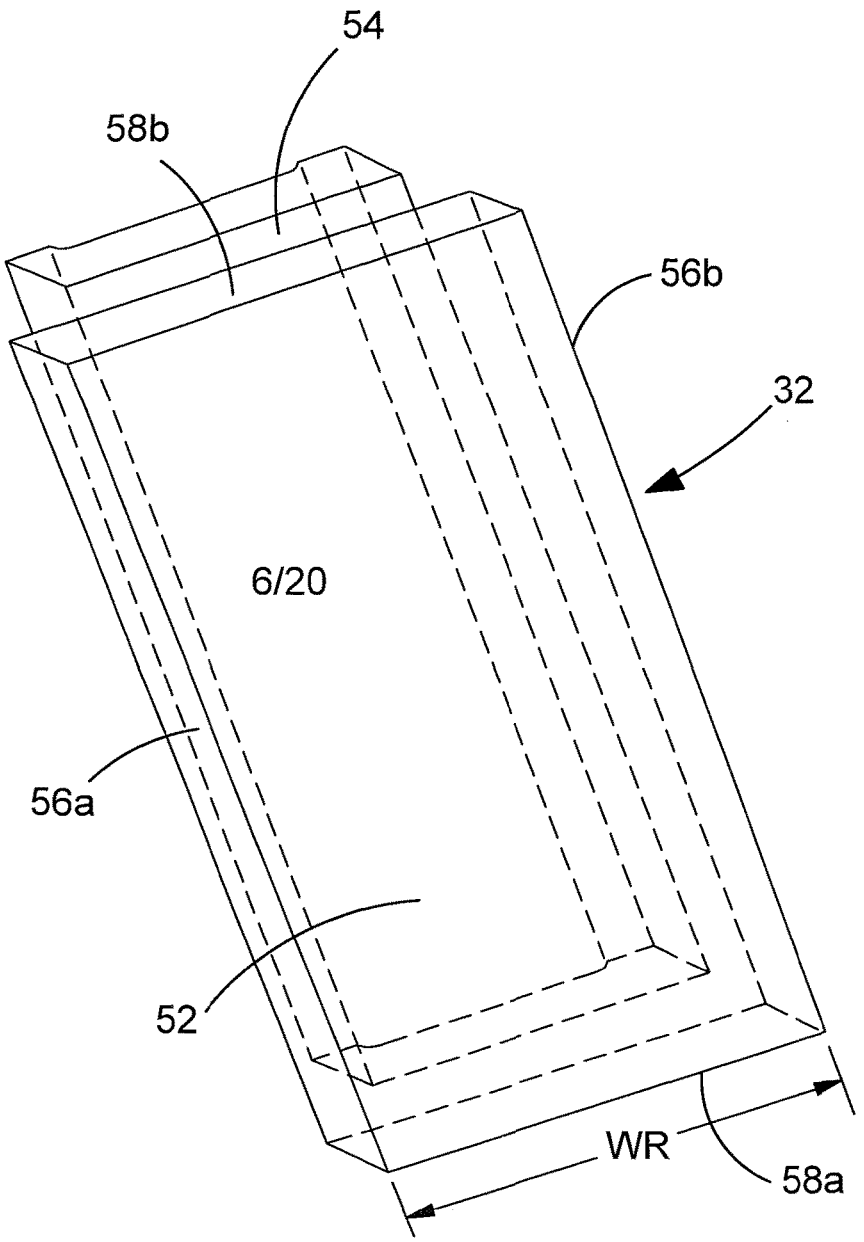
FIG. 6 is a perspective view of a piece of a double sloping roof panel.

Referring to FIG. 6, there is shown a generally rectangular roof panel piece 32 having a front face 52 and a back face 54 integral with the font face. The front face 52 overlaps the back face 54 along both long sides 56*a*, 56*b* and along one short side 58*a*. The back face 54 overlaps the front face 52 along the majority of the other short side 58*b*. The long side length may vary depending on the purpose of the roof panel piece (i.e. equipped with window or door). The short side width WR remains constant to fit over and between parallel side bars 30 of a double sloping roof frame 24.

Figure 14:
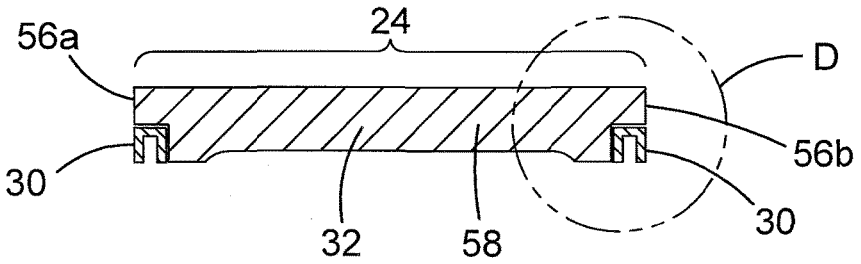
FIG. 14 is a horizontal cross section of a roof panel piece upon a double sloping roof frame.
Figure 15:
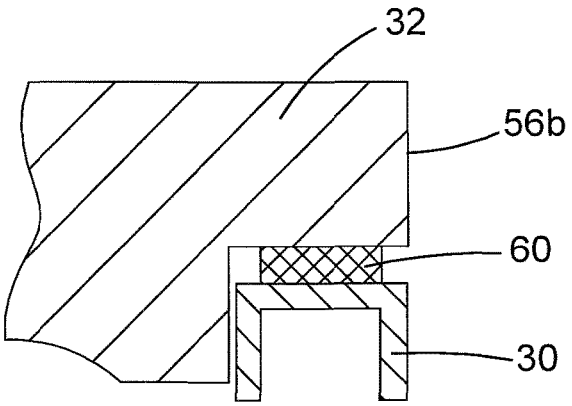
FIG. 15 is a horizontal cross section of detail D of FIG. 14.
Figure 16:
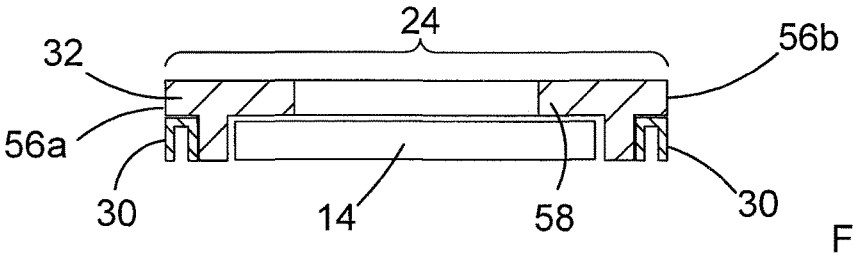
FIG. 16 is a vertical cross section of a roof panel piece equipped with a door or a window.

Referring to FIGS. 14 to 16, there is shown a double sloping roof frame 24 clad with a roof panel piece 32 connected to side bars 30. The side bars are nested in rebates along the long sides 56*a*, 56*b* behind where the front face 52 overlaps the back face 54. The short side 58 of the roof panel piece spans the side bars.

Referring in particular to FIG. 15, roof panel pieces 32 and side bars 30 are preferably interposed by shock absorbent material 60 to absorb any external impact experienced by the roof panels. The shock absorbent material may be formed from resilient materials such as, for example, rubber based materials, so as to form resilient joints or frangible materials, which may 'crush' under pressure. Routine maintenance can be done easily by removal of a roof panel piece for access to, and replacement of, the shock absorbent material.

Returning to FIG. 4, it can be seen that adjacent roof panel pieces 32 abut each other along their short sides 58. The front face 52 of one roof panel piece 32 overlaps the back face 54 of the adjacent roof panel piece 32.

Figure 7:
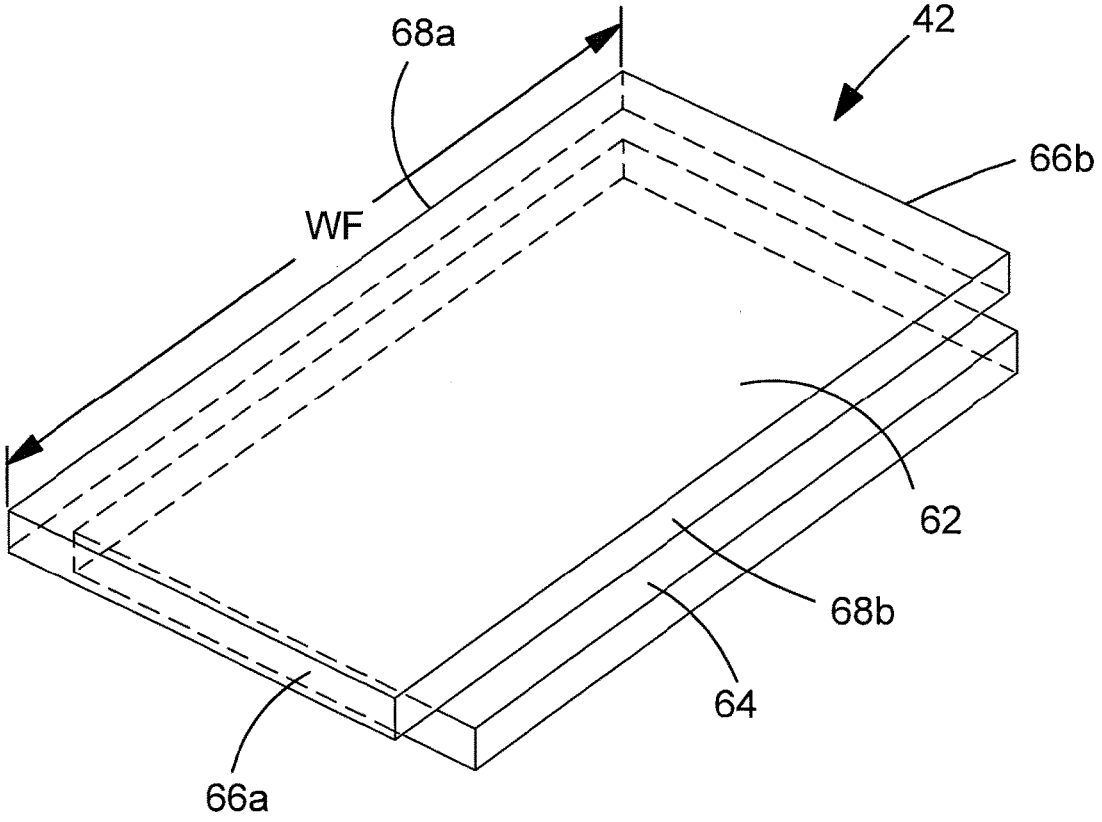
FIG. 7 is a perspective view of a floor panel.

Referring to FIG. 7, there is shown a generally rectangular floor panel 42 having a front face 62 and a back face 64 integral with the font face. The front face 62 overlaps the back face 64 along both short sides 66*a*, 66*b* and along one long side 68*a*. The back face 64 overlaps the front face 62 along the majority of the other long side 68*b*. The short side length may vary depending on the purpose of the floor panel. The long side width WF remains constant to fit over and between a pair of parallel cross bars 26 of a double sloping roof frame 24 or over and between the long sides of the rectangular cross frame 22.

Figure 13:
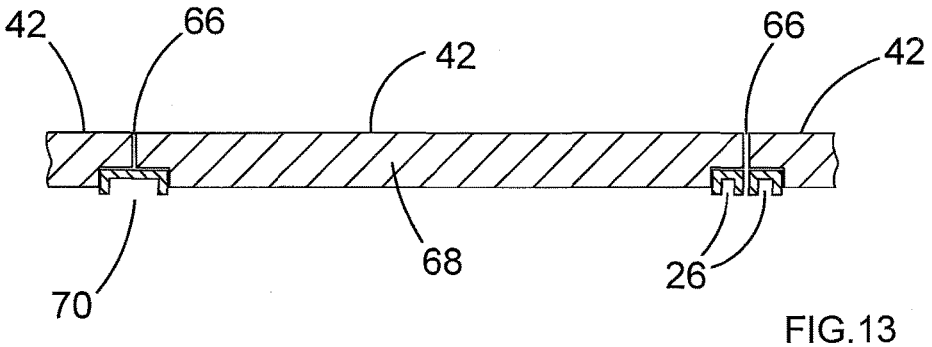
FIG. 13 is a vertical cross section of a floor panel upon an upper cross member.

Referring to FIG. 13, there is shown parallel cross bars 26 clad with floor panels 42. The floor panels 42 may be fastened to the cross bars 26 or they may rest, under gravitational force, upon the cross bars. The left side of FIG. 13 shows a situation where the upper cross member 26 of a double sloping roof panel 10 is a double width cross bar 70, which is discussed in more detail below. Half of cross bar 70 is nested in a rebate along the short side 66*a* of the floor panel behind where the front face 62 overlaps the back face 64. The other half of cross bar 70 is nested in a rebate along short side 66*b* of adjacent floor panel behind where the front face 62 overlaps the back face 64. The right side of FIG. 13 shows a situation where the upper cross member 26 of a double sloping roof panel 10 is a pair of single width cross bars 26 each spanning two of the four side bars 30. All of cross bar 26 is nested in a rebate along the short side 66*a* of the floor panel behind where the front face 62 overlaps the back face 64. The adjacent floor panel 42 is supported by its own cross bar 26. The long side 68 of the floor panel spans the side bars 26, 70.

Returning to FIG. 4, adjacent floor panels 42 abut each other along the long side 68. The front face 62 of one floor panel 42 overlaps the back face 64 of the adjacent floor panel 42.

Figure 9:
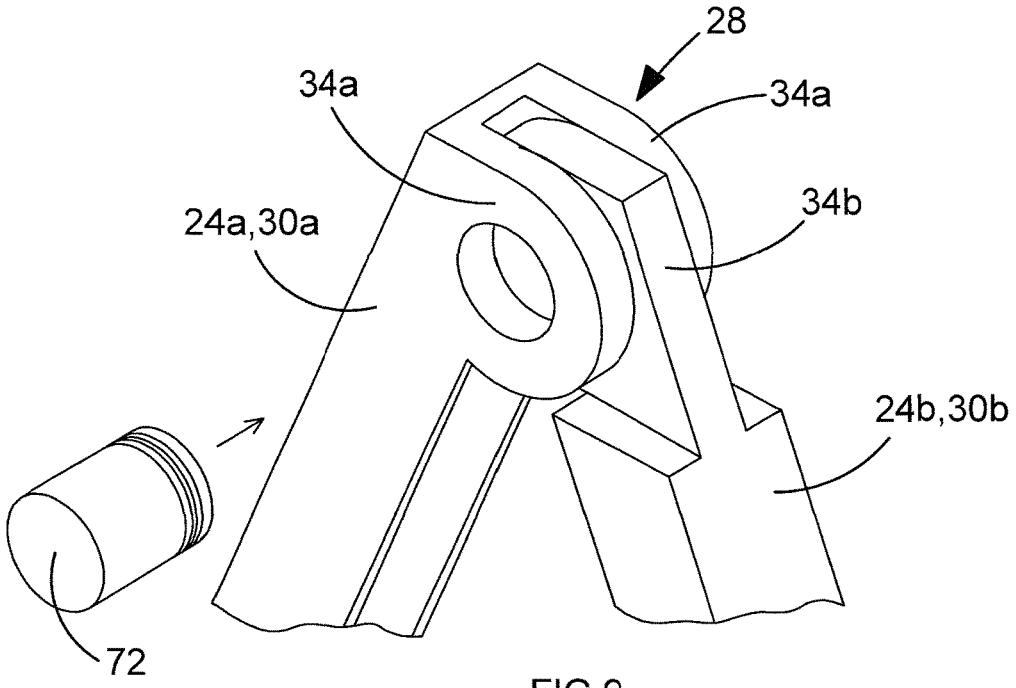
FIG. 9 is an exploded perspective view of detail A of FIG. 4.

Referring to FIG. 9, there is shown detail A in FIG. 4 of part of a ridge joint 28 of a double sloping roof frame 24 where a side bar 30*a* of one section 24*a* meets a side bar 30*b* of another section 24*b*. The side bar 30*a* has double eyelet 34*a*. The side bar 30*b* has a single eyelet 34*b* arranged between the double eyelet 34*a*. An axis of the eyelets, the form of a partially threaded pin 72, threadingly engages the far side of the double eyelet 34*a* only. The two sections of the double sloping roof frame are articulated about the axis 72 (i.e. the pin) of the ridge joint 28. The eyelets 34*a*, 34*b* and pin 72 arrangement provides a simple and easily constructed hinge between the sections 24*a*, 24*b* of the double sloping roof frame.

Figure 10:
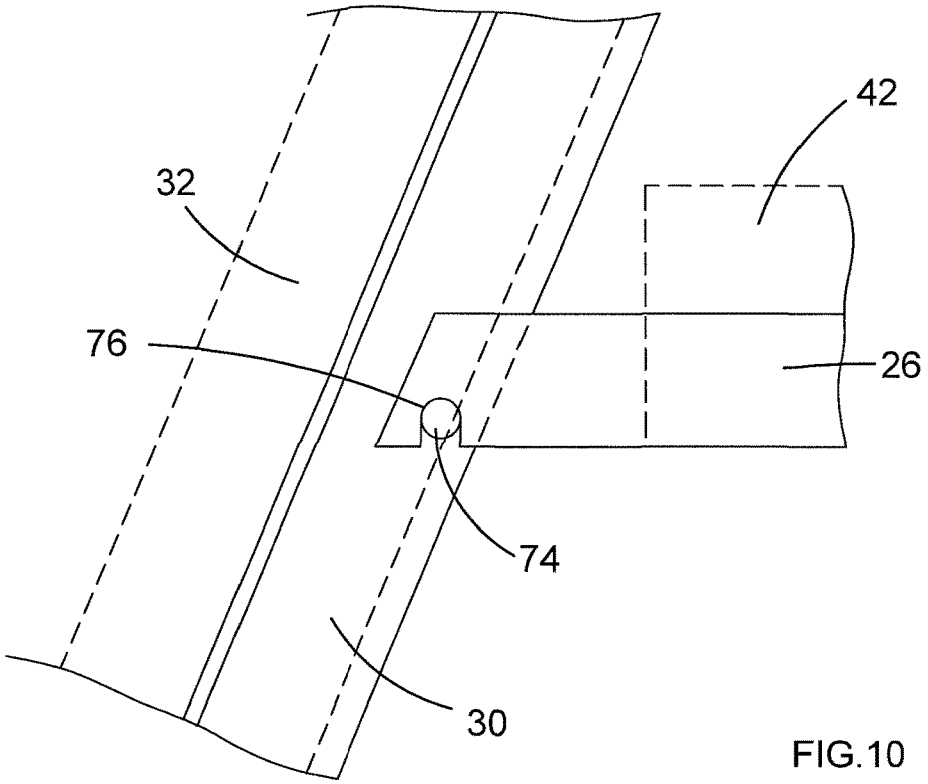
FIG. 10 is side elevation view of detail B1 of FIG. 4.

Referring to FIG. 10, there is shown detail B1 in FIG. 4 of a connection between a cross bar 26 of an upper cross member and a side bar 30 of a double sloping roof panel 10. The connection comprises a dowel 74 in the side bar and a rebate 76 under the cross bar. The dowel 74 is arranged generally horizontal. The rebate is hooked over the dowel which supports the cross bar and any floor panels 42. The connection can be assembled and disassembled quickly and without any tools. The connection is pivotable about the dowel.

Figure 11:
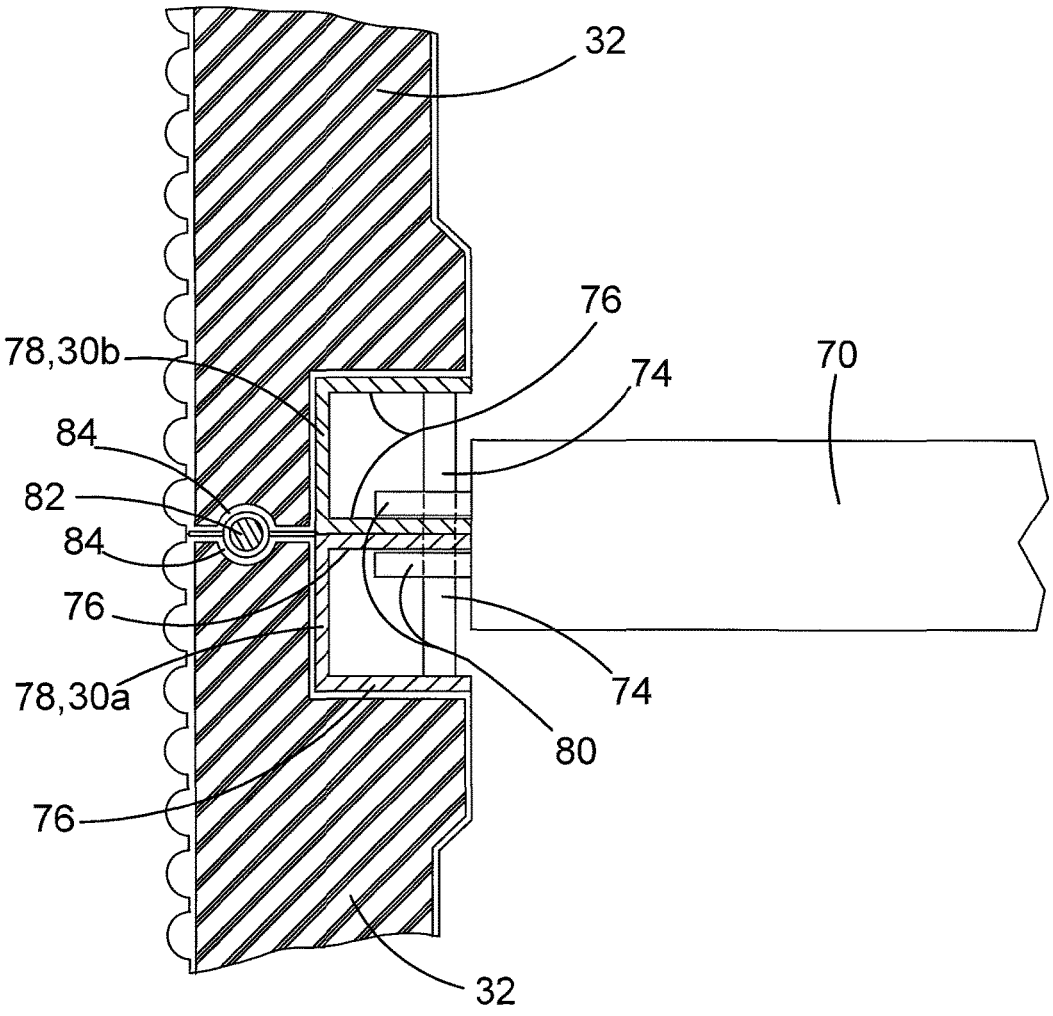
FIG. 11 is plan view in partial section of detail B2 in FIG. 4.

Referring to FIG. 11, there is shown detail B2 in FIG. 4 of a connection between a double width cross bar 70 of an upper cross member and two side bars 30*a*, 30*b* of adjacent double sloping roof panel frames 24. The side bars are both C-shaped in horizontal cross-section with a pair of parallel edges 76 and a back edge 78. Each side bar has a dowel 74 spanning its parallel edges 76. The double cross bar 70 has pair of fingers 80 each with a rebate 76 underneath. The dowel 74 is arranged generally horizontal. The rebates are hooked over the dowels which support the double cross bar 70 and any floor panels. Concurrently, abutting edges 76 of adjacent side bars 30*a*, 30*b* are gripped between the fingers 80 to connect the adjacent double sloping roof panels. The connection can be assembled and disassembled without any tools. The connection is pivotable about the dowel.

Adjacent double sloping roof panels 10 are sealed with a bead 82 located in a pair of facing grooves 84 in adjacent roof panel pieces 32.

Figure 12:
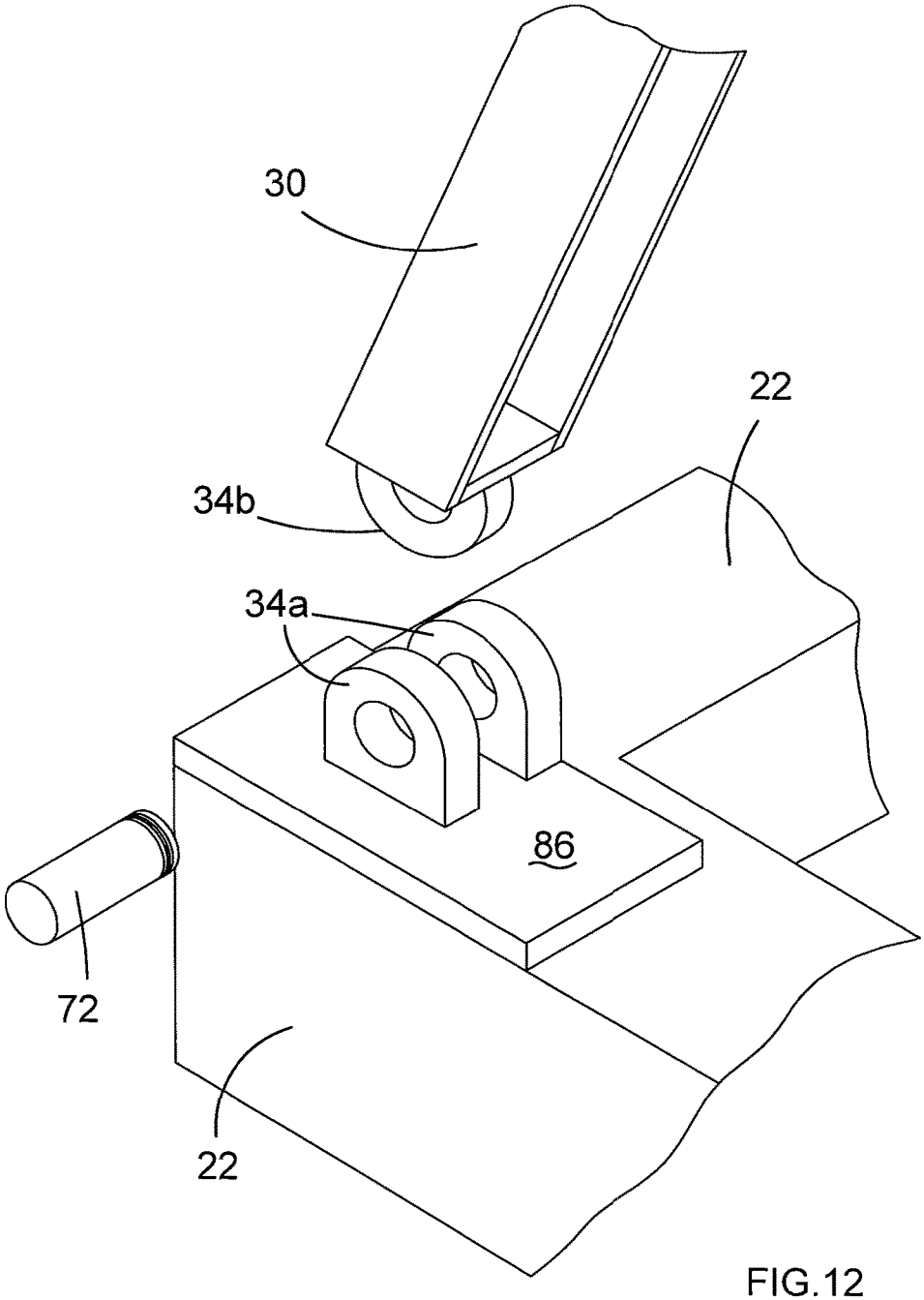
FIG. 12 is an exploded perspective view of detail C of FIG. 4.

Referring to FIG. 12, there is shown detail C in FIG. 4 of a connection between a rectangular cross frame 22 of a lower cross member and a foot of a side bar 30. The cross frame 22 has a double eyelet 30*a* protruding from a plate 86 arranged upon the cross frame. The side bar 30 has a single eyelet 34*b* arranged between the double eyelet 34*a*. An axis of the eyelets, the form of a partially threaded pin 72, threadingly engages the far side of the double eyelet 34*a* only. The side bar is pivotable about the axis 72 (i.e. the pin). The eyelets 34*a*, 34*b* and pin 72 arrangement provides a simple and easily constructed hinge between the side bars 30 and the cross frame 22.

The partially threaded pins 72 of the ridge joint 28 are interchangeable with the partially threaded pins 72 of the double eyelet plate 86.

Figure 8:
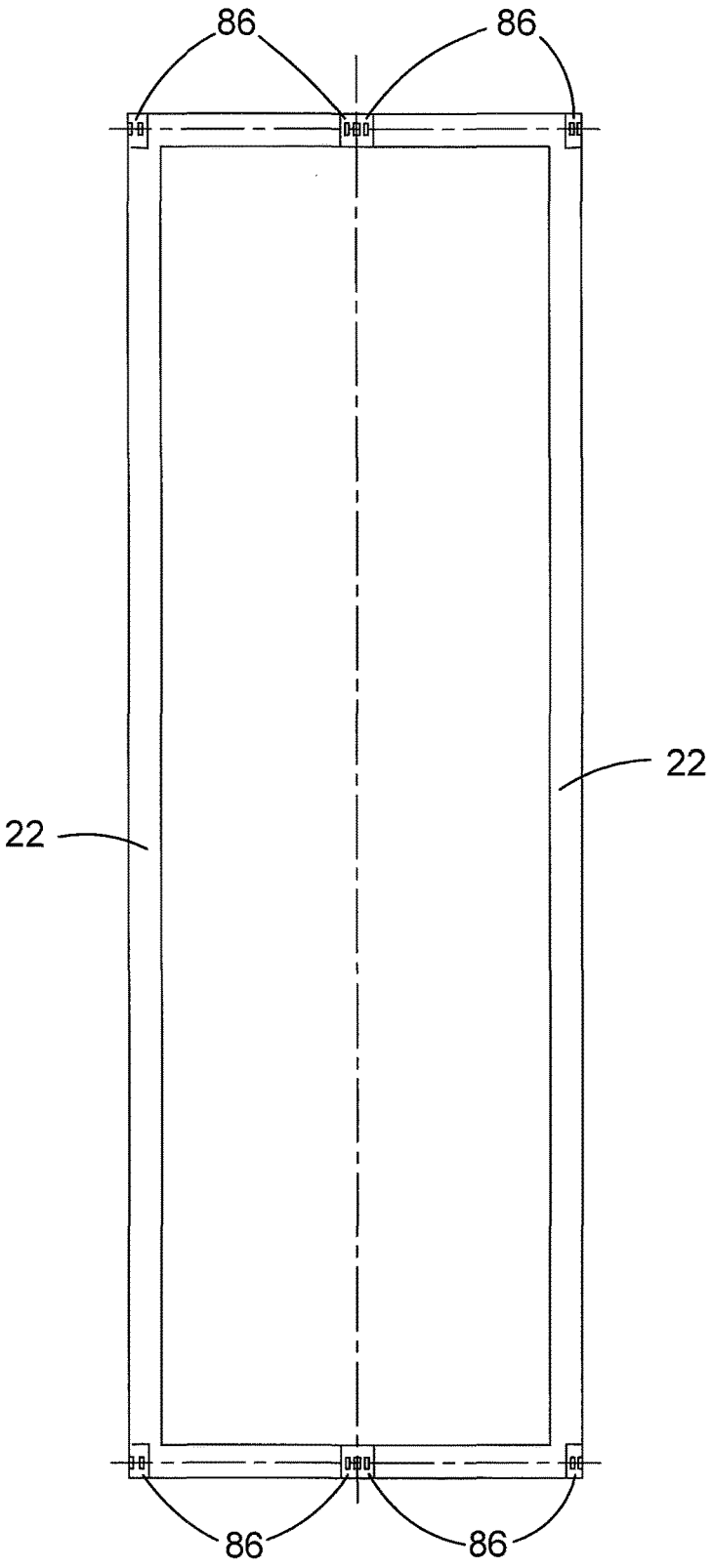
FIG. 8 is a plan view of a lower cross member.

Referring to FIG. 8, the cross frame 22 has a plate 86 with a double eyelet 30*a* at each corner and two such plates 86 at the midpoint of a short side. The cross frame shown is connectable with two adjacent double sloping roof frames.

The roof panel pieces 10, the dormer panels 20, the ridge panels 40, the end wall panels 40, the floor panels 42 and the partition panels 50 comprise composite panel material. Examples of the composite panel material are described below, as are its particular features and advantages.

Energy Absorbing Composite Examples

Figure 17:
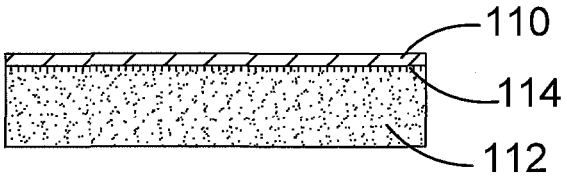
FIGS. 17 to 21 show a schematic cross-sectional view of various embodiments of the layered composite panels of the invention (not drawn to scale).

In FIG. 17, a layered composite panel is shown having a first surface layer of a sheet form polymeric material (110) bonded to a first solid open-cell foam panel (112), wherein a cured polymeric material (114) penetrates a surface of the first solid open-cell foam panel (112).

Figure 18:
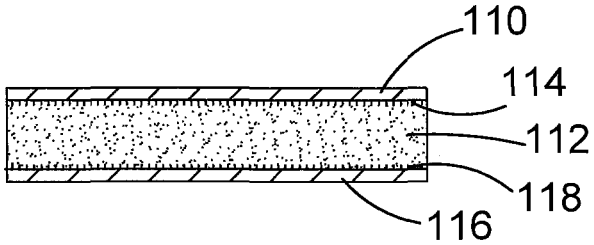

In FIG. 18, a second surface layer of a sheet form polymeric material (116) is also bonded to the first solid open-cell foam panel. Again, a cured polymeric material (118) penetrates a surface of the first solid open-cell foam panel (112).

Figure 19:
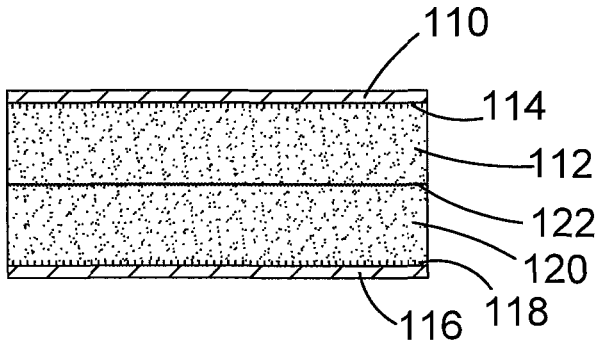

In FIG. 19, the core comprises first and second solid open-cell foam panels (112, 120) respectively bonded to first and second surface layers of sheet form polymeric material (110, 116). A cured polymeric material (114, 118) penetrates a surface of each of the first and second solid open-cell foam panels (112, 120), and an elastomeric adhesive (122) bonds the first and second solid open-cell foam panels together. As shown, the elastomeric adhesive penetrates a portion of each of the first and second solid open-cell foam panels.

Figure 20:
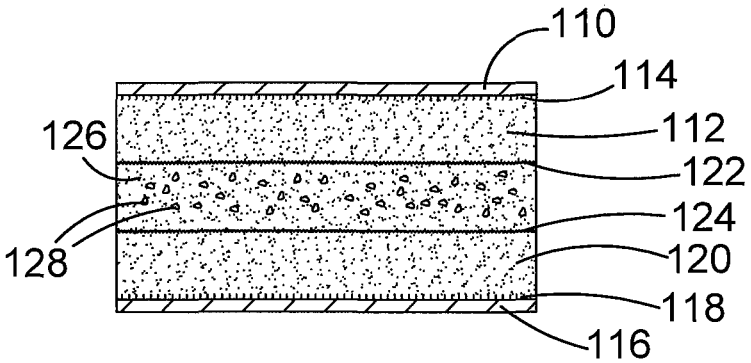

In FIG. 20, a third solid open-cell foam panel (126) is provided between the first and second solid open-cell foam panels (112, 120). An elastomeric adhesive (122, 124) bonds the first, second and third solid open-cell foam panels together, and penetrates a portion of each of the foam panels. As shown, the third solid open-cell foam panel comprises chips (128) of stone, ceramic, glass or other aggregate materials embedded in the solid open-cell foam matrix.

Figure 21:
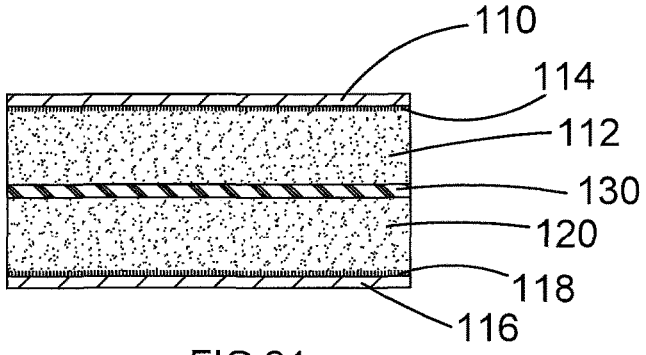

In FIG. 21, a reinforcing panel (130), such as a glass-reinforced plastics material, is provided between the first and second solid open-cell foam panels (112, 120).

Figure 22A:
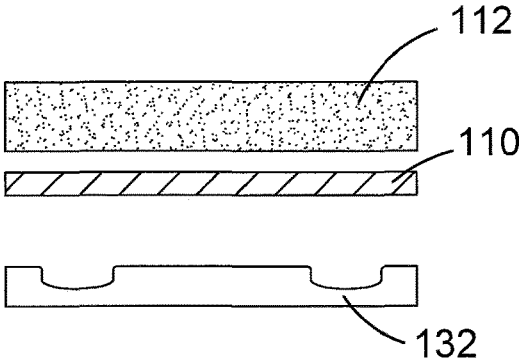
FIG. 22A shows schematically in cross-sectional exploded view the moulding of a layered composite panel of the invention having a profiled surface (not drawn to scale).
Figure 22B:
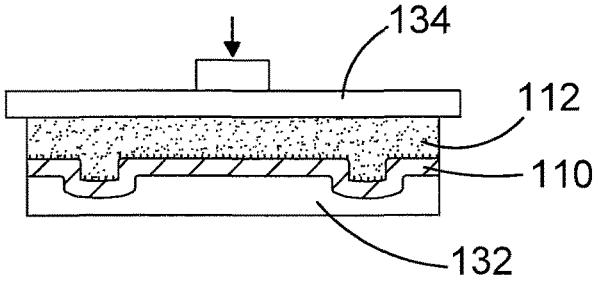
FIG. 22B shows schematically in cross-sectional view the moulding of a layered composite panel of the invention having a profiled surface (not drawn to scale).
Figure 22C:
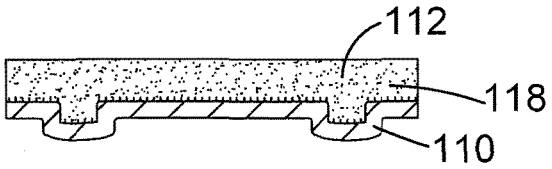
FIG. 22C shows schematically in cross-sectional view a moulded layered composite panel of the invention having a profiled surface (not drawn to scale).

As shown in FIGS. 22A to 22C, a profiled surface of the layered composite panels of the invention may be formed by a moulding process.

Thus, a layer of sheet form polymeric material (110), preferably SMC, is applied to the upper surface of a mould (132). The sheet-form polymeric material (110) is preferably sized so as to extend across the whole of the mould surface. Onto the sheet form polymeric material (110) is applied a solid open-cell foam panel (112). The foam used is advantageously:

- structural and has load bearing properties;
- frangible and can be formed under pressure;
- inelastic, such that it substantially retains its pressed form; and
- open cell such that gases may escape from the foam matrix during pressing and such that curable materials in the sheet form polymeric material can migrate into the open cells of the foam so as to form a strong bond between the sheet form polymeric material and the foam.

Downward pressure is applied to the components as shown in FIG. 22B using a pressure plate (134). Preferably, the layers are also heated. The foam layer (112) is pressed toward the lower mould surface (132), crushing the foam and moulding the lower surface of the foam (112) to the shape of the mould surface (132). The sheet form polymeric material (110) is also pressed between the mould surface (132) and the foam layer (112). Preferably, the sheet form polymeric material is heated so as to cure the polymeric material.

Air and other gases trapped between the sheet form polymeric material (110) and the foam layer (112) pass through the open cell structure of the foam. The components are held in the mould with the application of pressure and heat for a sufficient time for the formation of a bond between the layers, e.g. the curing time of the SMC. The resulting product is then removed from the mould as shown in FIG. 22C, and may subsequently be bonded to a first insulating layer as described above.

Figure 23A:
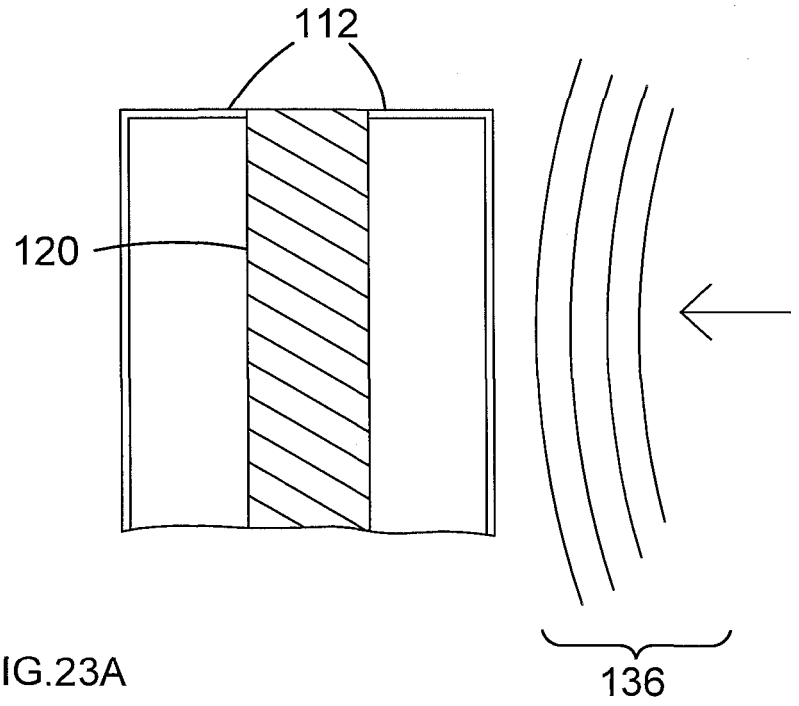
FIG. 23A shows schematically in cross-sectional view a layered composite panel of the invention before impact (not drawn to scale).
Figure 23B:
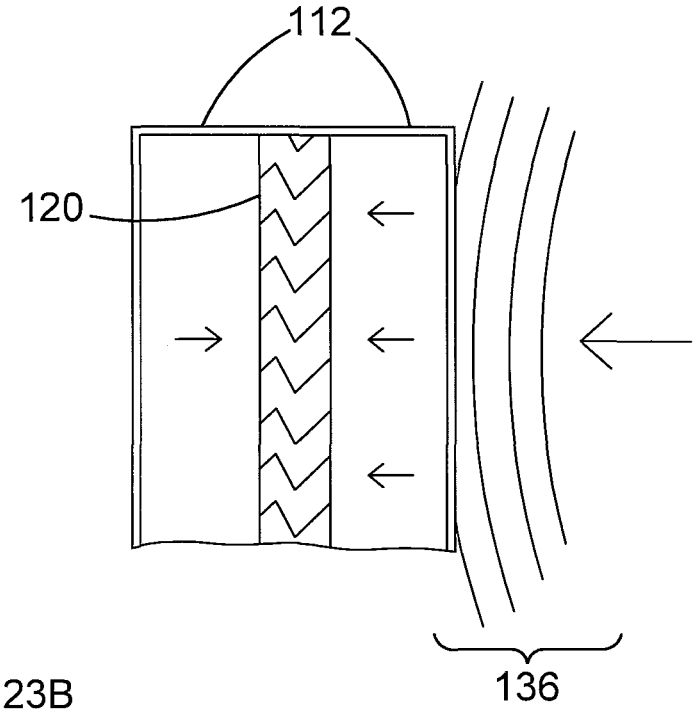
FIG. 23B shows schematically in cross-sectional view the effect of an impact on a layered composite panel of the invention (not drawn to scale).

In FIGS. 23A and 23B, a layered composite panel is shown having two first solid open-cell foam panels (112) sandwiching a lower density second solid open-cell foam panel (120). An energy wave (136) is shown approaching the composite panel in FIG. 23A, and impacting on the composite panel in FIG. 23B. As shown in FIG. 23B, the impact compresses the lower density second solid open-cell foam panel. The first solid open-cell foam panel remains intact.

EXAMPLES

Example 1

A blast resistant panel was constructed from a core consisting of a single solid open-cell phenolic resin foam panel (82 mm thickness), a first surface layer of SMC (1.5 mm) and a second surface layer of SMC (1.5 mm). A layer of orientated glass fibre fabric (1 mm) was provided between the phenolic resin foam panel and the first surface layer of SMC. The constituent layers of the blast-resistant panel were assembled and heated and pressed to cure the SMC, such that a curable material from the first surface layer of SMC penetrated the orientated glass fibre fabric and the surface of the phenolic resin foam, and a cura material from the second surface layer of SMC penetrated the opposite surface of the phenolic resin foam panel. The resulting panel had a thickness of 85 mm. A layer of Kevlar™ webbing (a poly-aramid webbing) was fixed to the second surface layer of SMC.

Four of these panels, measuring 2.0 m in height and 0.80 m in width were assembled adjacent to one another in a steel frame using expansion clips, so as to form a wall of approximately 2.4 m in height and 4.0 m in width.

An explosive charge (1800 kg of ammonium nitrate-fuel oil) was detonated at a distance of 70 m from the wall, to produce a shock wave having an impulse of 150 $psi \cdot ms^{-1}$.

A pressure monitor positioned behind the wall during the detonation recorded no change in pressure due to the explosive blast. In addition, no damage to the panels was observed.

Example 2

A blast resistant panel was constructed from a core comprising a first solid open-cell phenolic resin foam panel (40 mm thickness) bonded to a reinforcing layer of glass fibre reinforced plastic (13 mm) which was itself bonded to a second solid open-cell phenolic resin foam panel (40 mm thickness). Thus, the core comprised a glass fibre reinforced plastic material bonded between two phenolic resin foam panels. A first surface layer of SMC (1.5 mm) and a second surface layer of SMC (1.5 mm) were bonded to the first and second solid open-cell foam panels, respectively. A layer of orientated glass fibre fabric (1 mm) was provided between the first solid open-cell phenolic resin foam panel and the first surface layer of SMC. The constituent layers of the blast-resistant panel were assembled, heated and pressed to cure the SMC, such that a curable material from the first surface layer of SMC penetrated the orientated glass fibre fabric and the surface of the first solid open-cell phenolic resin foam panel, and a curable material from the second surface layer of SMC penetrated the opposite surface of the phenolic resin foam panel. The resulting panel had a thickness of 85 mm. A layer of Kevlar™ webbing (a poly-aramid webbing) was fixed to the second surface layer of SMC.

As above, four of these panels, measuring 2.0 m in height and 0.80 m in width were assembled adjacent to one another in a steel frame using expansion clips, so as to form a wall of approximately 2.4 m in height and 4.0 m in width.

An explosive charge (1800 kg of ammonium nitrate-fuel oil) was detonated at a distance of 70 m from the wall, to produce a shock wave having an impulse of 150 $psi \cdot ms^{-1}$.

A pressure monitor positioned behind the wall during the detonation recorded no change in pressure due to the explosive blast. In addition, no damage to the panels was observed.

Comparative Example 3

A wall measuring approximately 2.4 m in height, 4.0 m in width and 0.20 m in depth was constructed from concrete blocks of approximate dimensions 15 cm in height, 30 cm in length and 20 cm in depth and standard building mortar.

Figure 24:
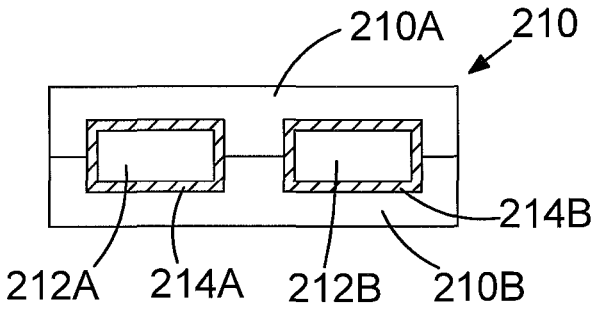
FIG. 24 shows a schematic cross-sectional view of a composite material panel for use according to the invention.

An explosive charge (1800 kg of ammonium nitrate-fuel oil) was detonated at a distance of 70 m from the wall, to produce a shock wave having an impulse of 150 $psi \cdot ms^{-1}$. The wall was totally demolished, with none of the mortar joints remaining intact and with a majority of the concrete blocks fragmenting Thermal Composite Examples FIG. 24 shows a schematic cross-sectional view of a composite material panel for use according to the invention. The panel shown in FIG. 24 comprises a solid open-cell foam panel (210) which is formed from a first solid open-cell foam panel (210A) and a second solid open-cell foam panel (210B). The first and second solid open-cell foam panels (210A,210B) are each provided with complementary recesses which define internal voids (212A,212B), the peripheral surfaces of which are provided with an air-tight sealing coating (214A,214B).

Figure 25:
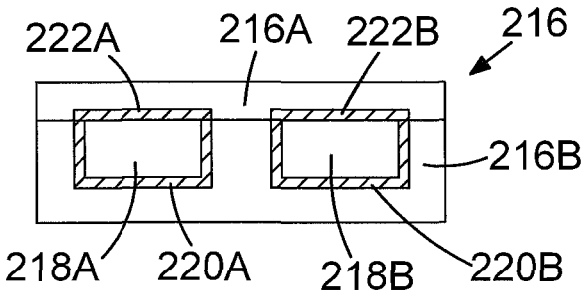
FIG. 25 shows a schematic cross-sectional view of an alternative embodiment of a composite material panel for use according to the invention.

FIG. 25 shows a schematic cross-sectional view of an alternative embodiment of a composite material panel for use according to the invention. The panel shown in FIG. 25 comprises a solid open-cell foam panel (216) which is formed from a first solid open-cell foam panel (216A) and a second solid open-cell foam panel (216B). The first solid open-cell foam panel (216A) has substantially planar surface adjacent to the second solid open-cell foam panel (216B) which is provided with recesses which define internal voids (218A,218B). The peripheral surfaces of the internal voids (218A,218B) are provided with an air-tight sealing coating (220A, 220B, 222A, 222B).

Figure 26:
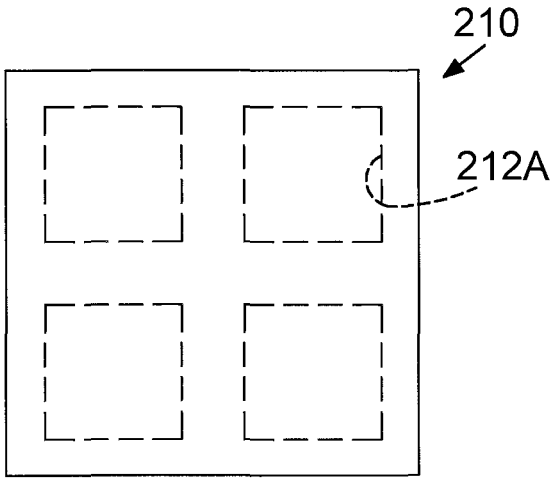
FIG. 26 shows a schematic plan view of a composite material panel for use according to the invention as shown in FIG. 24.

FIG. 26 shows a schematic plan view of a composite material panel for use according to the invention as shown in FIG. 24. The location of internal voids (212A) is shown in outline. It will be appreciated that FIG. 26 can equally represent the embodiment of the panel shown in FIG. 25.

Figure 27:
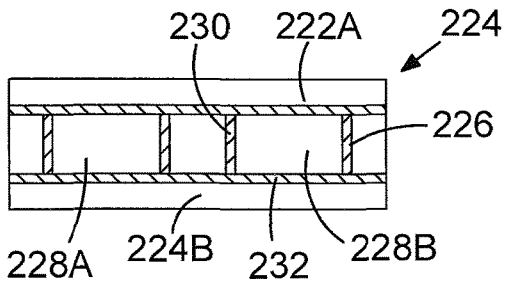
FIG. 27 shows a schematic cross-sectional view of a further alternative embodiment of a composite material panel for use according to the invention.

FIG. 27 shows a schematic cross-sectional view of a further alternative embodiment of a composite material panel for use according to the invention. The panel comprises a solid open-cell foam panel (224) which is formed from a first solid open-cell foam panel (224A) and a second solid open-cell foam panel (224B). The first and second solid open-cell foam panels (224A,24B) are separated by rails (226) and stiles (not shown) so as to define internal voids (228A,228B). The peripheral surfaces of the internal voids (228A,228B) are provided with an air-tight sealing coating (230). In the embodiment shown, the air-tight sealing coating material is provided across the entire surfaces (232) of the first and second solid open-cell foam panels (224A,224B) so as to hermetically seal the internal voids (228A,228B) and to bond the first and second solid open-cell foam panels (224A,224B) to the rails (226) and stiles.

Figure 28:
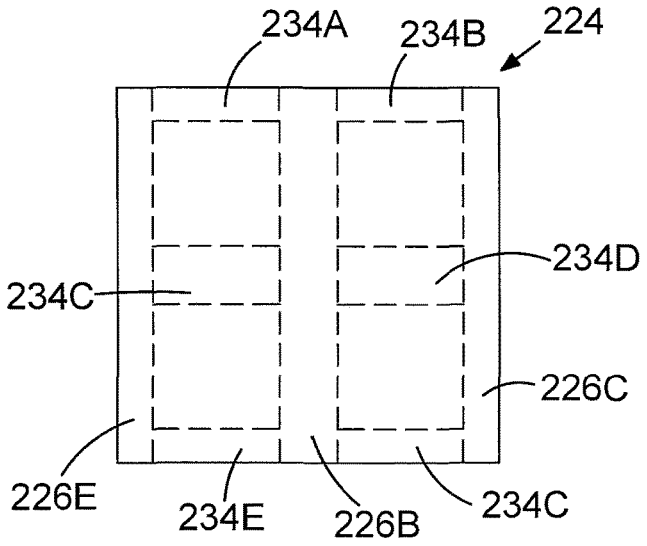
FIG. 28 shows a schematic plan view of a composite material panel for use according to the invention as shown in FIG. 4.

FIG. 28 shows a schematic plan view of a composite material panel for use according to the invention as shown in FIG. 4. The location of rails (226A,226B,226C) and stiles (234A,234B,234C,234D,234E,234F) are shown in outline.

Figure 29:
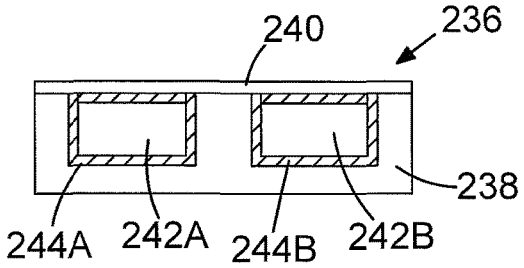
FIG. 29 shows a schematic cross-sectional view of a composite material panel for use according to the invention.

FIG. 29 shows a schematic cross-sectional view of a composite material panel for use according to the invention. The panel comprises an insulating layer (236) which is formed from a solid open-cell foam panel (238) and a layer of sheet-form polymeric material (240). The solid open-cell foam panel (238) is provided with recesses which, together with the layer of sheet-form polymeric material (240) define internal voids (242A,242B). The surfaces of the solid-open cell foam panel and the surfaces of the sheet-form polymeric material peripheral to the internal void are provided with an air-tight sealing coating (244A,244B).

Figure 30:
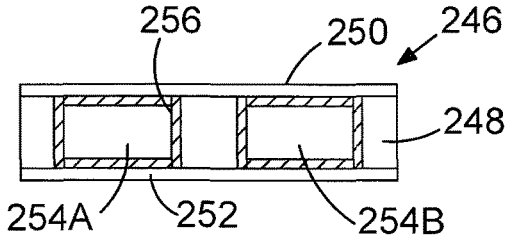
FIG. 30 shows a schematic cross-sectional view of an alternative embodiment of a composite material panel for use according to the invention.

FIG. 30 shows a schematic cross-sectional view of an alternative embodiment of a composite material panel for use according to the invention. The panel comprises an insulating layer (236) which is formed from a solid open-cell foam panel (248), a first layer of sheet-form polymeric material (250) and a second layer of sheet-form polymeric material (252). The solid open-cell foam panel (248) is provided with openings which extend through the entire thickness of the panel (248). Together with the first and second layers of sheet-form polymeric material (250,252) the openings define internal voids (254A,254B). The surfaces of the solid-open cell foam panel and the surfaces of the sheet-form polymeric material peripheral to the internal void are provided with an air-tight sealing coating (256).

Figure 31:
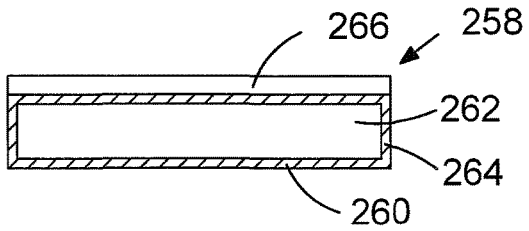
FIG. 31 shows a schematic cross-sectional view of a composite material panel for use according to the invention.

FIG. 31 shows a schematic cross-sectional view of a composite material panel (258) for use according to the invention. The panel comprises a first insulating layer (260) comprising a solid open-cell foam (262) having an air-tight sealing coating (264), and a first sheet-form polymeric material layer (266).

Figure 32:
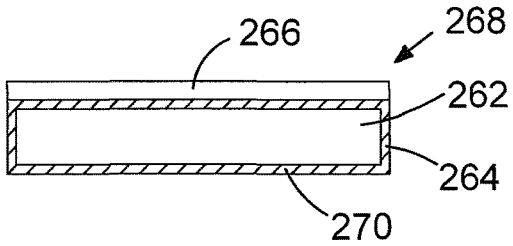
FIG. 32 shows a schematic cross-sectional view of an alternative embodiment of a composite material panel for use according to the invention.

FIG. 32 shows a schematic cross-sectional view of an alternative embodiment of a composite material panel (268) for use according to the invention. As in FIG. 31, the panel comprises a first insulating layer comprising a solid open-cell foam (262) having an air-tight sealing coating (264) and a first sheet-form polymeric material layer (266). A second sheet-form polymeric material layer (270) is additionally provided on the opposite face of the first insulating layer to the first sheet-form polymeric material layer (266).

Figure 33:
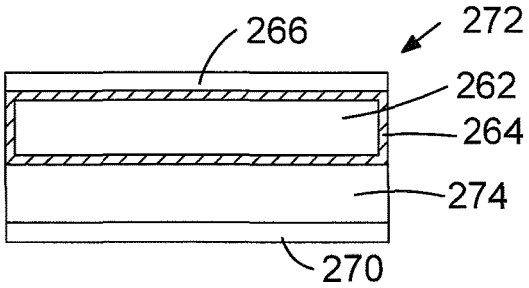
FIG. 33 shows a schematic cross-sectional view of an alternative embodiment of a composite material panel for use according to the invention.

FIG. 33 shows a schematic cross-sectional view of an alternative embodiment of a composite material panel (268) for use according to the invention. As in FIG. 32, the panel comprises a first insulating layer comprising a solid open-cell foam (262) having an air-tight sealing coating (264) and first and second sheet-form polymeric material layers (266, 270). An additional insulating layer (274), such as an open-cell foam layer is provided between the first insulating layer and the second sheet-form polymeric material layer (270).

Figure 34:
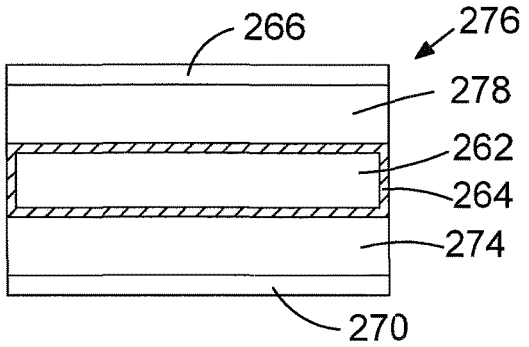
FIG. 34 shows a schematic cross-sectional view of an alternative embodiment of a composite material panel for use according to the invention.

FIG. 34 shows a schematic cross-sectional view of an alternative embodiment of a composite material panel (276) for use according to the invention. As in FIG. 33, the panel comprises a first insulating layer comprising a solid open-cell foam (262) having an air-tight sealing coating (264), first and second sheet-form polymeric material layers (266, 270) and an additional insulating layer (274). A further additional insulating layer (278) is provided between the first insulating layer and the first sheet-form polymeric material layer (266).

Figure 35:
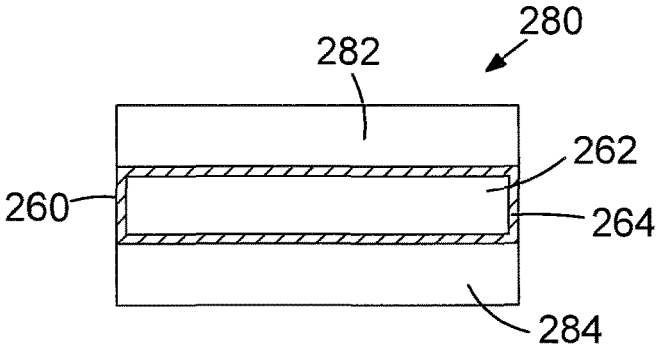
FIG. 35 shows a schematic cross-sectional view of a composite material panel for use according to the invention.

FIG. 35 shows a schematic cross-sectional view of a composite material panel (280) for use according to the invention. The panel comprises a first insulating layer (260) comprising a solid open-cell foam (262) having an air-tight sealing coating (264). Additional insulating layers (282,284) are provided on opposite faces of the first insulating layer (260).

Figure 36:
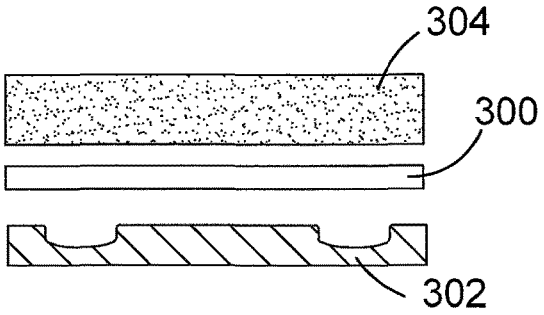
FIGS. 36 to 38 illustrate the formation of a profiled surface of the layered composite material panels of the invention by a moulding process.
Figure 37:
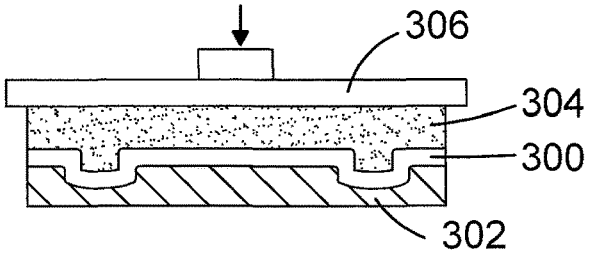
Figure 38:
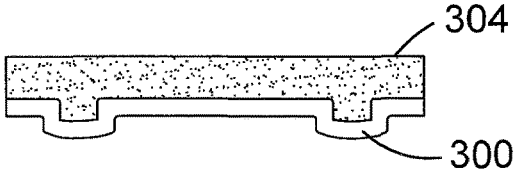

As shown in FIGS. 36 to 38, a profiled surface of the layered composite material panels of the invention may be formed by a moulding process. In FIGS. 36 to 38, the moulding process is shown by reference to the composite materials the third aspect of the invention, although it will be appreciated that the same process may also be applied to form composite materials according to the other aspects of the invention having a contoured surface.

Thus, a layer of sheet-form polymeric material (300), preferably SMC, is applied to the upper surface of a mould (302). The sheet-form polymeric material (300) is preferably sized so as to extend across the whole of the mould surface. Onto the sheet-form polymeric material (300) is applied a solid open-cell foam foam layer (304). The foam used is advantageously:

structural and has load bearing properties;

frangible and can be formed under pressure;

inelastic, such that it substantially retains its pressed form; and open cell such that gases may escape from the foam matrix during pressing and such that curable materials in the sheet-form polymeric material can migrate into the open cells of the foam so as to form a strong bond between the sheet-form polymeric material and the foam.

Downward pressure is applied to the components as shown in FIG. 37 using a pressure plate (306). The foam layer (304) is pressed toward the lower mould surface (302), crushing the foam and moulding the lower surface of the foam (304) to the shape of the mould surface (302). The sheet-form polymeric material (300) is also pressed between the mould surface and the foam layer (304). Where SMC is used as the sheet-form polymeric material, the mould surface is preferably heated. Under action of the pressing member, the SMC begins to liquefy and flows into cells at the surface of the foam.

Air and other gases trapped between the sheet-form polymeric material (300) and the foam layer (304) pass through the open cell structure of the foam. The components are held in the mould with the application of pressure for a sufficient time for the formation of a bond between the layers, e.g. the curing time of the SMC. The resulting product is then removed from the mould as shown in FIG. 38, and may subsequently be bonded to a first insulating layer as described above.

Figure 39:
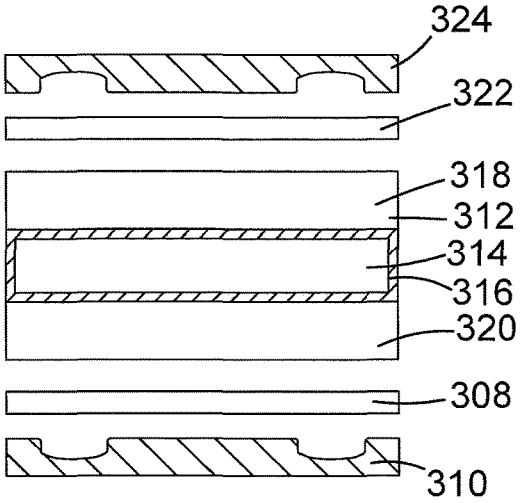
FIGS. 39 to 41 illustrate the formation of layered composite material panels of the invention having a profiled surface on both faces by a moulding process.
Figure 40:
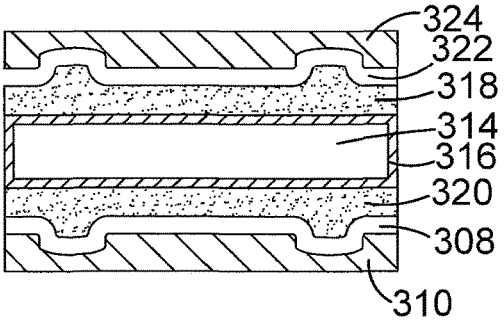
Figure 41:
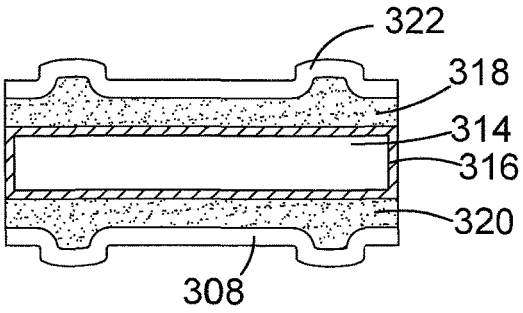

As shown in FIGS. 39 to 41, layered composite material panels of the invention having a profiled surface on both faces may also be formed by a moulding process. Thus, a layer of sheet-form polymeric material (308), preferably SMC, is applied to the upper surface of a mould (310). The sheet-form polymeric material (308) is preferably sized so as to extend across the whole of the mould surface. Onto the sheet-form polymeric material (308) is applied a three layer composite panel comprising a first insulating layer (312) comprising a solid open cell foam (314) having an air-tight sealing coating (316). The first insulating layer (312) sandwiched between two additional insulating foam layers (318, 320). As above, the additional insulating foam layers (318, 320) are advantageously:

structural and have load bearing properties;

frangible and can be formed under pressure;

inelastic, such that they substantially retain their pressed form; and open cell such that gases may escape from the foam matrix during pressing and such that curable materials in the sheet-form polymeric material can migrate into the open cells of the foam so as to form a strong bond between the sheet-form polymeric material and the foam.

A further layer of sheet-form polymeric material (322), preferably SMC, is applied to the upper surface of the insulating foam layer (318), and a second mould (324) is disposed above the sheet-form polymeric material (322).

Downward pressure is applied to the components as shown in FIG. 40 using a pressure plate (not shown). The foam layer (320) is pressed toward the lower mould surface (310), crushing the foam and moulding the lower surface of the foam (320) to the shape of the mould surface (310). The sheet-form polymeric material (308) is also pressed between the mould surface (310) and the foam layer (320). Simultaneously, the foam layer (318) is pressed toward the upper mould surface (324), crushing the foam and moulding the upper surface of the foam (318) to the shape of the mould surface (324). The sheet-form polymeric material (322) is also pressed between the mould surface (324) and the foam layer (318). Preferably, the foam layers (318,320) are selected such that crushing of the foam is progressive, such that most crushing takes place adjacent the mould surfaces. In this way, damage to the air-tight sealing coating of the first insulating layer, and therefore compromise of the air-tight seal, is avoided.

As above, air and other gases trapped between the sheet-form polymeric materials (308,322) and the foam layers (318,320) pass through the open cell structure of the foam layers. The components are held in the mould with the application of pressure for a sufficient time for the formation of a bond between the layers, e.g. the curing time of the SMC. The resulting product is then removed from the mould as shown in FIG. 41.

Figure 42:
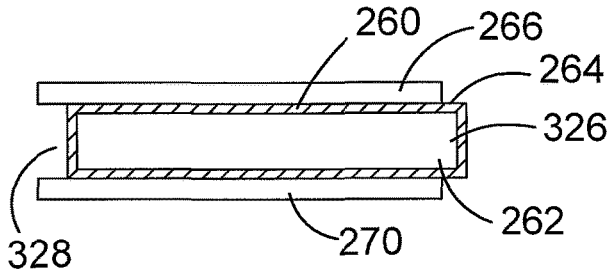
FIG. 42 shows the composite material of FIG. 32, wherein the first insulating layer is offset relative to the sheet-form polymeric material layers so as to form a tongue portion and a groove portion.
Figure 43:
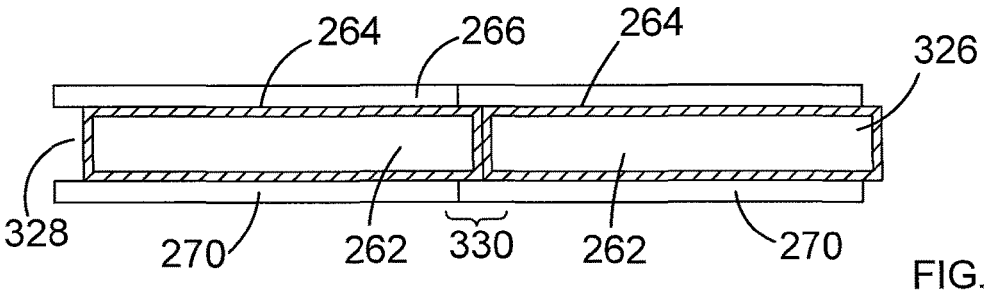
FIG. 43 shows a tongue and groove joint of two panels of FIG. 42.
Figure 44:
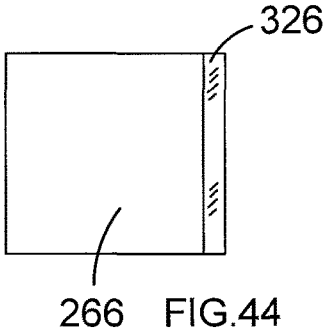
FIG. 44 shows that the offset of the joint shown in FIG. 43 may be linear.
Figure 45:
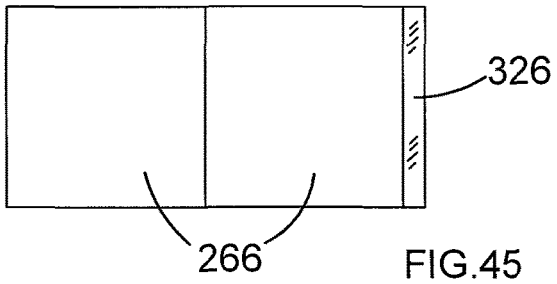
FIG. 45 shows a two-dimensional array of the panels of FIG. 42, connected linearly.
Figure 46:
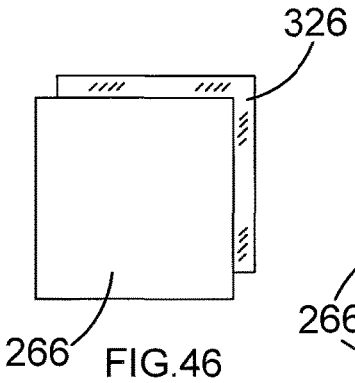
FIG. 46 shows that the offset of the joint shown in FIG. 43 may be diagonal.
Figure 47:
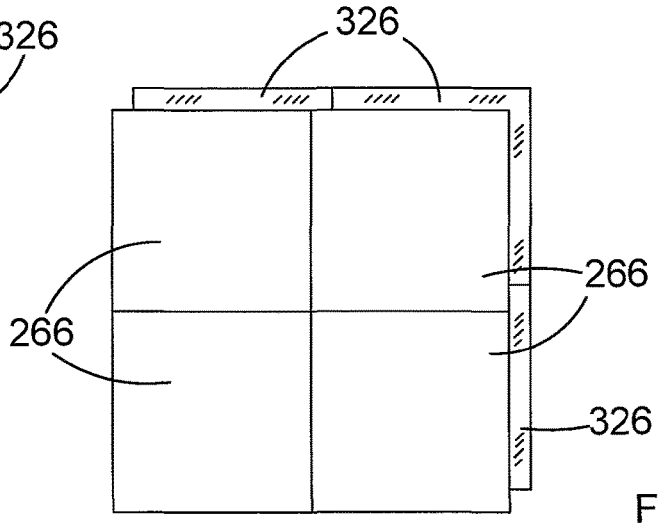
FIG. 47 shows a three-dimensional array of the panels of FIG. 42, connected diagonally.

FIG. 42 represents the composite material of FIG. 32, wherein the first insulating layer (260) is offset relative to the sheet-form polymeric material layers (266,270) so as to form a tongue portion (326) and a groove portion (328). The tongue and groove portions allow a series of panels to be joined together by way of a tongue and groove joint (330), as shown in FIG. 43. The offset may be linear, as shown in FIG. 44, such that a two-dimensional array of panels may be formed, as shown in FIG. 45. Alternatively, the offset may be diagonal, as shown in FIG. 46, such that a three-dimensional array of panels may be formed, as shown in FIG. 47. Although FIGS. 42 to 47 relate to the composite material of the FIG. 32, it will be appreciated that the same arrangement may be used to join panels according to the other aspects of the invention.

The invention claimed is:

1. A modular building having a generally triangular transverse sectional profile, wherein the modular building comprises a double sloping roof over the generally triangular transverse sectional profile, wherein the double sloping roof is formed by one or more double sloping roof panels, wherein the one or more double sloping roof panels comprise composite panel material, wherein the generally triangular transverse sectional profile is formed from a frame, wherein shock absorbent material interposes the frame and the composite panel material, and wherein the shock absorbent material comprises one or more frangible materials, one or more expansion clips, or a combination thereof.

2. The modular building as claimed in claim 1, wherein the one or more double sloping roof panels is an array of double sloping roof panels with adjoining double sloping edges.

3. The modular building as claimed in claim 1, wherein the modular building comprises a pair of mutually spaced triangular end walls, wherein each triangular end wall is saddled on two upper edges by the double sloping roof.

4. The modular building as claimed in claim 3, wherein each triangular end wall is formed by end wall panels, wherein the end wall panels comprise composite panel material.

5. The modular building as claimed in claim 4, wherein the end wall panels have at least one aperture equipped with a window or a door.

6. The modular building as claimed in claim 1, wherein the double sloping roof panels have at least one aperture equipped with a window or a door.

7. The modular building as claimed in claim 1, wherein the modular building comprises at least one cross member spanning the double sloping roof.

8. The modular building as claimed in claim 7, wherein the at least one cross member comprises a floor panel, wherein the floor panel comprises composite panel material.

9. The modular building as claimed in claim 8, wherein the floor panel has an aperture for a stairway.

10. The modular building as claimed in claim 7, wherein the at least one cross member comprises an elongate cross bar and wherein the elongate cross bar provides support for the floor panel.

11. The modular building as claimed in claim 1, wherein each double sloping roof panel is formed by a pair of mutually inclined roof sections, wherein the inclined roof sections meet along edges defining a ridge, and wherein the frame of the double sloping roof panel is articulated at the ridge.

12. The modular building as claimed in claim 11, wherein the frame of the double sloping roof panel is articulated by at least one hinge.

13. A method of assembling a modular building as claimed in claim 1, comprising the steps of:

(a) erecting a double sloping roof panel having a frame clad with a composite panel material;

(b) erecting a subsequent double sloping roof panel adjacent the previous double sloping roof panel;

(c) repeating steps (a) and (b) until all the double sloping roof panels have been erected in an array; and (d) connecting all adjacent double sloping edges to form a double sloping roof; and (e) interposing shock absorbent material between the frame and the composite panel material.

14. The method of assembling the modular building as claimed in claim 13, comprising a step (f) of erecting a pair of mutually spaced triangular end walls.

15. The method of assembling the modular building as claimed in claim 13, comprising a step (g) of equipping the end wall panels with a window or a door.

16. The method of assembling the modular building as claimed in claim 13, comprising a step (h) of equipping the double sloping roof panels with a window or a door.

17. The method of assembling the modular building as claimed in claim 13, comprising a step (i) of equipping the modular building with at least one cross member spanning the double sloping roof panels.

18. The method of assembling the modular building as claimed in claim 13, comprising a first step (j) preceding all other steps of founding the modular building upon at least one cross member spanning lower edges of the double sloping roof.

19. The method of assembling the modular building as claimed in claim 13, comprising a step (k) of providing at least one floor panel made of composite panel material.

20. The method of assembling the modular building as claimed in claim 13, comprising a step (l) of providing an aperture in the at least one floor panel for a stairway.

21. The method of assembling the modular building as claimed in claim 13, comprising a step (m) of providing at least one elongate cross bar in support of the floor panel.

22. The method of assembling the modular building as claimed in claim 13, comprising a step (n) of unfolding the double sloping roof panels to the appropriate angle.

23. The method of assembling the modular building as claimed in claim 22, comprising a step (o) of providing a frame of each inclined section with a pair of elongate parallel side bars.

24. The method of assembling the modular building as claimed in claim 22, comprising a step (p) of capping a ridge formed by the double sloping roof panels.

25. A modular building village, comprising a plurality of modular buildings as claimed in claim 1, wherein neighboring modular buildings are coupled by elevated walkway.

26. The modular building according to claim 1, wherein the composite panel material is a laminate.

27. The modular building according to claim 26 wherein the composite panel material comprises solid phenolic resin foams.

28. The modular building according to claim 26, wherein the composite panel material comprises sheet-form polymeric material.

29. The modular building according to claim 1, wherein the composite panel material comprises: (i) a core comprising a first solid, open-cell foam panel and a second solid foam panel, wherein the foam panels are bonded together by an adhesive or other bonding agent so as to form a monolithic layered structure; and (ii) a first surface layer of a sheet form polymeric material, wherein the sheet form polymeric material is bonded to a surface of the core, with the proviso that the adhesive or other bonding agent does not form an air-tight sealing coating around a foam panel of the core.

30. The modular building according to claim 1 comprising the use of a composite material panel in a modular building as herein described, wherein the composite material panel comprises a first insulating layer comprising a solid open-cell foam panel having at least one internal void provided therein, wherein the peripheral surfaces of the internal void are provided with an air-tight sealing coating.

31. The modular building according to claim 28, wherein the composite panel material comprises sheet-form polymeric material comprising SMC.

32. The modular building according to claim 28, wherein the sheet-form polymeric material includes a thermosetting resin with a plurality of reinforcing fibers.

* * * * *